US005871238A

United States Patent [19]

Furniss

[11] Patent Number: 5,871,238

[45] Date of Patent: Feb. 16, 1999

[54] METHOD OF MODIFYING AND ARRANGING BIBLE TEXT AND IDENTIFYING BIBLE TEXT PAGES FOR PUBLISHING QUICK-REFERENCE BIBLES

[76] Inventor: Delma Furniss, P.O. Box 104, Rena Lara, Miss. 38767

[21] Appl. No.: 528,025

[22] Filed: Sep. 14, 1995

[51] Int. Cl.[6] ..... B42D 15/00

[52] U.S. Cl. ..... 283/67; 283/36

[58] Field of Search ..... 283/67, 70, 36–43, 283/117, 63.1; 281/15.1, 21.1, 38; 434/156, 178, 179, 245

[56] References Cited

U.S. PATENT DOCUMENTS

| | | | |
|---|---|---|---|
| 3,463,515 | 8/1969 | Thompson | 283/37 |
| 3,561,147 | 2/1971 | Valencia | 40/360 |
| 3,995,389 | 12/1976 | Mathis | 40/360 |
| 4,019,759 | 4/1977 | Stanton | 283/42 |
| 4,978,143 | 12/1990 | Ericson . | |

OTHER PUBLICATIONS

Webster's New International Dictionary of the English Language –p.2683, Dec. 1939.

Declaration and Power of Attorney for Patent Application (German Language Declaration), pp. 1 and 2, Aug. 1983.

Webster's II New Riverside University Dictionary –p. 170 – "Books of the Bible" Chart, Dec. 1984.

MISSA –(The Order of Catholic Mass in eight languages) – p. 48, Sep. 1986.

The Rosetta Stone as shown in the New Encyclopedia Britannica –p. 187.

*Primary Examiner*—Willmon Fridie, Jr.

[57] ABSTRACT

A method of modifying and arranging Bible text (32) and identifying each Bible page (30) for publishing quick-reference Bibles, whereby predetermined segments of Bible text (32) are allocated for each predetermined Bible page (30) so that said segments of Bible text (32) and like segments of equivalent Bible text (32) of other Bible versions, editions, and languages, can be published on the space available on each predetermined Bible page (30) so that Bible text references in Bibles published using this method can be cited by page identification number (36) and quickly and easily located in one and all said Bibles by page identification number (36), regardless of version, edition, or language of Bible used.

12 Claims, 48 Drawing Sheets

THE FIRST BOOK OF MOSES, CALLED

GENESIS

CHAPTER 1

IN the beginning God created the heaven and the earth.
2 And the earth was without form, and void; and darkness was upon the face of the deep. And the Spirit of God moved upon the face of the waters.
3 And God said, Let there be light: and there was light.
4 And God saw the light, that it was good: and God divided the light from the darkness.
5 And God called the light Day, and the darkness he called Night. And the evening and the morning were the first day.
6 And God said, Let there be a firmament in the midst of the waters, and let it divide the waters from the waters.
7 And God made the firmament, and divided the waters which were under the firmament from the waters which were above the firmament: and it was so.
8 And God called the firmament Heaven. And the evening and the morning were the second day.
9 And God said, Let the waters under the heaven be gathered together unto one place, and let the dry *land* appear: and it was so.
10 And God called the dry *land* Earth; and the gathering together of the waters called he Seas: and God saw that *it* was good.
11 And God said, Let the earth bring forth grass, the herb yielding seed, and the fruit tree yielding fruit after his kind, whose seed *is* in itself, upon the earth: and it was so.
12 And the earth brought forth grass, *and* herb yielding seed after his kind, and the tree yielding fruit, whose seed was in itself, after his kind: and God saw that *it was* good.
13 And the evening and the morning were the third day.
14 And God said, Let there be lights in the firmament of the heaven to divide the day from the night; and let them be for signs, and for seasons, and for days, and years:
15 And let them be for lights in the firmament of the heaven to give light upon the earth: and it was so.
16 And God made two great lights; the greater light to rule the day, and the lesser light to rule the night: *he made* the stars also.
17 And God set them in the firmament of the heaven to give light upon the earth,
18 And to rule over the day and over the night, and to divide the light from the darkness: and God saw that *it was* good.
19 And the evening and the morning were the fourth day.
20 And God said, Let the waters bring forth abundantly the moving creature that hath life, and fowl *that* may fly above the earth in the open firmament of heaven.
21 And God created great whales, and every living creature that moveth, which the waters brought forth abundantly, after their kind, and every winged fowl after his kind: and God saw that *it was* good.
22 And God blessed them, saying, Be fruitful, and multiply, and fill the waters in the seas, and let fowl multiply in the earth.
23 And the evening and the morning were the fifth day.
24 And God said, Let the earth bring forth the living creature after his kind, cattle, and creeping thing, and beast of the earth after his kind: and it was so.

KING JAMES VERSION

| 72 COL.A | 74 COL.B | 72 COL.A | 74 OLD TESTAMENT COL.B | 72 COL.A | 74 COL.B |
|---|---|---|---|---|---|
| 1 | GENESIS 1:1 - 1:24 | 29 | 24:60 -25:18 | 57 | 43:21 -44:8 |
| 2 | 1:25 - 2:15 | 30 | 25:19 -26:8 | 58 | 44:9 -44:34 |
| 3 | 2:16 - 3:13 | 31 | 26:9 -26:32 | 59 | 45:1 -45:22 |
| 4 | 3:14 - 4:4 | 32 | 26:33 -27:24 | 60 | 45:23 -46:18 |
| 5 | 4:5 - 4:24 | 33 | 27:25 -27:40 | 61 | 46:19 -47:8 |
| 6 | 4:25 - 5:29 | 34 | 27:41 -28:16 | 62 | 47:9 -47:28 |
| 7 | 5:30 - 6:22 | 35 | 28:17 -29:19 | 63 | 47:29 -48:16 |
| 8 | 7:1 - 7:24 | 36 | 29:20 -30:13 | 64 | 48:17 -49:9 |
| 9 | 8:1 - 8:22 | 37 | 30:14 -30:36 | 65 | 49:10 -49:24 |
| 10 | 9:1 - 9:23 | 38 | 30:37 -31:16 | 66 | 49:25 -50:9 |
| 11 | 9:24 -10:20 | 39 | 31:17 -31:39 | 67 | 50:10 -50:26 |
| 12 | 10:21 -11:18 | 40 | 31:40 -32:7 | 68 | EXODUS 1:1 - 1:21 |
| 13 | 11:19 -12:9 | 41 | 32:8 -32:31 | 69 | 1:22 - 2:21 |
| 14 | 12:10 -13:13 | 42 | 32:32 -34:2 | 70 | 2:22 - 3:15 |
| 15 | 13:14 -14:17 | 43 | 34:3 -34:26 | 71 | 3:16 - 4:10 |
| 16 | 14:18 -15:17 | 44 | 34:27 -35:12 | 72 | 4:11 - 5:1 |
| 17 | 15:18 -16:16 | 45 | 35:13 -36:10 | 73 | 5:2 - 5:23 |
| 18 | 17:1 -17:22 | 46 | 36:11 -36:35 | 74 | 6:1 - 6:22 |
| 19 | 17:23 -18:19 | 47 | 36:36 -37:14 | 75 | 6:23 - 7:15 |
| 20 | 18:20 -19:8 | 48 | 37:15 -38:3 | 76 | 7:16 - 8:9 |
| 21 | 19:9 -19:30 | 49 | 38:4 -38:25 | 77 | 8:10 - 8:29 |
| 22 | 19:31 -20:14 | 50 | 38:26 -39:17 | 78 | 8:30 -9:18 |
| 23 | 20:15 -21:21 | 51 | 39:18 -40:17 | 79 | 9:19 -10:2 |
| 24 | 21:22 -22:11 | 52 | 40:18 -41:19 | 80 | 10:3 -10:21 |
| 25 | 22:12 -23:11 | 53 | 41:20 -41:45 | 81 | 10:22 -12:2 |
| 26 | 23:12 -24:13 | 54 | 41:46 -42:12 | 82 | 12:3 -12:21 |
| 27 | 24:14 -24:36 | 55 | 42:13 -42:36 | 83 | 12:22 -12:41 |
| 28 | 24:37 -24:59 | 56 | 42:37 -43:20 | 84 | 12:42 -13:12 |

OLD TESTAMENT WORKABLE MODEL

THE FIRST BOOK OF MOSES, CALLED

GENESIS

30

CHAPTER 1

IN the beginning God created the heaven and the earth.
2 And the earth was without form, and void; and darkness *was* upon the face of the deep. And the Spirit of God moved upon the face of the waters.
3 And God said, Let there be light: and there was light.
4 And God saw the light, that *it was* good: and God divided the light from the darkness.
5 And God called the light Day, and the darkness he called Night. And the evening and the morning were the first day.
6 And God said, Let there be a firmament in the midst of the waters, and let it divide the waters from the waters.
7 And God made the firmament, and divided the waters which *were* under the firmament from the waters which *were* above the firmament: and it was so.
8 And God called the firmament Heaven. And the evening and the morning were the second day.
9 And God said, Let the waters under the heaven be gathered together unto one place, and let the dry *land* appear: and it was so.
10 And God called the dry *land* Earth; and the gathering together of the waters called he Seas: and God saw that *it was* good.
11 And God said, Let the earth bring forth grass, the herb yielding seed, *and* the fruit tree yielding fruit after his kind, whose seed *is* in itself, upon the earth: and it was so.
12 And the earth brought forth grass, *and* herb yielding seed after his kind, and the tree yielding fruit, whose seed *was* in itself, after his kind: and God saw that *it was* good.
13 And the evening and the morning were the third day.
14 And God said, Let there be lights in the firmament of the heaven to divide the day from the night; and let them be for signs, and for seasons, and for days, and years:
15 And let them be for lights in the firmament of the heaven to give light upon the earth: and it was so.
16 And God made two great lights; the greater light to rule the day, and the lesser light to rule the night: *he made* the stars also.
17 And God set them in the firmament of the heaven to give light upon the earth,
18 And to rule over the day and over the night, and to divide the light from the darkness: and God saw that *it was* good.
19 And the evening and the morning were the fourth day.
20 And God said, Let the waters bring forth abundantly the moving creature that hath life, and fowl *that* may fly above the earth in the open firmament of heaven.
21 And God created great whales, and every living creature that moveth, which the waters brought forth abundantly, after their kind, and every winged fowl after his kind: and God saw that *it was* good.
22 And God blessed them, saying, Be fruitful, and multiply, and fill the waters in the seas, and let fowl multiply in the earth.
23 And the evening and the morning were the fifth day.
24 And God said, Let the earth bring forth the living creature after his kind, cattle, and creeping thing, and beast of the earth after his kind: and it was so.

32

34

36

1

FIG. 1A KING JAMES VERSION

GENESIS

30

1 WHEN GOD BEGAN creating[a] the heavens and the earth, [2] the earth was at first[b] a shapeless, chaotic mass,[c] with the Spirit of God brooding over the dark vapors.[d]
[3] Then[b] God said, "Let there be light." And light appeared. [4,5] And God was pleased with it, and divided the light from the darkness. So he let it shine for awhile, and then there was darkness again. He called the light "daytime," and the darkness "nighttime." Together they formed the first day.[e]
[6] And God said, "Let the vapors separate[f] to form the sky above and the oceans below." [7,8] So God made the sky, dividing the vapor above from the water below. This all happened on the second day.[g]
[9,10] Then God said, "Let the water beneath the sky be gathered into oceans so that the dry land will emerge." And so it was. Then God named the dry land "earth," and the water "seas." And God was pleased. [11,12] And he said, "Let the earth burst forth with every sort of grass and seed-bearing plant, and fruit trees with seeds inside the fruit, so that these seeds will produce the kinds of plants and fruits they came from." And so it was, and God was pleased. [13] This all occurred on the third day.[h]
[14,15] Then God said, "Let there be bright lights in the sky to give light to the earth and to identify the day and the night; they shall bring about the seasons on the earth, and mark the days and years." And so it was. [16] For God made two huge lights, the sun and moon, to shine down upon the earth—the larger one, the sun, to preside over the day and the smaller one, the moon, to preside through the night; he also made the stars. [17] And God set them in the sky to light the earth, [18] and to preside over the day and night, and to divide the light from the darkness. And God was pleased. [19] This all happened on the fourth day.[i]
[20] Then God said, "Let the waters teem with fish and other life, and let the skies be filled with birds of every kind." [21,22] So God created great sea creatures, and every sort of fish and every kind of bird. And God looked at them with pleasure, and blessed them all. "Multiply and stock the oceans," he told them, and to the birds he said, "Let your numbers increase. Fill the earth!" [23] That ended the fifth day.[j]
[24] And God said, "Let the earth bring forth every kind of animal—cattle and reptiles and wildlife of every kind." And so it was.

38

32

34

36

1

FIG. 1B LIVING BIBLE PARAPHRASED VERSION

GENESIS

30

*The creation of the world*

IN THE BEGINNING OF CREATION, when God made 1
heaven and earth,[a] the earth was without form and void, with darkness 2
over the face of the abyss, and a mighty wind that swept[b] over the
surface of the waters. God said, 'Let there be light', and there was light; 3
and God saw that the light was good, and he separated light from darkness. 4
He called the light day, and the darkness night. So evening came, and 5
morning came, the first day.

God said, 'Let there be a vault between the waters, to separate water 6
from water.' So God made the vault, and separated the water under the 7
vault from the water above it, and so it was; and God called the vault 8
heaven. Evening came, and morning came, a second day.

32

God said, 'Let the waters under heaven be gathered into one place, so 9
that dry land may appear'; and so it was. God called the dry land earth, 10
and the gathering of the waters he called seas; and God saw that it was
good. Then God said, 'Let the earth produce fresh growth, let there be 11
on the earth plants bearing seed, fruit-trees bearing fruit each with seed
according to its kind.' So it was; the earth yielded fresh growth, plants 12
bearing seed according to their kind and trees bearing fruit each with seed
according to its kind; and God saw that it was good. Evening came, and 13
morning came, a third day.

42

God said, 'Let there be lights in the vault of heaven to separate day from 14
night, and let them serve as signs both for festivals and for seasons and
years. Let them also shine in the vault of heaven to give light on earth.' So 15
it was; God made the two great lights, the greater to govern the day and 16
the lesser to govern the night; and with them he made the stars. God put 17
these lights in the vault of heaven to give light on earth, to govern day and 18
night, and to separate light from darkness; and God saw that it was good.
Evening came, and morning came, a fourth day. 19

God said, 'Let the waters teem with countless living creatures, and let 20
birds fly above the earth across the vault of heaven.' God then created the 21
great sea-monsters and all living creatures that move and swarm in the
waters, according to their kind, and every kind of bird; and God saw that
it was good. So he blessed them and said, 'Be fruitful and increase, fill the 22
waters of the seas; and let the birds increase on land.' Evening came, and 23
morning came, a fifth day.

God said, 'Let the earth bring forth living creatures, according to their 24
kind: cattle, reptiles, and wild animals, all according to their kind.' So it
was;

34

1

36

FIG. 1C NEW ENGLISH BIBLE VERSION

GENESIS

30

1 In the beginning when God created[a]
the heavens and the earth, [2]the earth
was a formless void and darkness cov-
ered the face of the deep, while a wind
from God[b] swept over the face of the
waters. [3]Then God said, "Let there be
light"; and there was light. [4]And God
saw that the light was good; and God
separated the light from the darkness.
[5]God called the light Day, and the dark-
ness he called Night. And there was eve-
ning and there was morning, the first
day.

6 And God said, "Let there be a dome
in the midst of the waters, and let it sepa-
rate the waters from the waters." [7]So
God made the dome and separated the
waters that were under the dome from
the waters that were above the dome.
And it was so. [8]God called the dome
Sky. And there was evening and there
was morning, the second day.

9 And God said, "Let the waters un-
der the sky be gathered together into one
place, and let the dry land appear." And
it was so. [10]God called the dry land
Earth, and the waters that were gathered
together he called Seas. And God saw
that it was good. [11]Then God said, "Let
the earth put forth vegetation: plants
yielding seed, and fruit trees of every
kind on earth that bear fruit with the seed
in it." And it was so. [12]The earth brought
forth vegetation: plants yielding seed of
every kind, and trees of every kind bear-
ing fruit with the seed in it. And God saw
that it was good. [13]And there was eve-
ning and there was morning, the third
day.

14 And God said, "Let there be lights
in the dome of the sky to separate the day
from the night; and let them be for signs
and for seasons and for days and years,
[15]and let them be lights in the dome of
the sky to give light upon the earth."
And it was so. [16]God made the two great
lights—the greater light to rule the day
and the lesser light to rule the night—and
the stars. [17]God set them in the dome of
the sky to give light upon the earth, [18]to
rule over the day and over the night, and
to separate the light from the darkness.
And God saw that it was good. [19]And
there was evening and there was morn-
ing, the fourth day.

32

20 And God said, "Let the waters
bring forth swarms of living creatures,
and let birds fly above the earth across
the dome of the sky." [21]So God created
the great sea monsters and every living
creature that moves, of every kind, with
which the waters swarm, and every
winged bird of every kind. And God saw
that it was good. [22]God blessed them,
saying, "Be fruitful and multiply and fill
the waters in the seas, and let birds multi-
ply on the earth." [23]And there was eve-
ning and there was morning, the fifth
day.

24 And God said, "Let the earth bring
forth living creatures of every kind: cattle
and creeping things and wild animals of
the earth of every kind." And it was so.

34

36

1

FIG. 1D REVISED STANDARD VERSION

RUTH 2

30

16 And Ruth said, Intreat me not to leave thee, *or* to return from following after thee: for whither thou goest, I will go; and where thou lodgest, I will lodge: thy people *shall be* my people, and thy God my God:
17 Where thou diest, will I die, and there will I be buried: the LORD do so to me, and more also, *if ought* but death part thee and me.
18 When she saw that she was stedfastly minded to go with her, then she left speaking unto her.
19 So they two went until they came to Beth-lehem. And it came to pass, when they were come to Beth-lehem, that all the city was moved about them, and they said, *Is* this Naomi?
20 And she said unto them, Call me not Naomi, call me Ma'ra: for the Almighty hath dealt very bitterly with me.
21 I went out full, and the LORD hath brought me home again empty: why *then* call ye me Naomi, seeing the LORD hath testified against me, and the Almighty hath afflicted me?
22 So Naomi returned, and Ruth the Moabitess, her daughter in law, with her, which returned out of the country of Moab: and they came to Beth-lehem in the beginning of barley harvest.

CHAPTER 2

AND Naomi had a kinsman of her husband's, a mighty man of wealth, of the family of E-lim'e-lech; and his name *was* Bo'az.
2 And Ruth the Moabitess said unto Naomi, Let me now go to the field, and glean ears of corn after *him* in whose sight I shall find grace. And she said unto her, Go, my daughter.
3 And she went, and came, and gleaned in the field after the reapers: and her hap was to light on a part of the field *belonging* unto Bo'az, who *was* of the kindred of E-lim'e-lech.
4 And, behold, Bo'az came from Beth-lehem, and said unto the reapers, The LORD *be* with you. And they answered him, The LORD bless thee.
5 Then said Bo'az unto his servant that was set over the reapers, Whose damsel *is* this?
6 And the servant that was set over the reapers answered and said, It *is* the Moabitish damsel that came back with Naomi out of the country of Moab:
7 And she said, I pray you, let me glean and gather after the reapers among the sheaves: so she came, and hath continued even from the morning until now, that she tarried a little in the house.
8 Then said Bo'az unto Ruth, Hearest thou not, my daughter? *Go* not to glean in another field, neither go from hence, but abide here fast by my maidens:
9 *Let* thine eyes *be* on the field that they do reap, and go thou after them: have I not charged the young men that they shall not touch thee? and when thou art athirst, go unto the vessels, and drink of *that* which the young men have drawn.
10 Then she fell on her face, and bowed herself to the ground, and said unto him, Why have I found grace in thine eyes, that thou shouldest take knowledge of me, seeing I *am* a stranger?
11 And Bo'az answered and said unto her, It hath fully been shewed me, all that thou hast done unto thy mother in law since the death of thine husband: and *how* thou hast left thy father and thy mother, and the land of thy nativity, and art come unto a people which thou knewest not heretofore.

32

34

36

354

FIG. 2A KING JAMES VERSION

RUTH 2

*Boaz befriends Ruth*

30

[14] But Ruth replied, "Don't make me leave you, for I want to go wherever you go, and to live wherever you live; your people shall be my people, and your God shall be my God; [17] I want to die where you die, and be buried there. May the Lord do terrible things to me if I allow anything but death to separate us."

[18] And when Naomi saw that Ruth had made up her mind and could not be persuaded otherwise, she stopped urging her. [19] So they both came to Bethlehem and the entire village was stirred by their arrival.

"Is it really Naomi?" the women asked.

[20] But she told them, "Don't call me Naomi. Call me Mara," (Naomi means "pleasant"; Mara means "bitter") "for Almighty God has dealt me bitter blows. [21] I went out full and the Lord has brought me home empty; why should you call me Naomi when the Lord has turned his back on me and sent such calamity!"

[22] (Their return from Moab and arrival in Bethlehem was at the beginning of the barley harvest.)

2 NOW NAOMI HAD an in-law there in Bethlehem who was a very wealthy man. His name was Boaz.

[2] One day Ruth said to Naomi, "Perhaps I can go out into the fields of some kind man to glean the free grain[a] behind his reapers."

And Naomi said, "All right, dear daughter. Go ahead."

[3] So she did. And as it happened, the field where she found herself belonged to Boaz, this relative of Naomi's husband.

[4-5] Boaz arrived from the city while she was there. After exchanging greetings with the reapers he said to his foreman, "Hey, who's that girl over there?"

[6] And the foreman replied, "It's that girl from the land of Moab who came back with Naomi. [7] She asked me this morning if she could pick up the grains dropped by the reapers, and she has been at it ever since except for a few minutes' rest over there in the shade."

[8-9] Boaz went over and talked to her. "Listen, my child," he said to her. "Stay right here with us to glean; don't think of going to any other fields. Stay right behind my women workers; I have warned the young men not to bother you; when you are thirsty, go and help yourself to the water."

[10-11] She thanked him warmly. "How can you be so kind to me?" she asked. "You must know I am only a foreigner."

"Yes, I know," Boaz replied, "and I also know about all the love and kindness you have shown your mother-in-law since the death of your husband, and how you left your father and mother in your own land and have come here to live among strangers.

32

38

34

36

354

FIG. 2B LIVING BIBLE PARAPHRASED VERSION

RUTH 2

16 'Do not urge me to go back and desert
you', Ruth answered. 'Where you go, I will go, and where you stay, I will
17 stay. Your people shall be my people, and your God my God. Where you
die, I will die, and there I will be buried. I swear a solemn oath before the
18 LORD your God: nothing but[b] death shall divide us.' When Naomi saw
19 that Ruth was determined to go with her, she said no more, and the two
of them went on until they came to Bethlehem. When they arrived in
Bethlehem, the whole town was in great excitement about them, and the
20 women said, 'Can this be Naomi?' 'Do not call me Naomi,'[c] she said, 'call
21 me Mara,[a] for it is a bitter lot that the Almighty has sent me. I went away
full, and the LORD has brought me back empty. Why do you call me Naomi?
The LORD has pronounced against me; the Almighty has brought disaster
22 on me.' This is how Naomi's daughter-in-law, Ruth the Moabitess,
returned with her from the Moabite country. The barley harvest was
beginning when they arrived in Bethlehem.

30

32

*Ruth and Boaz*

2 NOW NAOMI HAD A KINSMAN on her husband's side, a well-to-do
2 man of the family of Elimelech; his name was Boaz. Ruth the
Moabitess said to Naomi, 'May I go out to the cornfields and glean behind
anyone who will grant me that favour?' 'Yes, go, my daughter', she replied.
3 So Ruth went gleaning in the fields behind the reapers. As it happened,
she was in that strip of the fields which belonged to Boaz of Elimelech's
4 family, and there was Boaz coming out from Bethlehem. He greeted the
reapers, saying, 'The LORD be with you'; and they replied, 'The LORD
5 bless you.' Then he asked his servant in charge of the reapers, 'Whose girl
6 is this?' 'She is a Moabite girl', the servant answered, 'who has just come
7 back with Naomi from the Moabite country. She asked if she might glean
and gather among the swathes behind the reapers. She came and has been
8 on her feet with hardly a moment's rest[b] from daybreak till now.' Then
Boaz said to Ruth, 'Listen to me, my daughter: do not go and glean in any
9 other field, and do not look any further, but keep close to my girls. Watch
where the men reap, and follow the gleaners; I have given them orders not
to molest you. If you are thirsty, go and drink from the jars the men have
10 filled.' She fell prostrate before him and said, 'Why are you so kind as to
11 take notice of me when I am only a foreigner?' Boaz answered, 'They have
told me all that you have done for your mother-in-law since your husband's
death, how you left your father and mother and the land of your birth, and
came to a people you did not know before.

42

34

354

36

FIG.2C NEW ENGLISH BIBLE VERSION

RUTH 1.16

16 But Ruth said,
"Do not press me to leave you
or to turn back from following
you!
Where you go, I will go;
Where you lodge, I will lodge;
your people shall be my people,
and your God my God.
17 Where you die, I will die—
there will I be buried.
May the LORD do thus and so to
me,
and more as well,
if even death parts me from you!"
18 When Naomi saw that she was determined to go with her, she said no more
to her.
19 So the two of them went on until
they came to Bethlehem. When they
came to Bethlehem, the whole town was
stirred because of them; and the women
said, "Is this Naomi?" 20 She said to
them,
"Call me no longer Naomi,[a]
call me Mara,[b]
for the Almighty[c] has dealt
bitterly with me.
21 I went away full,
but the LORD has brought me
back empty;
why call me Naomi
when the LORD has dealt harshly
with[d] me,
and the Almighty[c] has brought
calamity upon me?"
22 So Naomi returned together with
Ruth the Moabite, her daughter-in-law,
who came back with her from the country of Moab. They came to Bethlehem at
the beginning of the barley harvest.
2 Now Naomi had a kinsman on her
husband's side, a prominent rich
man, of the family of Elimelech, whose
name was Boaz. 2 And Ruth the Moabite
said to Naomi, "Let me go to the field
and glean among the ears of grain, behind someone in whose sight I may find
favor." She said to her, "Go, my daughter." 3 So she went. She came and gleaned
in the field behind the reapers. As it happened, she came to the part of the field
belonging to Boaz, who was of the family of Elimelech.

40

30

4 Just then Boaz came
from Bethlehem. He said to the reapers,
"The LORD be with you." They answered, "The LORD bless you." 5 Then
Boaz said to his servant who was in
charge of the reapers, "To whom does
this young woman belong?" 6 The servant who was in charge of the reapers
answered, "She is the Moabite who came
back with Naomi from the country of
Moab. 7 She said, 'Please, let me glean
and gather among the sheaves behind the
reapers.' So she came, and she has been
on her feet from early this morning until
now, without resting even for a moment."
8 Then Boaz said to Ruth, "Now listen, my daughter, do not go to glean in
another field or leave this one, but keep
close to my young women. 9 Keep your
eyes on the field that is being reaped, and
follow behind them. I have ordered the
young men not to bother you. If you get
thirsty, go to the vessels and drink from
what the young men have drawn."
10 Then she fell prostrate, with her face to
the ground, and said to him, "Why have
I found favor in your sight, that you
should take notice of me, when I am a
foreigner?" 11 But Boaz answered her,
"All that you have done for your
mother-in-law since the death of your
husband has been fully told me, and how
you left your father and mother and your
native land and came to a people that you
did not know before.

32

34

354

36

FIG.2D REVISED STANDARD VERSION

MALACHI 4

CHAPTER 4

FOR, behold, the day cometh, that shall burn as an oven; and all the proud, yea, and all that do wickedly, shall be stubble: and the day that cometh shall burn them up, saith the LORD of hosts, that it shall leave them neither root nor branch.

2 But unto you that fear my name shall the Sun of righteousness arise with healing in his wings; and ye shall go forth, and grow up as calves of the stall.

3 And ye shall tread down the wicked; for they shall be ashes under the soles of your feet in the day that I shall do *this*, saith the LORD of hosts.

4 Remember ye the law of Moses my servant, which I commanded unto him in Ho'reb for all Israel, *with* the statutes and judgments.

5 Behold, I will send you E-li'jah the prophet before the coming of the great and dreadful day of the LORD:

6 And he shall turn the heart of the fathers to the children, and the heart of the children to their fathers, lest I come and smite the earth with a curse.

30

32

34

36

1321

FIG. 3A KING JAMES VERSION

MALACHI 4

4 "WATCH NOW," THE Lord of Hosts declares, "the day of judgment is coming, burning like a furnace. The proud and wicked will be burned up like straw; like a tree, they will be consumed—roots and all.

[3] "But for you who fear my name, the Sun of Righteousness will rise with healing in his wings. And you will go free, leaping with joy like calves let out to pasture.

[4] Then you will tread upon the wicked as ashes underfoot," says the Lord of Hosts.

[5] "Remember to obey the laws I gave all Israel through Moses my servant on Mount Horeb.

[6] "See, I will send you another prophet like[a] Elijah before the coming of the great and dreadful judgment day of God. [7] His preaching will bring fathers and children together again, to be of one mind and heart, for they will know that if they do not repent, I will come and utterly destroy their land."

30

32

38

34

36

1321

FIG. 3B LIVING BIBLE PARAPHRASED VERSION

MALACHI 4

30

1 The day comes, glowing like a furnace; all the arrogant and the evil-
2 doers shall be chaff, and that day when it comes shall set them ablaze, says
the LORD of Hosts, it shall leave them neither root nor branch. But for
you who fear my name, the sun of righteousness shall rise with healing in
3 his wings, and you shall break loose like calves released from the stall. On
the day that I act, you shall trample down the wicked, for they will be ashes
under the soles of your feet, says the LORD of Hosts.
4 Remember the law of Moses my servant, the rules and precepts which I
bade him deliver to all Israel at Horeb.
5 Look, I will send you the prophet Elijah before the great and terrible
6 day of the LORD comes. He will reconcile fathers to sons and sons to fathers,
lest I come and put the land under a ban to destroy it.

42

32

34

36

1321

FIG. 3C NEW ENGLISH BIBLE VERSION

MALACHI 4.1

30

4 [1] See, the day is coming, burning like
an oven, when all the arrogant and
all evildoers will be stubble; the day that
comes shall burn them up, says the LORD
of hosts, so that it will leave them neither
root nor branch. [2] But for you who re-
vere my name the sun of righteousness
shall rise, with healing in its wings. You
shall go out leaping like calves from the
stall. [3] And you shall tread down the
wicked, for they will be ashes under the
soles of your feet, on the day when I act,
says the LORD of hosts.
4 Remember the teaching of my ser-
vant Moses, the statutes and ordinances
that I commanded him at Horeb for all
Israel.
5 Lo, I will send you the prophet Eli-
jah before the great and terrible day of
the LORD comes. [6] He will turn the hearts
of parents to their children and the hearts
of children to their parents, so that I will
not come and strike the land with a
curse.

32

34

36

1321

FIG. 3D REVISED STANDARD VERSION

THE GOSPEL ACCORDING TO

SAINT MATTHEW 46 30

CHAPTER 1

THE book of the generation of Jesus Christ, the son of David, the son of Abraham.

2 Abraham begat Isaac; and Isaac begat Jacob; and Jacob begat Judas and his brethren;

3 And Judas begat Pha'res and Za'ra of Tha'mar; and Pha'res begat Es'rom; and Es'rom begat A'ram;

4 And A'ram begat A-min'a-dab; and A-min'a-dab begat Na-as'son; and Na-as'son begat Sal'mon;

5 And Sal'mon begat Bo'oz of Ra'chab; and Bo'oz begat O'bed of Ruth; and O'bed begat Jesse;

6 And Jesse begat David the king; and David the king begat Solomon of her *that had been the wife* of U-ri'as;

7 And Solomon begat Ro-bo'am; and Ro-bo'am begat A-bi'a; and A-bi'a begat Asa;

8 And Asa begat Jos'a-phat; and Jos'a-phat begat Joram; and Joram begat O-zi'as;

9 And O-zi'as begat Jo'a-tham; and Jo'a-tham begat A'chaz; and A'chaz begat Ez-e-ki'as;

10 And Ez-e-ki'as begat Ma-nas'ses; and Ma-nas'ses begat A'mon; and A'mon begat Jo-si'as;

11 And Jo-si'as begat Jech-o-ni'as and his brethren, about the time they were carried away to Babylon:

12 And after they were brought to Babylon, Jech-o-ni'as begat Sa-la'thi-el; and Sa-la'thi-el begat Zo-rob'a-bel;

13 And Zo-rob'a-bel begat A-bi'ud; and A-bi'ud begat E-li'a-kim; and E-li'a-kim begat Azor;

14 And Azor begat Sa'doc; and Sa'doc begat A'chim; and A'chim begat E-li'ud;

15 And E-li'ud begat E-le-a'zar; and E-le-a'zar begat Mat'than; and Mat'than begat Jacob;

16 And Jacob begat Joseph the husband of Mary, of whom was born Jesus, who is called Christ.

17 So all the generations from Abraham to David are fourteen generations; and from David until the carrying away into Babylon are fourteen generations; and from the carrying away into Babylon unto Christ are fourteen generations.

32

18 Now the birth of Jesus Christ was on this wise: When as his mother Mary was espoused to Joseph, before they came together, she was found with child of the Holy Ghost.

19 Then Joseph her husband, being a just *man*, and not willing to make her a publick example, was minded to put her away privily.

34

36

2001

FIG. 4A KING JAMES VERSION

MATTHEW 46 30

1 THESE ARE THE ancestors of Jesus Christ, a descendant of King David and of Abraham:

2 Abraham was the father of Isaac; Isaac was the father of Jacob; Jacob was the father of Judah and his brothers.

3 Judah was the father of Perez and Zerah (Tamar was their mother); Perez was the father of Hezron; Hezron was the father of Aram;

4 Aram was the father of Amminadab; Amminadab was the father of Nahshon; Nahshon was the father of Salmon;

5 Salmon was the father of Boaz (Rahab was his mother); Boaz was the father of Obed (Ruth was his mother); Obed was the father of Jesse;

6 Jesse was the father of King David. David was the father of Solomon (his mother was the widow of Uriah);

7 Solomon was the father of Rehoboam; Rehoboam was the father of Abijah; Abijah was the father of Asa;

8 Asa was the father of Jehoshaphat; Jehoshaphat was the father of Joram; Joram was the father of Uzziah;

9 Uzziah was the father of Jotham; Jotham was the father of Ahaz; Ahaz was the father of Hezekiah;

10 Hezekiah was the father of Manasseh; Manasseh was the father of Amos; Amos was the father of Josiah;

11 Josiah was the father of Jechoniah and his brothers (born at the time of the exile to Babylon).

12 After the exile:
Jechoniah was the father of Shealtiel; Shealtiel was the father of Zerubbabel;

13 Zerubbabel was the father of Abiud; Abiud was the father of Eliakim; Eliakim was the father of Azor;

14 Azor was the father of Zadok; Zadok was the father of Achim; Achim was the father of Eliud;

15 Eliud was the father of Eleazar; Eleazar was the father of Matthan; Matthan was the father of Jacob;

16 Jacob was the father of Joseph (who was the husband of Mary, the mother of Jesus Christ the Messiah).

17 These are[a] fourteen of the generations from Abraham to King David; and fourteen from King David's time to the exile; and fourteen from the exile to Christ.

32

18 These are the facts concerning the birth of Jesus Christ: His mother, Mary, was engaged to be married to Joseph. But while she was still a virgin she became pregnant by the Holy Spirit. 19 Then Joseph, her fiancé,[b] being a man of stern principle,[c] decided to break the engagement but to do it quietly, as he didn't want to publicly disgrace her.

34

36

2001

FIG. 4B LIVING BIBLE PARAPHRASED VESION

THE GOSPEL ACCORDING TO

MATTHEW

30

*The coming of Christ*

46

A TABLE OF THE DESCENT of Jesus Christ, son of David, 1
son of Abraham.
Abraham was the father of Isaac, Isaac of Jacob, Jacob of Judah 2
and his brothers, Judah of Perez and Zarah (their mother was Tamar), 3
Perez of Hezron, Hezron of Ram, Ram of Amminadab, Amminadab of 4
Nahshon, Nahshon of Salma, Salma of Boaz (his mother was Rahab), 5
Boaz of Obed (his mother was Ruth), Obed of Jesse; and Jesse was the 6
father of King David.
David was the father of Solomon (his mother had been the wife of 7
Uriah), Solomon of Rehoboam, Rehoboam of Abijah, Abijah of Asa, 8 9
Asa of Jehoshaphat, Jehoshaphat of Joram, Joram of Azariah, Azariah of 10
Jotham, Jotham of Ahaz, Ahaz of Hezekiah, Hezekiah of Manasseh,
Manasseh of Amon, Amon of Josiah; and Josiah was the father of Jeconiah 11
and his brothers at the time of the deportation to Babylon.
After the deportation Jeconiah was the father of Shealtiel, Shealtiel of 12
Zerubbabel, Zerubbabel of Abiud, Abiud of Eliakim, Eliakim of Azor, 13
Azor of Zadok, Zadok of Achim, Achim of Eliud, Eliud of Eleazar, Eleazar 14 15
of Matthan, Matthan of Jacob, Jacob of Joseph, the husband of Mary, who 16
gave birth to[d] Jesus called Messiah.
There were thus fourteen generations in all from Abraham to David, 17
fourteen from David until the deportation to Babylon, and fourteen from
the deportation until the Messiah.

THIS IS THE STORY of the birth of the Messiah. Mary his mother was 18
betrothed to Joseph; before their marriage she found that she was with
child by the Holy Spirit. Being a man of principle, and at the same time 19
wanting to save her from exposure, Joseph desired to have the marriage
contract set aside quietly.

32

42

34

36

2001

FIG. 4C NEW ENGLISH BIBLE VERSION

THE GOSPEL ACCORDING TO

MATTHEW

30

46

1 An account of the genealogy[a] of
Jesus the Messiah,[b] the son of Da-
vid, the son of Abraham.
2 Abraham was the father of Isaac,
and Isaac the father of Jacob, and Jacob
the father of Judah and his brothers, 3and
Judah the father of Perez and Zerah by
Tamar, and Perez the father of Hezron,
and Hezron the father of Aram, 4and
Aram the father of Aminadab, and
Aminadab the father of Nahshon, and
Nahshon the father of Salmon, 5and Sal-
mon the father of Boaz by Rahab, and
Boaz the father of Obed by Ruth, and
Obed the father of Jesse, 6and Jesse the
father of King David.
And David was the father of Solomon
by the wife of Uriah, 7and Solomon the
father of Rehoboam, and Rehoboam the
father of Abijah, and Abijah the father of
Asaph,[c] 8and Asaph[c] the father of Je-
hoshaphat, and Jehoshaphat the father of
Joram, and Joram the father of Uzziah,
9and Uzziah the father of Jotham, and
Jotham the father of Ahaz, and Ahaz the
father of Hezekiah, 10and Hezekiah
the father of Manasseh, and Manasseh
the father of Amos,[d] and Amos[d] the fa-
ther of Josiah, 11and Josiah the father of
Jechoniah and his brothers, at the time of
the deportation to Babylon.
12 And after the deportation to Bab-
ylon: Jechoniah was the father of Salathi-
el, and Salathiel the father of Zerubbabel,
13and Zerubbabel the father of Abiud,
and Abiud the father of Eliakim, and Eli-
akim the father of Azor,
14and Azor the
father of Zadok, and Zadok the father of
Achim, and Achim the father of Eliud,
15and Eliud the father of Eleazar, and
Eleazar the father of Matthan, and Mat-
than the father of Jacob, 16and Jacob the
father of Joseph the husband of Mary, of
whom Jesus was born, who is called the
Messiah.[e]
17 So all the generations from Abra-
ham to David are fourteen generations;
and from David to the deportation to
Babylon, fourteen generations; and from
the deportation to Babylon to the Messi-
ah,[e] fourteen generations.

18 Now the birth of Jesus the Messi-
ah[b] took place in this way.[f] When his
mother Mary had been engaged to Jo-
seph, but before they lived together, she
was found to be with child from the
Holy Spirit. 19Her husband Joseph, be-
ing a righteous man and unwilling to ex-
pose her to public disgrace, planned
dismiss her quietly.

40

32

34

36

2001

FIG. 4D REVISED STANDARD VERSION

JOHN 3

24 But Jesus did not commit himself unto them, because he knew all *men*.
25 And needed not that any should testify of man: for he knew what was in man.

CHAPTER 3

THERE was a man of the Pharisees, named Nic-o-de'mus, a ruler of the Jews:
2 The same came to Jesus by night, and said unto him, Rabbi, we know that thou art a teacher come from God: for no man can do these miracles that thou doest, except God be with him.
3 Jesus answered and said unto him, Verily, verily, I say unto thee, Except a man be born again, he cannot see the kingdom of God.
4 Nic-o-de'mus saith unto him, How can a man be born when he is old? can he enter the second time into his mother's womb, and be born?
5 Jesus answered, Verily, verily, I say unto thee, Except a man be born of water and *of* the Spirit, he cannot enter into the kingdom of God.
6 That which is born of the flesh is flesh; and that which is born of the Spirit is spirit.
7 Marvel not that I said unto thee, Ye must be born again.
8 The wind bloweth where it listeth, and thou hearest the sound thereof, but canst not tell whence it cometh, and whither it goeth: so is every one that is born of the Spirit.
9 Nic-o-de'mus answered and said unto him, How can these things be?
10 Jesus answered and said unto him, Art thou a master of Israel, and knowest not these things?
11 Verily, verily, I say unto thee, We speak that we do know, and testify that we have seen; and ye receive not our witness.
12 If I have told you earthly things, and ye believe not, how shall ye believe, if I tell you *of* heavenly things?
13 And no man hath ascended up to heaven, but he that came down from heaven, *even* the Son of man which is in heaven.
14 And as Moses lifted up the serpent in the wilderness, even so must the Son of man be lifted up:
15 That whosoever believeth in him should not perish, but have eternal life.
16 For God so loved the world, that he gave his only begotten Son, that whosoever believeth in him should not perish, but have everlasting life.
17 For God sent not his Son into the world to condemn the world; but that the world through him might be saved.
18 He that believeth on him is not condemned: but he that believeth not is condemned already, because he hath not believed in the name of the only begotten Son of God.
19 And this is the condemnation, that light is come into the world, and men loved darkness rather than light, because their deeds were evil.
20 For every one that doeth evil hateth the light, neither cometh to the light, lest his deeds should be reproved.
21 But he that doeth truth cometh to the light, that his deeds may be made manifest, that they are wrought in God.
22 After these things came Jesus and his disciples into the land of Judæa; and there he tarried with them, and baptized.
23 And John also was baptizing in Æ'non near to Sa'lim, because there was much water there: and they came, and were baptized.
24 For John was not yet cast into prison.

30
44
32
34
36

2125

FIG. 5A KING JAMES VERSION

JOHN 3

[16,17] But Jesus didn't trust them, for he knew mankind to the core. No one needed to tell him how changeable human nature is!

3 AFTER DARK ONE night a Jewish religious leader named Nicodemus, a member of the sect of the Pharisees, came for an interview with Jesus. "Sir," he said, "we all know that God has sent you to teach us. Your miracles are proof enough of this."

[2] Jesus replied, "With all the earnestness I possess I tell you this: Unless you are born again, you can never get into the Kingdom of God."

[3] "Born again!" exclaimed Nicodemus. "What do you mean? How can an old man go back into his mother's womb and be born again?"

[4,5] Jesus replied, "What I am telling you so earnestly is this: Unless one is born of water[a] and the Spirit, he cannot enter the Kingdom of God. [6] Men can only reproduce human life, but the Holy Spirit gives new life from heaven; [7] so don't be surprised at my statement that you must be born again! [8] Just as you can hear the wind but can't tell where it comes from or where it will go next, so it is with the Spirit. We do not know on whom he will next bestow this life from heaven."

[9] "What do you mean?" Nicodemus asked.

[10,11] Jesus replied, "You, a respected Jewish teacher, and yet you don't understand these things? I am telling you what I know and have seen—and yet you won't believe me. [12] But if you don't even believe me when I tell you about such things as these that happen here among men, how can you possibly believe if I tell you what is going on in heaven?

[13] For only I, the Messiah,[b] have come to earth and will return to heaven again. [14] And as Moses in the wilderness lifted up the bronze image of a serpent on a pole, even so I must be lifted up upon a pole, [15] so that anyone who believes in me will have eternal life. [16] For God loved the world so much that he gave his only[c] Son so that anyone who believes in him shall not perish but have eternal life. [17] God did not send his Son into the world to condemn it, but to save it.

[18] "There is no eternal doom awaiting those who trust him to save them. But those who don't trust him have already been tried and condemned for not believing in the only[c] Son of God. [19] Their sentence is based on this fact: that the Light from heaven came into the world, but they loved the darkness more than the Light, for their deeds were evil. [20] They hated the heavenly Light because they wanted to sin in the darkness. They stayed away from that Light for fear their sins would be exposed and they would be punished. [21] But those doing right come gladly to the Light to let everyone see that they are doing what God wants them to."

[22] Afterwards Jesus and his disciples left Jerusalem and stayed for a while in Judea and baptized there.

[23,24] At this time John the Baptist was not yet in prison. He was baptizing at Aenon, near Salim, because there was plenty of water there.

30
44
32
38
34
36

2125

FIG. 5B LIVING BIBLE PARAPHRASED VERSION

JOHN 3

30

But Jesus for his part 24
would not trust himself to them. He knew men so well, all of them, that he 25
needed no evidence from others about a man, for he himself could tell what
was in a man.

THERE WAS ONE of the Pharisees named Nicodemus, a member of the 3
Jewish Council, who came to Jesus by night. 'Rabbi,' he said, 'we know 2
that you are a teacher sent by God; no one could perform these signs of
yours unless God were with him.' Jesus answered, 'In truth, in very truth 3
I tell you, unless a man has been born over again he cannot see the kingdom
of God.' 'But how is it possible', said Nicodemus, 'for a man to be born 4
when he is old? Can he enter his mother's womb a second time and be
born?' Jesus answered, 'In truth I tell you, no one can enter the kingdom 5
of God without being born from water and spirit. Flesh can give birth only 6
to flesh; it is spirit that gives birth to spirit. You ought not to be astonished, 7
then, when I tell you that you must be born over again. The wind[a] blows 8
where it wills; you hear the sound of it, but you do not know where it
comes from, or where it is going. So with everyone who is born from spirit".

Nicodemus replied, 'How is this possible?' 'What!' said Jesus. 'Is this 9 10
famous teacher of Israel ignorant of such things? In very truth I tell you, 11
we speak of what we know, and testify to what we have seen, and yet you
all reject our testimony. If you disbelieve me when I talk to you about 12
things on earth, how are you to believe if I should talk about the things of
heaven? 13
'No one ever went up into heaven except the one who came down from
heaven, the Son of Man whose home is in heaven.[a] This Son of Man must 14
be lifted up as the serpent was lifted up by Moses in the wilderness, so that 15
everyone who has faith in him may in him possess eternal life.
'God loved the world so much that he gave his only Son, that everyone 16
who has faith in him may not die but have eternal life. It was not to judge 17
the world that God sent his Son into the world, but that through him the
world might be saved.
'The man who puts his faith in him does not come under judgement; 18
but the unbeliever has already been judged in that he has not given his
allegiance to God's only Son. Here lies the test: the light has come into the 19
world, but men preferred darkness to light because their deeds were evil.
Bad men all hate the light and avoid it, for fear their practices should be 20
shown up. The honest man comes to the light so that it may be clearly seen 21
that God is in all he does.'

AFTER THIS, Jesus went into Judaea with his disciples, stayed there with 22
them, and baptized. John too was baptizing at Aenon, near to Salim, 23
because water was plentiful in that region; and people were constantly
coming for baptism. This was before John's imprisonment. 24

32

42

44

34

36

2125

FIG. 5C NEW ENGLISH BIBLE VERSION

JOHN 2.24

30

24 But Jesus on his part
would not entrust himself to them, be-
cause he knew all people 25 and needed no
one to testify about anyone; for he him-
self knew what was in everyone.
3 Now there was a Pharisee named
Nicodemus, a leader of the Jews.
2 He came to Jesus[a] by night and said to
him, "Rabbi, we know that you are a
teacher who has come from God; for no
one can do these signs that you do apart
from the presence of God." 3 Jesus an-
swered him, "Very truly, I tell you, no
one can see the kingdom of God without
being born from above."[a] 4 Nicodemus
said to him, "How can anyone be born
after having grown old? Can one enter a
second time into the mother's womb and
be born?" 5 Jesus answered, "Very truly,
I tell you, no one can enter the kingdom
of God without being born of water and
Spirit. 6 What is born of the flesh is flesh,
and what is born of the Spirit is spirit.'
7 Do not be astonished that I said to you,
'You' must be born from above.'[a] 8 The
wind[a] blows where it chooses, and you
hear the sound of it, but you do not
know where it comes from or where it
goes. So it is with everyone who is born
of the Spirit." 9 Nicodemus said to him,
"How can these things be?" 10 Jesus an-
swered him, "Are you a teacher of Israel,
and yet you do not understand these
things?
11 "Very truly, I tell you, we speak of
what we know and testify to what we
have seen; yet you do not receive our
testimony. 12 If I have told you about
earthly things and you do not believe,
how can you believe if I tell you about
heavenly things?

13 No one has ascended
into heaven except the one who descend-
ed from heaven, the Son of Man.[a] 14 And
just as Moses lifted up the serpent in the
wilderness, so must the Son of Man be
lifted up, 15 that whoever believes in him
may have eternal life.[a]
16 "For God so loved the world that
he gave his only Son, so that everyone
who believes in him may not perish but
may have eternal life.
17 "Indeed, God did not send the Son
into the world to condemn the world,
but in order that the world might be
saved through him. 18 Those who believe
in him are not condemned; but those
who do not believe are condemned al-
ready, because they have not believed in
the name of the only Son of God. 19 And
this is the judgment, that the light has
come into the world, and people loved
darkness rather than light because their
deeds were evil. 20 For all who do evil
hate the light and do not come to the
light, so that their deeds may not be ex-
posed. 21 But those who do what is true
come to the light, so that it may be clear-
ly seen that their deeds have been done in
God."

22 After this Jesus and his disciples
went into the Judean countryside, and he
spent some time there with them and
baptized. 23 John also was baptizing at
Aenon near Salim because water was
abundant there; and people kept coming
and were being baptized 24 —John, of
course, had not yet been thrown into
prison.

32

44

34

36

2125

FIG. 5D REVISED STANDARD VERSION

REVELATION 22

CHAPTER 22

AND he shewed me a pure river of water of life, clear as crystal, proceeding out of the throne of God and of the Lamb.

2 In the midst of the street of it, and on either side of the river, *was there* the tree of life, which bare twelve *manner of* fruits, *and* yielded her fruit every month: and the leaves of the tree *were* for the healing of the nations.

3 And there shall be no more curse: but the throne of God and of the Lamb shall be in it; and his servants shall serve him:

4 And they shall see his face; and his name *shall be* in their foreheads.

5 And there shall be no night there; and they need no candle, neither light of the sun; for the Lord God giveth them light: and they shall reign for ever and ever.

6 And he said unto me, These sayings *are* faithful and true: and the Lord God of the holy prophets sent his angel to shew unto his servants the things which must shortly be done.

7 Behold, I come quickly: blessed *is* he that keepeth the sayings of the prophecy of this book.

8 And I John saw these things, and heard *them*. And when I had heard and seen, I fell down to worship before the feet of the angel which shewed me these things.

9 Then saith he unto me, See *thou do it* not: for I am thy fellowservant, and of thy brethren the prophets, and of them which keep the sayings of this book: worship God.

10 And he saith unto me, Seal not the sayings of the prophecy of this book: for the time is at hand.

11 He that is unjust, let him be unjust still: and he which is filthy, let him be filthy still: and he that is righteous, let him be righteous still: and he that is holy, let him be holy still.

12 And, behold, I come quickly; and my reward *is* with me, to give every man according as his work shall be.

13 I am Alpha and Omega, the beginning and the end, the first and the last.

14 Blessed are they that do his commandments, that they may have right to the tree of life, and may enter in through the gates into the city.

15 For without are dogs, and sorcerers, and whoremongers, and murderers, and idolaters, and whosoever loveth and maketh a lie.

16 I Jesus have sent mine angel to testify unto you these things in the churches. I am the root and the offspring of David, *and* the bright and morning star.

17 And the Spirit and the bride say, Come. And let him that heareth say, Come. And let him that is athirst come. And whosoever will, let him take the water of life freely.

18 For I testify unto every man that heareth the words of the prophecy of this book, If any man shall add unto these things, God shall add unto him the plagues that are written in this book:

19 And if any man shall take away from the words of the book of this prophecy, God shall take away his part out of the book of life, and out of the holy city, and *from* the things which are written in this book.

20 He which testifieth these things saith, Surely I come quickly. Amen. Even so, come, Lord Jesus.

21 The grace of our Lord Jesus Christ *be* with you all. Amen.

30 32 34 36

2360

FIG. 6A KING JAMES VERSION

THE REVELATION 22

22 AND HE POINTED out to me a river of pure Water of Life, clear as crystal, flowing from the throne of God and the Lamb, [2] coursing down the center of the main street. On each side of the river grew Trees[a] of Life, bearing twelve crops of fruit, with a fresh crop each month; the leaves were used for medicine to heal the nations.

[3] There shall be nothing in the city which is evil; for the throne of God and of the Lamb will be there, and his servants will worship him. [4] And they shall see his face; and his name shall be written on their foreheads. [5] And there will be no night there —no need for lamps or sun—for the Lord God will be their light; and they shall reign forever and ever.

[6] Then the angel said to me, "These words are trustworthy and true: 'I am coming soon!'[b] God, who tells his prophets what the future holds, has sent his angel to tell you this will happen soon. Blessed are those who believe it and all else written in the scroll."

[8] I, John, saw and heard all these things, and fell down to worship the angel who showed them to me; [9] but again he said, "No, don't do anything like that. I, too, am a servant of Jesus as you are, and as your brothers the prophets are, as well as all those who heed the truth stated in this Book. Worship God alone."

[10] Then he instructed me, "Do not seal up what you have written, for the time of fulfillment is near. [11] And when that time comes, all doing wrong will do it more and more; the vile will become more vile; good men will be better; those who are holy will continue on in greater holiness."

[12] "See, I am coming soon,[b] and my reward is with me, to repay everyone according to the deeds he has done. [13] I am the A and the Z, the Beginning and the End, the First and Last. [14] Blessed forever are all who are washing their robes, to have the right to enter in through the gates of the city, and to eat the fruit from the Tree of Life.

[15] "Outside the city are those who have strayed away from God, and the sorcerers and the immoral and murderers and idolaters, and all who love to lie, and do so. [16] I, Jesus, have sent my angel to you to tell the churches all these things. I am both David's Root and his Descendant. I am the bright Morning Star. [17] The Spirit and the bride say, 'Come.' Let each one who hears them say the same, 'Come.' Let the thirsty one come—anyone who wants to; let him come and drink the Water of Life without charge.

[18] And I solemnly declare to everyone who reads this book: If anyone adds anything to what is written here, God shall add to him the plagues described in this book. [19] And if anyone subtracts any part of these prophecies, God shall take away his share in the Tree of Life, and in the Holy City just described.

[20] "He who has said all these things declares: Yes, I am coming soon!"[b]

Amen! Come, Lord Jesus!

[21] The grace of our Lord Jesus Christ be with you all. Amen!

30 32 38 34 36

2360

FIG. 6B LIVING BIBLE PARAPHRASED VERSION

REVELATION 22

22 Then he showed me the river of the water of life, sparkling like crystal, 30
2 flowing from the throne of God and of the Lamb down the middle of the city's street. On either side of the river stood a tree of life, which yields twelve crops of fruit, one for each month of the year; the leaves of the trees
3 serve for the healing of the nations. Every accursed thing shall disappear. The throne of God and of the Lamb will be there, and his servants shall
4 worship him; they shall see him face to face, and bear his name on their
5 foreheads. There shall be no more night, nor will they need the light of lamp or sun, for the Lord God will give them light; and they shall reign for evermore.

6 THEN HE SAID to me, 'These words are trustworthy and true. The Lord God who inspires the prophets has sent his angel to show his servants what must shortly happen. And, remember, I am coming soon!'

7 Happy is the man who heeds the words of prophecy contained in this
8 book! It is I, John, who heard and saw these things. And when I had heard and seen them, I fell in worship at the feet of the angel who had shown 32
9 them to me. But he said to me, 'No, not that! I am but a fellow-servant with you and your brothers the prophets and those who heed the words of
42 10 this book. It is God you must worship.' Then he told me, 'Do not seal up
11 the words of prophecy in this book, for the hour of fulfilment is near. Meanwhile, let the evil-doer go on doing evil and the filthy-minded wallow in his filth, but let the good man persevere in his goodness and the dedicated man be true to his dedication.'

12 'Yes, I am coming soon, and bringing my recompense with me, to
13 requite everyone according to his deeds! I am the Alpha and the Omega, the first and the last, the beginning and the end.'

14 Happy are those who wash their robes clean! They will have the right
15 to the tree of life and will enter by the gates of the city. Outside are dogs, sorcerers and fornicators, murderers and idolaters, and all who love and practise deceit.

16 'I, Jesus, have sent my angel to you with this testimony for the churches. I am the scion and offspring of David, the bright star of dawn.'

17 'Come!' say the Spirit and the bride.
'Come!' let each hearer reply.
Come forward, you who are thirsty; accept the water of life, a free gift to all who desire it.

18 For my part, I give this warning to everyone who is listening to the words of prophecy in this book: should anyone add to them, God will add
19 to him the plagues described in this book; should anyone take away from the words in this book of prophecy, God will take away from him his share in the tree of life and the Holy City, described in this book.

20 He who gives this testimony speaks: 'Yes, I am coming soon!'
Amen. Come, Lord Jesus!

21 The grace of the Lord Jesus be with you all.[a] 34

2360 36

FIG. 6C NEW ENGLISH BIBLE VERSION

REVELATION 22.1

30

22 Then the angel[b] showed me the river of the water of life, bright as crystal, flowing from the throne of God and of the Lamb [2]through the middle of the street of the city. On either side of the river, is the tree of life[c] with its twelve kinds of fruit, producing its fruit each month; and the leaves of the tree are for the healing of the nations. [3]Nothing accursed will be found there any more. But the throne of God and of the Lamb will be in it, and his servants[d] will worship him; [4]they will see his face, and his name will be on their foreheads. [5]And there will be no more night; they need no light of lamp or sun, for the Lord God will be their light, and they will reign forever and ever.

6 And he said to me, "These words are trustworthy and true, for the Lord, the God of the spirits of the prophets, has sent his angel to show his servants[e] what must soon take place."

7 "See, I am coming soon! Blessed is the one who keeps the words of the prophecy of this book."

8 I, John, am the one who heard and saw these things. And when I heard and saw them, I fell down to worship at the feet of the angel who showed them to me; [9]but he said to me, "You must not do that! I am a fellow servant[f] with you and your comrades[g] the prophets, and with those who keep the words of this book. Worship God!"

10 And he said to me, "Do not seal up the words of the prophecy of this book, for the time is near. [11]Let the evildoer still do evil, and the filthy still be filthy, and the righteous still do right, and the holy still be holy."

12 "See, I am coming soon; my reward is with me, to repay according to everyone's work. [13]I am the Alpha and the Omega, the first and the last, the beginning and the end."

14 Blessed are those who wash their robes,[h] so that they will have the right to the tree of life and may enter the city by the gates. [15]Outside are the dogs and sorcerers and fornicators and murderers and idolaters, and everyone who loves and practices falsehood.

16 "It is I, Jesus, who sent my angel to you with this testimony for the churches. I am the root and the descendant of David, the bright morning star." 32

17 The Spirit and the bride say,
"Come."
And let everyone who hears say,
"Come." 40
And let everyone who is thirsty
come.
Let anyone who wishes take the
water of life as a gift.

18 I warn everyone who hears the words of the prophecy of this book: if anyone adds to them, God will add to that person the plagues described in this book; [19]if anyone takes away from the words of the book of this prophecy, God will take away that person's share in the tree of life and in the holy city, which are described in this book.

20 The one who testifies to these things says, "Surely I am coming soon."
Amen. Come, Lord Jesus!

21 The grace of the Lord Jesus be with all the saints. Amen.[i]

34

2360 36

FIG. 6D REVISED STANDARD VERSION

EL SANTO EVANGELIO SEGÚN
SAN MATEO

46

30

LIBRO de la generación de Jesucristo, hijo de David, hijo de Abraham.
2 Abraham engendró á Isaac: é Isaac engendró á Jacob: y Jacob engendró á Judas y á sus hermanos:
3 Y Judas engendró de Thamar á Phares y á Zara: y Phares engendró á Esrom: y Esrom engendró á Aram:
4 Y Aram engendró á Aminadab: y Aminadab engendró á Naassón: y Naassón engendró á Salmón:
5 Y Salmón engendró de Rachâb á Booz, y Booz engendró de Ruth á Obed: y Obed engendró á Jessé:
6 Y Jessé engendró al rey David: y el rey David engendró á Salomón de la *que fué mujer* de Urías:

7 Y Salomón engendró á Roboam: y Roboam engendró á Abía: y Abía engendró á Asa:
8 Y Asa engendró á Josaphat: y Josaphat engendró á Joram: y Joram engendró á Ozías:
9 Y Ozías engendró á Joatam: y Joatam engendró á Achâz: y Achâz engendró á Ezechías:
10 Y Ezechías engendró á Manasés: y Manasés engendró á Amón: y Amón engendró á Josías:
11 Y Josías engendró á Jechônías y á sus hermanos, en la transmigración de Babilonia.

12 Y después de la transmigración de Babilonia, Jechônías engendró á Salathiel: y Salathiel engendró á Zorobabel:
13 Y Zorobabel engendró á Abiud: y Abiud engendró á Eliachim: y Eliachim engendró á Azor:

14 Y Azor engendró á Sadoc: y Sadoc engendró á Achim: y Achim engendró á Eliud:
15 Y Eliud engendró á Eleazar: y Eleazar engendró á Mathán: y Mathán engendró á Jacob:
16 Y Jacob engendró á José, marido de María, de la cual nació Jesús, el cual es llamado el Cristo.
17 De manera que todas las generaciones desde Abraham hasta David son catorce generaciones: y desde David hasta la transmigración de Babilonia, catorce generaciones: y desde la transmigración de Babilonia hasta Cristo, catorce generaciones.
18 Y el nacimiento de Jesucristo fué así: Que siendo María su madre desposada con José, antes que se juntasen, se halló haber concebido del Espíritu Santo.

32

19 Y José su marido, como era justo, y no quisiese infamarla, quiso dejarla secretamente,

34

36

2001

FIG. 7 SPANISH LANGUAGE VERSION

TOBIT 12, 13

30

The two men were shaken, and prostrated themselves in awe. But he 16 17
said to them: 'Do not be afraid, all is well; praise God for ever. It is no 18
thanks to me that I have been with you; it was the will of God. Worship
him all your life long, sing his praise. Take note that I ate no food; what 19
appeared to you was a vision. And now praise the Lord, give thanks to God 20
here on earth; I am ascending to him who sent me. Write down all these
things that have happened to you.' He then ascended, and when they rose 21
to their feet, he was no longer to be seen. They sang hymns of praise to God, 22
giving him thanks for these great deeds he had done when his angel
appeared to them.

32

TOBIT said: 13

'Praise to the ever-living God and to his kingdom.
He punishes and he shows mercy; 2
he brings men down to the grave below,
and up from the great destruction.
Nothing can escape his power.
Give him thanks, men of Israel, in the presence of the nations, 3
for he has scattered you among them;
there he has shown you his greatness. 4
Exalt him in the sight of every living creature,
for he is our Lord and God;
he is our Father and our God for ever.

He will punish you for your wickedness, 5
and he will show mercy to you all,
gathering you from among all the nations
wherever you have been scattered.
When you turn to him with all your heart and soul 6
and act in loyal obedience to him,
then he will turn to you
and hide his face from you no longer.
Consider now the deeds he has done for you,
and give him thanks with full voice;
praise the righteous Lord
and exalt the King of ages. [a]

34

36

3087

FIG. 8A APOCRYPHA NEW ENGLISH BIBLE VERSION

TOBIT 13.6

16 The two of them were shaken;
they fell face down, for they were afraid.
17 But he said to them, "Do not be afraid;
peace be with you. Bless God forever-
more. 18 As for me, when I was with you,
I was not acting on my own will, but by
the will of God. Bless him each and every
day; sing his praises. 19 Although you
were watching me, I really did not eat or
drink anything— but what you saw was
a vision. 20 So now get up from the
ground, and acknowledge God. See, I
am ascending to him who sent me. Write
down all these things that have happened
to you." And he ascended. 21 Then they
stood up, and could see him no more.
22 They kept blessing God and singing his
praises, and they acknowledged God for
these marvelous deeds of his, when an
angel of God had appeared to them.

13 Then Tobit said:
"Blessed be God who lives
forever,
because his kingdom lasts
throughout all ages.
2 For he afflicts, and he shows
mercy;
he leads down to Hades in the
lowest regions of the earth,
and he brings up from the great
abyss,
and there is nothing that can
escape his hand.
3 Acknowledge him before the
nations, O children of
Israel;
for he has scattered you among
them.
4 He has shown you his greatness
even there.
Exalt him in the presence of every
living being,
because he is our Lord and he is
our God;
he is our Father and he is God
forever.

30

5 He will afflict you for your
iniquities,
but he will again show mercy
on all of you.
He will gather you from all the
nations
among whom you have been
scattered.

32

6 If you turn to him with all your
heart and with all your
soul,
to do what is true before him,
then he will turn to you
and will no longer hide his face
from you.
So now see what he has done for
you;
acknowledge him at the top of
your voice.
Bless the Lord of righteousness,
and exalt the King of the ages.
In the land of my exile I
acknowledge him,
and show his power and
majesty to a nation of
sinners:
'Turn back, you sinners, and do
what is right before him;
perhaps he may look with favor
upon you and show you
mercy.'

34

36

3087

FIG. 8B APOCRYPHA REVISED STANDARD VERSION

CONCORDANCE

*To the Holy Scriptures*

48 — A

ABASE Ezek. 21:26, and *a* him that is high
Dan. 4:37, walk in pride, he is able to *a*
Mat. 23:12; Luke 14:11; 18:14, whosoever exalteth himself shall be *a*
Phil. 4:12, I know how to be *a*
*See* Job 40:11; Is. 31:4, 2 Cor. 11:7

52 — ABATED Gen. 8:3; Lev. 27:18; Deut. 34:7

ABHOR Ex. 5:21, made our savour to be *a*
Job 19:19, my inward friends *a* me
Ps. 78:59, wrath, and *a* Israel 89:38, thou hast cast off and *a*
Prov. 22:14, *a* of the Lord shall fall therein
Is. 66:24, be an *a* unto all flesh
Ezek. 16:25, made thy beauty to be *a*
*See* Lev. 26:11; Job 42:6; Rom. 12:9

ABIDE Ex. 16:29, *a* every man in his place
Num. 24:2, he saw Israel *a* in tents
31:19, *a* without camp seven days
1 Sam. 5:7, ark of God shall not *a* with us
Job 24:13, nor *a* in the paths thereof
Ps. 15:1, Lord, who shall *a* in thy tabernacle?
91:1, shall *a* under the shadow
Prov. 15:31, hereth reproof *a* among wise
Eccl. 1:4, the earth *a* for ever
Jer. 42:10, if ye will still *a* in this land
49:18, 33; 50:40, there shall no man *a*
Luke 2:8, shepherds *a* in field
24:29, *a* with us, it is toward evening

ABODE—*Continued*
Judg. 21:2, the people *a* there before God
Luke 1:56, Mary *a* with her about three months
John 1:32, the Spirit, and it *a* on him
8:44, a murderer, and *a* not in truth
Acts 14:3, long time *a*, speaking boldly
18:3, Paul *a* with them, and wrought
*See* 1 Sam. 7:2; Ezra 8:15

ABOLISH 2 Cor. 3:13, the end of that *a*
Eph. 2:15, *a* in his flesh the enmity
2 Tim. 1:10, Christ who hath *a* death
*See* Is. 2:18; 51:6; Ezek. 6:6

ABOMINABLE 1 Ki. 21:26, Ahab *a* in following idols
Job 15:16, how much more *a* is man?
Ps. 14:1; 53:1, they have done *a* works
Is. 14:19, cast out like *a* branch
65:4; Jer. 16:18, broth of *a* things
Jer. 44:4, this *a* thing that I hate
Tit. 1:16, in works they deny him, being *a*
1 Pet. 4:3, walked in *a* idolatries
*See* Lev. 11:43; Deut. 14:3; Rev. 21:8

ABOMINATION Gen. 43:32, *a* to Egyptians
Lev. 18:26, shall not commit any *a*
Deut. 7:26, nor bring *a* into house
18:9, after the *a* of nations
12, because of *a* the Lord doth drive
25:16, all that do unrighteously are *a* to God
Prov. 3:32; 11:20, the froward *a* to the Lord
8:7, wickedness an *a* to my lips
15:8, 9, 26; 21:27, sacrifice, etc. of wicked *a*

ABILITY Ezra 2:69, they gave after their *a*
Dan. 1:4, had *a* to stand in the palace
Mat. 25:15, to every man according to *a*
1 Pet. 4:11, as of the *a* God giveth
*See* Lev. 27:8; Neh. 5:8; Acts 11:29

ABJECTS Ps. 35:15, the *a* gathered themselves together

ABLE Deut. 16:17, every man give as he is *a*
Josh. 23:9, no man *a* to stand before you
1 Sam. 6:20, who is *a* to stand before God?
1 Ki. 3:9, who is *a* to judge?
2 Chr. 2:6, who is *a* to build?
Prov. 27:4, who is *a* to stand before envy?
Amos 7:10, land not *a* to bear his words
Mat. 3:9, God is *a* of these stones
9:28, believe ye that I am *a*
20:22, are ye *a* to drink of the cup?
Luke 12:26, not *a* to do which is least
Acts 6:10, not *a* to resist wisdom
Rom. 4:21, what he had promised he was *a*
8:39, *a* to separate us from love of God
1 Cor. 10:13, tempted above that ye are *a*

ABOUND Rom. 15:13, that ye may *a* in hope
1 Cor. 15:58, always *a* in work of the Lord
2 Cor. 1:5, as sufferings *a*, so consolation *a*
*See* Rom. 3:7; 5:15; Phil. 4:12

ABOVE Job 31:2, portion of God from *a*
Prov. 15:24, way of life *a* to wise
Mat. 10:24; Luke 6:40, disciple not *a* master
John 3:31, he that cometh from *a* is *a* all
John 8:23, I am from *a*
1 Cor. 4:6, *a* that which is written
Gal. 4:26, Jerusalem *a* is free
*See* Gen. 48:22; Ps. 138:2; Jas. 1:17

ABODE (n.) John 14:23, come and make our *a*
*See* 2 Ki. 19:27, Is. 37:28

ABODE (v.) Gen. 49:24, his bow *a* in strength
Ex. 24:16, glory of the Lord *a* on Sinai

34

36

4001

FIG. 9A PRIOR ART

*Concordance*

50 — ABSENT 1 Cor. 5:3; Col. 2:5, *a* in body
2 Cor. 5:6, *a* from Lord
*See* Gen. 31:49; 2 Cor. 10:1

ABSTAIN 1 Thes. 5:22, *a* from all appearance of evil
1 Pet. 2:11, *a* from fleshly lusts
*See* 1 Thes. 4:3; 1 Tim. 4:3

ABSTINENCE Acts 27:21, after long *a* Paul stood forth

ABUNDANCE 1 Sam. 1:16
1 Ki. 18:41, sound of *a* of rain
1 Chr. 29:21, offered sacrifices in *a*
Ps. 52:7, trusted in *a* of riches
72:7; Jer. 33:6, *a* of peace
Eccl. 5:10, loveth *a* with increase Is. 56:12, as this day, and more *a*
1 Tim. 1:14, grace was exceeding *a*
Tit. 3:6, shed *a*, through Jesus Christ
2 Pet. 1:11, entrance administered *a*
*See* Ex. 34:6; Is. 55:7; 1 Pet. 1:3

ABUSE 1 Cor. 7:31, use world as not *a*
9:18, that I *a* not my power

ACCEPT Gen. 4:7, shalt thou not be *a*?
Ex. 28:38; Lev. 10:19, *a* before the Lord
Deut. 33:11, *a* the work of his hands
1 Sam. 18:5, *a* in sight of all the people
2 Sam. 24:23, the Lord thy God *a* thee

ACCOMPLISH Job 14:6, *a*, as a hireling
Ps. 64:6, they *a* diligent search
Prov. 13:19, desire *a* is sweet
Is. 40:2, her warfare is *a*
Luke 12:50, straitened till it be *a*
1 Pet. 5:9, afflictions are *a* in brethren
*See* Is. 55:11; Luke 18:31; 22:37

ACCORD Acts 1:14; 4:24; 8:6; Phil. 2:2

ACCORDING Ex. 12:25, *a* as he promised
Deut. 16:10, *a* as God hath blessed thee
Job 34:11; Jer. 17:10; 25:14; 32:19, *a* to ways
Mat. 16:27; Rom. 2:6, *a* to works
John 7:24, *a* to the appearance
Rom. 8:28, the called *a* to his purpose
12:6, gifts differing *a* to grace

ACCOUNT Luke 16:2, give *a* of stewardship
20:35, *a* worthy to obtain
Rom. 14:12, every one give *a* to God
Gal. 3:6, *a* to him for righteousness
Heb. 13:17, watch as they that give *a*
*See* Job 33:13; Ps. 144:3; Mat. 12:36

ACCURSED Josh. 6:18; 7:1; 22:20, *a* thing
Rom. 9:3, wish myself *a* from Christ
1 Cor. 12:3, no man calleth Jesus *a*
Gal. 1:8, 9, preach other gospel, let him be *a*
*See* Deut. 21:23; Josh. 6:17; Is. 65:20

ADVERSITY 1 Sam. 10:19, all *a*
Ps. 10:6, I shall never be in *a*
94:13; Prov. 24:10; Eccl. 7:14, day of *a*
Prov. 17:17, brother is born for *a*
Is. 30:20, bread of *a*
Heb. 13:3, remember them which suffer *a*
*See* Ps. 31:7; 35:15

ADVERTISE Num. 24:14; Ruth 4:4

ADVICE 1 Sam. 25:33, blessed be thy *a*
2 Sam. 19:43, that our *a* should not be first
2 Chr. 10:9, 14, what *a* give ye?
Prov. 20:18, with good *a* make war
2 Cor. 8:10, herein I give my *a*
*See* Judg. 19:30; 20:7; 2 Chr. 25:17

ACCUSATION Luke 19:8, by false *a*
1 Tim. 5:19, against elder receive not *a*
2 Pet. 2:11; Jude 9, railing *a*
*See* Mat. 27:37; Mark 15:26; Luke 6:7

ACCUSE Prov. 30:10, *a* not servant to master
Mat. 27:12, when *a* he answered nothing
Luke 16:1, was *a* that he had wasted
John 5:45, that I will *a* you to the Father
Tit. 1:6, not *a* of riot or unruly

ACKNOWLEDGE Ps. 32:5; 51:3, I *a* my sin
Prov. 3:6, in all thy ways *a* him
Is. 63:16, though Israel *a* us not
1 Jonn 2:23, he that *a* the son
*See* Dan. 11:39; Hos. 5:15

ACQUAINT Job 22:21; Ps. 139:3; Eccl. 2:3

ACQUAINTANCE Job 19:13; Ps. 31:11

ACQUIT Job 10:14; Nah. 1:3

ACTIONS 1 Sam. 2:3

ACTIVITY Gen. 47:6

ADDER Gen. 49:17; Ps. 58:4; 91:13; 140:3

ADDICTED 1 Cor. 16:15

ADDITION 1 Ki. 7:29, 30, 36

ADJURE Josh. 6:26; 1 Sam. 14:24; Mark 5:7

ADMINISTER 1 Cor. 12:5; 2 Cor. 8:19, 20

ADMIRE 2 Thes. 1:10; Jude 16; Rev. 17:6

ADMONISH Acts 27:9, Paul *a* them
Rom. 15:14; Col. 3:16, *a* one another
1 Thes. 5:12, over you in Lord, and *a* you
2 Thes. 3:15, *a* him as a brother
Heb. 8:5, Moses was *a* of God
*See* Eccl. 4:13; 12:12; Jer. 42:19

ADMONITION 1 Cor. 10:11; Eph. 6:4

ADO Mark 5:39

ADOPTION Rom. 8:15, 23; 9:4; Gal. 4:5

ADORN Is. 61:10; Rev. 21:2, bride *a* herself
1 Tim. 2:9; 1 Pet. 3:3, 5, women *a*
Tit. 2:10, *a* doctrine of God

ADULTERER Lev. 20:10, *a* shall surely be put to death
Job 24:15, eye of *a* waits for twilight
Is. 57:3, seed of the *a*
Jer. 9:2; 23:10, land is full of *a*
Mal. 3:5, I, swift witness against *a*
1 Cor. 6:9, neither *a* shall inherit

ADULTERY Prov. 6:32, whoso committeth *a*
Mat. 5:28, committed *a* in his heart
2 Pet. 2:14, having eyes full of *a*
*See* Hos. 2:2; Mat. 15:19; Mark 7:21

ADVANCED 1 Sam. 12:6; Esth. 3:1; 5:11

ADVANTAGE Luke 9:25, what is a man *a*?
Rom. 3:1; 1 Cor. 15:32, what *a*?
2 Cor. 2:11, lest Satan get *a*
*See* Job 35:3; Jude 16

ADVENTURE Deut. 28:56; Judg. 9:17

ADVERSARY Ex. 23:22, I will be *a* to thy *a*
Num. 22:22, angel stood for *a*
Ps. 89:42; Is. 59:18; Jer. 46:10; Nah. 1:2
Luke 13:17, his *a*
1 Ki. 5:4, neither *a* nor evil
11:14, 23, Lord stirred up *a*
Job 31:35, that mine *a* had written a book
Ps. 38:20; 69:19; 109:4, 20, 29; Is. 1:24, my *a*
74:10, how long shall *a* reproach?
Is. 50:8, who is mine *a*?
64:2; Jer. 30:16; Mic. 5:9, thy *a*

34

4002

36

FIG. 9B

BIBLE GLOSSARY

50 A

AARON The elder brother of and often the spokesman for Moses. From him descended, through his eldest son Eleazer, the hereditary class of priests in Israel.

ABEDNEGO The Babylonian name of one of the companions of Daniel, his Hebrew name being Azariah. *See* Shadrach.

ABBA A name addressed to God in Jewish and early Christian prayers. It occurs three times in the NT, with its Greek equivalent placed after it (Mk 14.36; Rom 8.15; Gal 4.6).

ABEL (Heb. "vanity," "breath"; Akkad. "son") 1. The second son of Adam, who was murdered by his brother Cain (Gen 4.2ff). He was God-fearing and righteous, and in contrast with Cain is a pattern of a worshiper pleasing to God, who on that account has to suffer (1 Jn 3.12). He is described as righteous by our Lord (Mt 23.35), and in Heb 11.4 he stands at the head of the heroes of faith.

ABIATHAR (Heb. "the Father [God] gives abundantly") A priest who became the priest of David.

ABIGAIL (Heb. "my father rejoices") The wife of Nabal and after Nabal's death the wife of David.

ABIMELECH (Heb. "Melek is Father") A king of Gerar who appears in similar accounts of Isaac and Rebecca and of Abraham and Sarah (Gen 20–21; 26).

54

ABNER (Heb. "father is Ner") Commander of the Israelite army under Saul.

ABOMINATION Anything ritually or ethically repugnant or loathsome to God and men.

ABRAHAM, ABRAM (Heb. "Father of a multitude"; "exalted Father") One of the greatest OT characters, and possibly the story of two persons combined into one (Gen 11.27–25.8). Abraham was born in Ur of the Chaldees, in what is now Iraq. Terah, his father, migrated with Abraham and Sarah, Abraham's wife, and Lot, his nephew, as far as Haran, now Harran, in Turkey. There Terah died. The others, with flocks and herds, moved on to Palestine (Canaan).

At Sarah's death he arranged the purchase of a burial place at Machpelah, where he also was buried after a long life of constant activity

34

36

5001

FIG.10A

GLOSSARY

50

ABSALOM (Heb. "father of peace") Son of David and Maachah, through popular arts alienating the people from his father, at length raised a revolt against him, but was defeated by Joab and slain by him, to the great sorrow of David (2 Sam 3.3, 13.20–19.10).

ACCAD (Gen 10.10) One of the four cities of Nimrod in Shinar (Babylonia). Land of Sumer and Accad (or Akkad) is in the Assyrian inscriptions the common designation of Babylonia as a whole. *See* Akkad; Babylonia.

ACELDAMA, AKELDAMA A burial ground outside the Jerusalem wall.

ACTS OF THE APOSTLES, THE Written by the author of the Gospel according to Luke. Acts is the account of what Jesus' disciples did after His resurrection. It tells about the early Christian church and its missionaries, the baptism of Cornelius, the Council in Jerusalem, and about the conversion of Paul and his journeys to establish churches and to teach. Acts emphasizes that the church is guided continually by the Holy Spirit.

ADAM ("earthy," "a human") The Hebrew word for man, specifically applied to the first man. Created on the same day as the animals, he is not semi-divine but has the ability for spiritual growth.

ADAMANT It is not known what is meant by this word; it is something impenetrably hard (Ezek 3.9; Jer 17.1; Zech 7.12).

54

ADONAI, ADONAY A Hebrew name for God. *See* Jehovah.

AGAPE, THE (Gr. *agape*, "love") Love feasts, the common meals of the early Christians, which expressed the brotherly love that bound them together as one family, and culminated in the Lord's Supper. Gross abuses of this beautiful custom, such as are condemned in 1 Cor 11.17ff, and Jude 12, led to the separation of the Lord's Supper from the love feast in the post-apostolic church.

AGRICULTURE Excavations reveal a developed agriculture in Bible lands as early as 8000-7000 B.C.; flint sickles for harvesting and basalt mortars and pestles for grinding grain are found in abundance. The religious year of the Israelites was adjusted to the cultivation cycle, and many memorable passages of the Bible have reference to the life of seedtime and harvest.

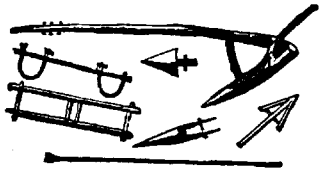

Plow and other implements

The patriarchs and their descendants down to the conquest of Canaan were herdsmen of cattle (sheep, oxen, goats, asses, and camels). After the settlement, the western tribes learned agriculture, and the culture of the vine, olive, and fig tree, from the Canaanites. Among the crops raised were wheat, barley, rye, spelt, flax, cummin, fitches or vetch, beans, lentils, and millet.

34

36

5002

FIG.10B

BIBLE TEXT GROUP NUMBERING TABLE

| COL. X TEXT GROUP | COL. Y BEGINNING PAGE NUMBER | COL. Z ENDING PAGE NUMBER |
|---|---|---|
| Old Testament | 1 | A number greater than 1 but less than 2000 |
| New Testament | 2001 | A number greater than 2001 but less than 3000 |
| Apocrypha | 3001 | A number greater than 3001 but less than 4000 |
| Concordance | 4001 | A number greater than 4001 but less than 5000 |
| Glossary | 5001 | A number greater than 5001 but less than 6000 |

66 68 70 64

OLD TESTAMENT

| 72 COL.A | 74 COL.B | 72 COL.A | 74 COL.B | 72 COL.A | 74 COL.B |
|---|---|---|---|---|---|
| 1 | GENESIS 1:1 - 1:24 | 29 | 24:60 -25:18 | 57 | 43:21 -44:8 |
| 2 | 1:25 - 2:15 | 30 | 25:19 -26:8 | 58 | 44:9 -44:34 |
| 3 | 2:16 - 3:13 | 31 | 26:9 -26:32 | 59 | 45:1 -45:22 |
| 4 | 3:14 - 4:4 | 32 | 26:33 -27:24 | 60 | 45:23 -46:18 |
| 5 | 4:5 - 4:24 | 33 | 27:25 -27:40 | 61 | 46:19 -47:8 |
| 6 | 4:25 - 5:29 | 34 | 27:41 -28:16 | 62 | 47:9 -47:28 |
| 7 | 5:30 - 6:22 | 35 | 28:17 -29:19 | 63 | 47:29 -48:16 |
| 8 | 7:1 - 7:24 | 36 | 29:20 -30:13 | 64 | 48:17 -49:9 |
| 9 | 8:1 - 8:22 | 37 | 30:14 -30:36 | 65 | 49:10 -49:24 |
| 10 | 9:1 - 9:23 | 38 | 30:37 -31:16 | 66 | 49:25 -50:9 |
| 11 | 9:24 -10:20 | 39 | 31:17 -31:39 | 67 | 50:10 -50:26 |
| 12 | 10:21 -11:18 | 40 | 31:40 -32:7 | 68 | EXODUS 1:1 - 1:21 |
| 13 | 11:19 -12:9 | 41 | 32:8 -32:31 | 69 | 1:22 - 2:21 |
| 14 | 12:10 -13:13 | 42 | 32:32 -34:2 | 70 | 2:22 - 3:15 |
| 15 | 13:14 -14:17 | 43 | 34:3 -34:26 | 71 | 3:16 - 4:10 |
| 16 | 14:18 -15:17 | 44 | 34:27 -35:12 | 72 | 4:11 - 5:1 |
| 17 | 15:18 -16:16 | 45 | 35:13 -36:10 | 73 | 5:2 - 5:23 |
| 18 | 17:1 -17:22 | 46 | 36:11 -36:35 | 74 | 6:1 - 6:22 |
| 19 | 17:23 -18:19 | 47 | 36:36 -37:14 | 75 | 6:23 - 7:15 |
| 20 | 18:20 -19:8 | 48 | 37:15 -38:3 | 76 | 7:16 - 8:9 |
| 21 | 19:9 -19:30 | 49 | 38:4 -38:25 | 77 | 8:10 - 8:29 |
| 22 | 19:31 -20:14 | 50 | 38:26 -39:17 | 78 | 8:30 -9:18 |
| 23 | 20:15 -21:21 | 51 | 39:18 -40:17 | 79 | 9:19 -10:2 |
| 24 | 21:22 -22:11 | 52 | 40:18 -41:19 | 80 | 10:3 -10:21 |
| 25 | 22:12 -23:11 | 53 | 41:20 -41:45 | 81 | 10:22 -12:2 |
| 26 | 23:12 -24:13 | 54 | 41:46 -42:12 | 82 | 12:3 -12:21 |
| 27 | 24:14 -24:36 | 55 | 42:13 -42:36 | 83 | 12:22 -12:41 |
| 28 | 24:37 -24:59 | 56 | 42:37 -43:20 | 84 | 12:42 -13:12 |

FIG.13 A OLD TESTAMENT WORKABLE MODEL

2

| 72 COL.A | | 74 COL.B | 72 COL.A | 74 COL.B | 72 COL.A | 74 COL.B |
|---|---|---|---|---|---|---|
| 85 | EXODUS | 13:13 -14:9 | 113 | 32:27 -33:10 | 141 | 11:47 -13:9 |
| 86 | | 14:10 -14:27 | 114 | 33:11 -34:7 | 142 | 13:10 -13:30 |
| 87 | | 14:28 -15:12 | 115 | 34:8 -34:25 | 143 | 13:31 -13:51 |
| 88 | | 15:13 -15:27 | 116 | 34:26 -35:14 | 144 | 13:52 -14:11 |
| 89 | | 16:1 -16:18 | 117 | 35:15 -35:35 | 145 | 14:12 -14:30 |
| 90 | | 16:19 -17:4 | 118 | 36:1 -36:21 | 146 | 14:31 -14:52 |
| 91 | | 17:5 -18:9 | 119 | 36:22 -37:8 | 147 | 14:53 -15:18 |
| 92 | | 18:10 -19:2 | 120 | 37:9 -38:2 | 148 | 15:19 -16:5 |
| 93 | | 19:3 -19:22 | 121 | 38:3 -38:23 | 149 | 16:6 -16:22 |
| 94 | | 19:23 -20:23 | 122 | 38:24 -39:13 | 150 | 16:23 -17:6 |
| 95 | | 20:24 -21:21 | 123 | 39:14 -39:37 | 151 | 17:7 -18:10 |
| 96 | | 21:22 -22:7 | 124 | 39:38 -40:19 | 152 | 18:11 -19:4 |
| 97 | | 22:8 -23:1 | 125 | 40:20 -40:38 | 153 | 19:5 -19:25 |
| 98 | | 23:2 -23:23 | 126 | LEV. 1:1 - 1:14 | 154 | 19:26 -20:11 |
| 99 | | 23:24 -24:11 | 127 | 1:15 - 2:16 | 155 | 20:12 -21:3 |
| 100 | | 24:12 -25:19 | 128 | 3:1 - 4:3 | 156 | 21:4 -22:2 |
| 101 | | 25:20 -26:1 | 129 | 4:4 - 4:22 | 157 | 22:3 -22:23 |
| 102 | | 26:2 -26:23 | 130 | 4:23 - 5:4 | 158 | 22:24 -23:14 |
| 103 | | 26:24 -27:8 | 131 | 5:5 - 6:2 | 159 | 23:15 -23:35 |
| 104 | | 27:9 -28:7 | 132 | 6:3 - 6:22 | 160 | 23:36 -24:12 |
| 105 | | 28:8 -28:29 | 133 | 6:23 - 7:15 | 161 | 24:13 -25:12 |
| 106 | | 28:30 -29:5 | 134 | 7:16 - 7:35 | 162 | 25:13 -25:34 |
| 107 | | 29:6 -29:26 | 135 | 7:36 - 8:20 | 163 | 25:35 -25:55 |
| 108 | | 29:27 -29:46 | 136 | 8:21 - 9:2 | 164 | 26:1 -26:23 |
| 109 | | 30:1 -30:20 | 137 | 9:3 - 9:24 | 165 | 26:24 -26:43 |
| 110 | | 30:21 -31:6 | 138 | 10:1 -10:18 | 166 | 26:44 -27:18 |
| 111 | | 31:7 -32:7 | 139 | 10:19 -11:25 | 167 | 27:19 -27:34 |
| 112 | | 32:8 -32:26 | 140 | 11:26 -11:46 | 168 | NUMBERS 1:1 - 1:20 |

FIG.13B OLD TESTAMENT WORKABLE MODEL

| 72 COL.A | 74 COL.B | 72 COL.A | 3 74 COL.B | 72 COL.A | 74 COL.B |
|---|---|---|---|---|---|
| 169 | NUMBERS 1:21 - 1:38 | 197 | 16:25 -16:45 | 225 | 33:47 -34:11 |
| 170 | 1:39 - 2:4 | 198 | 16:46 -18:2 | 226 | 34:12 -35:5 |
| 171 | 2:5 - 2:27 | 199 | 18:3 -18:19 | 227 | 35:6 -35:26 |
| 172 | 2:28 - 3:14 | 200 | 18:20 -19:6 | 228 | 35:27 -36:8 |
| 173 | 3:15 - 3:36 | 201 | 19:7 -20:1 | 229 | 36:9 -36:13 |
| 174 | 3:37 - 4:5 | 202 | 20:2 -20:21 | 230 | DEUT. 1:1 - 1:15 |
| 175 | 4:6 - 4:25 | 203 | 20:22 -21:12 | 231 | 1:16 - 1:36 |
| 176 | 4:26 - 4:43 | 204 | 21:13 -21:29 | 232 | 1:37 - 2:10 |
| 177 | 4:44 - 5:15 | 205 | 21:30 -22:14 | 233 | 2:11 - 2:31 |
| 178 | 5:16 - 6:3 | 206 | 22:15 -22:34 | 234 | 2:32 - 3:15 |
| 179 | 6:4 - 6:22 | 207 | 22:35 -23:12 | 235 | 3:16 - 4:5 |
| 180 | 6:23 - 7:20 | 208 | 23:13 -24:3 | 236 | 4:6 - 4:24 |
| 181 | 7:21 - 7:47 | 209 | 24:4 -24:17 | 237 | 4:25 - 4:42 |
| 182 | 7:48 - 7:74 | 210 | 24:18 -25:12 | 238 | 4:43 - 5:14 |
| 183 | 7:75 - 8:7 | 211 | 25:13 -26:17 | 239 | 5:15 - 6:1 |
| 184 | 8:8 - 9:1 | 212 | 26:18 -26:41 | 240 | 6:2 - 6:24 |
| 185 | 9:2 - 9:19 | 213 | 26:42 -26:63 | 241 | 6:25 - 7:15 |
| 186 | 9:20 -10:16 | 214 | 26:64 -27:19 | 242 | 7:16 - 8:8 |
| 187 | 10:17 -11:3 | 215 | 27:20 -28:17 | 243 | 8:9 - 9:6 |
| 188 | 11:4 -11:22 | 216 | 28:18 -29:10 | 244 | 9:7 - 9:25 |
| 189 | 11:23 -12:7 | 217 | 29:11 -29:31 | 245 | 9:26 -10:14 |
| 190 | 12:8 -13:19 | 218 | 29:32 -30:10 | 246 | 10:15 -11:12 |
| 191 | 13:20 -14:5 | 219 | 30:11 -31:15 | 247 | 11:13 -11:32 |
| 192 | 14:6 -14:26 | 220 | 31:16 -31:39 | 248 | 12:1 -12:17 |
| 193 | 14:27 -15:2 | 221 | 31:40 -32:8 | 249 | 12:18 -13:2 |
| 194 | 15:3 -15:24 | 222 | 32:9 -32:30 | 250 | 13:3 -13:18 |
| 195 | 15:25 -16:2 | 223 | 32:31 -33:11 | 251 | 14:1 -14:22 |
| 196 | 16:3 -16:24 | 224 | 33:12 -33:46 | 252 | 14:23 -15:10 |

FIG.13C OLD TESTAMENT WORKABLE MODEL

4

| 72 COL.A | 74 COL.B | 72 COL.A | 74 COL.B | 72 COL.A | 74 COL.B |
|---|---|---|---|---|---|
| 253 | DEUT. 15:11 -16:6 | 281 | 33:16 -33:25 | 309 | 19:27 -19:51 |
| 254 | 16:7 -17:2 | 282 | 33:26 -34:12 | 310 | 20:1 -21:7 |
| 255 | 17:3 -17:19 | 283 | JOSHUA 1:1 - 1:13 | 311 | 21:8 -21:33 |
| 256 | 17:20 -18:20 | 284 | 1:14 - 2:12 | 312 | 21:34 -22:8 |
| 257 | 18:21 -19:17 | 285 | 2:13 - 3:6 | 313 | 22:9 -22:23 |
| 258 | 19:18 -20:16 | 286 | 3:7 - 4:7 | 314 | 22:24 -23:4 |
| 259 | 20:17 -21:14 | 287 | 4:8 - 5:2 | 315 | 23:5 -24:5 |
| 260 | 21:15 -22:10 | 288 | 5:3 - 6:4 | 316 | 24:6 -24:22 |
| 261 | 22:11 -22:30 | 289 | 6:5 - 6:21 | 317 | 24:23 -24:33 |
| 262 | 23:1 -23:21 | 290 | 6:22 - 7:11 | 318 | JUDGES 1:1 - 1:15 |
| 263 | 23:22 -24:15 | 291 | 7:12 - 7:26 | 319 | 1:16 - 1:35 |
| 264 | 24:16 -25:12 | 292 | 8:1 - 8:18 | 320 | 1:36 - 2:17 |
| 265 | 25:13 -26:12 | 293 | 8:19 - 8:35 | 321 | 2:18 - 3:13 |
| 266 | 26:13 -27:11 | 294 | 9:1 - 9:20 | 322 | 3:14 - 4:3 |
| 267 | 27:12 -28:6 | 295 | 9:21 -10:10 | 323 | 4:4 - 4:21 |
| 268 | 28:7 -28:26 | 296 | 10:11 -10:27 | 324 | 4:22 - 5:10 |
| 269 | 28:27 -28:47 | 297 | 10:28 -11:2 | 325 | 5:11 - 5:23 |
| 270 | 28:48 -28:63 | 298 | 11:3 -11:20 | 326 | 5:24 - 6:7 |
| 271 | 28:64 -29:16 | 299 | 11:21 -12:19 | 327 | 6:8 - 6:25 |
| 272 | 29:17 -30:4 | 300 | 12:20 -13:19 | 328 | 6:26 - 7:2 |
| 273 | 30:5 -31:3 | 301 | 13:20 -14:5 | 329 | 7:3 - 7:17 |
| 274 | 31:4 -31:19 | 302 | 14:6 -15:7 | 330 | 7:18 - 8:9 |
| 275 | 31:20 -32:3 | 303 | 15:8 -15:33 | 331 | 8:10 - 8:28 |
| 276 | 32:4 -32:14 | 304 | 15:34 -16:4 | 332 | 8:29 - 9:14 |
| 277 | 32:15 -32:27 | 305 | 16:5 -17:10 | 333 | 9:15 - 9:32 |
| 278 | 32:28 -32:41 | 306 | 17:11 -18:8 | 334 | 9:33 - 9:51 |
| 279 | 32:42 -33:5 | 307 | 18:9 -18:28 | 335 | 9:52 - 10:15 |
| 280 | 33:6 -33:15 | 308 | 19:1 -19:26 | 336 | 10:16 - 11:16 |

FIG.13D OLD TESTAMENT WORKABLE MODEL

5

| 72 COL.A | 74 COL.B | 72 COL.A | 74 COL.B | 72 COL.A | 74 COL.B |
|---|---|---|---|---|---|
| 337 | JUDGES 11:17 -11:34 | 365 | 6:2 - 6:17 | 393 | 24:13 -25:10 |
| 338 | 11:35 -12:12 | 366 | 6:18 - 7:11 | 394 | 25:11 -25:28 |
| 339 | 12:13 -13:17 | 367 | 7:12 - 8:16 | 395 | 25:29 -26:2 |
| 340 | 13:18 -14:11 | 368 | 8:17 - 9:12 | 396 | 26:3 -26:19 |
| 341 | 14:12 -15:8 | 369 | 9:13 -10:1 | 397 | 26:20 -27:12 |
| 342 | 15:9 -16:6 | 370 | 10:2 -10:19 | 398 | 28:1 -28:18 |
| 343 | 16:7 -16:23 | 371 | 10:20 -11:10 | 399 | 28:19 -29:9 |
| 344 | 16:24 -17:8 | 372 | 11:11 -12:12 | 400 | 29:10 -30:16 |
| 345 | 17:9 -18:13 | 373 | 12:13 -13:6 | 401 | 30:17 -31:4 |
| 346 | 18:14 -18:31 | 374 | 13:7 -14:1 | 402 | 31:5 -31:13 |
| 347 | 19:1 -19:17 | 375 | 14:2 -14:19 | 403 | 2 SAM. 1:1 - 1:11 |
| 348 | 19:18 -20:4 | 376 | 14:20 -14:37 | 404 | 1:12 - 1:29 |
| 349 | 20:5 -20:23 | 377 | 14:38 -15:5 | 405 | 2:1 - 2:20 |
| 350 | 20:24 -20:41 | 378 | 15:6 -15:23 | 406 | 2:21 - 3:7 |
| 351 | 20:42 -21:12 | 379 | 15:24 -16:8 | 407 | 3:8 - 3:25 |
| 352 | 21:13 -21:35 | 380 | 16:9 -17:5 | 408 | 3:26 - 4:5 |
| 353 | RUTH 1:1 - 1:15 | 381 | 17:6 -17:26 | 409 | 4:6 - 5:10 |
| 354 | 1:16 - 2:11 | 382 | 17:27 -17:45 | 410 | 5:11 - 6:7 |
| 355 | 2:12 - 3:6 | 383 | 17:46 -18:5 | 411 | 6:8 - 7:4 |
| 356 | 3:7 - 4:6 | 384 | 18:6 -18:26 | 412 | 7:5 - 7:24 |
| 357 | 4:7 - 4:22 | 385 | 18:27 -19:16 | 413 | 7:25 - 8:14 |
| 358 | 1 SAM. 1:1 - 1:12 | 386 | 19:17 -20:10 | 414 | 8:15 -10:1 |
| 359 | 1:13 - 2:3 | 387 | 20:11 -20:29 | 415 | 10:2 -10:19 |
| 360 | 2:4 - 2:18 | 388 | 20:30 -21:5 | 416 | 11:1 -11:20 |
| 361 | 2:19 - 2:36 | 389 | 21:6 -22:7 | 417 | 11:21 -12:10 |
| 362 | 3:1 - 4:1 | 390 | 22:8 -23:3 | 418 | 12:11 -12:29 |
| 363 | 4:2 - 4:18 | 391 | 23:4 -23:23 | 419 | 12:30 -13:15 |
| 364 | 4:19 - 6:1 | 392 | 23:24 -24:12 | 420 | 13:16 -13:35 |

FIG.13E OLD TESTAMENT WORKABLE MODEL

6

| 72 COL.A | 74 COL.B | 72 COL.A | 74 COL.B | 72 COL.A | 74 COL.B |
|---|---|---|---|---|---|
| 421 | 2 SAM. 13:36 -14:15 | 449 | 3:26 - 4:19 | 477 | 18:41 -19:12 |
| 422 | 14:16 -14:33 | 450 | 4:20 - 5:5 | 478 | 19:13 -20:8 |
| 423 | 15:1 -15:20 | 451 | 5:6 - 6:5 | 479 | 20:9 -20:26 |
| 424 | 15:21 -16:1 | 452 | 6:6 - 6:26 | 480 | 20:27 -20:41 |
| 425 | 16:2 -16:20 | 453 | 6:27 - 7:10 | 481 | 20:42 -21:16 |
| 426 | 16:21 -17:15 | 454 | 7:11 - 7:29 | 482 | 21:17 -22:7 |
| 427 | 17:16 -18:2 | 455 | 7:30 - 7:50 | 483 | 22:8 -22:26 |
| 428 | 18:3 -18:20 | 456 | 7:51 - 8:19 | 484 | 22:27 -22:46 |
| 429 | 18:21 -19:5 | 457 | 8:20 - 8:36 | 485 | 22:47 -22:53 |
| 430 | 19:6 -19:22 | 458 | 8:37 - 8:53 | 486 | 2 KINGS 1:1 - 1:10 |
| 431 | 19:23 -19:40 | 459 | 8:54 - 9:4 | 487 | 1:11 - 2:8 |
| 432 | 19:41 -20:12 | 460 | 9:5 - 9:24 | 488 | 2:9 - 3:1 |
| 433 | 20:13 -21:5 | 461 | 9:25 -10:15 | 489 | 3:2 - 3:20 |
| 434 | 21:6 -21:22 | 462 | 10:16 -11:6 | 490 | 3:21 - 4:11 |
| 435 | 22:1 -22:17 | 463 | 11:7 -11:26 | 491 | 4:12 - 4:33 |
| 436 | 22:18 -22:37 | 464 | 11:27 -12:2 | 492 | 4:34 - 5:6 |
| 437 | 22:38 -23:3 | 465 | 12:3 -12:20 | 493 | 5:7 - 5:22 |
| 438 | 23:4 -23:19 | 466 | 12:21 -13:4 | 494 | 5:23 - 6:16 |
| 439 | 23:20 -24:7 | 467 | 13:5 -13:24 | 495 | 6:17 - 6:33 |
| 440 | 24:8 -24:22 | 468 | 13:25 -14:7 | 496 | 7:1 - 7:15 |
| 441 | 24:23 -24:25 | 469 | 14:8 -14:25 | 497 | 7:16 - 8:11 |
| 442 | 1 KINGS 1:1 - 1:12 | 470 | 14:26 -15:16 | 498 | 8:12 - 9:1 |
| 443 | 1:13 - 1:33 | 471 | 15:17 -15:34 | 499 | 9:2 - 9:19 |
| 444 | 1:34 - 1:51 | 472 | 16:1 -16:19 | 500 | 9:20 -10:1 |
| 445 | 1:52 - 2:16 | 473 | 16:20 -17:5 | 501 | 10:2 -10:18 |
| 446 | 2:17 - 2:33 | 474 | 17:6 -18:2 | 502 | 10:19 -10:36 |
| 447 | 2:34 - 3:5 | 475 | 18:3 -18:22 | 503 | 11:1 -11:17 |
| 448 | 3:6 -3:25 | 476 | 18:23 -18:40 | 504 | 11:18 -12:13 |

FIG.13F OLD TESTAMENT WORKABLE MODEL

7

| 72 COL.A | 74 COL.B | 72 COL.A | 74 COL.B | 72 COL.A | 74 COL.B |
|---|---|---|---|---|---|
| 505 | 2 KINGS 12:14 -13:10 | 533 | 4:14 - 4:39 | 561 | 24:27 -25:21 |
| 506 | 13:11 -14:3 | 534 | 4:40 - 5:17 | 562 | 25:22 -26:17 |
| 507 | 14:4 -14:22 | 535 | 5:18 - 6:17 | 563 | 26:18 -27:4 |
| 508 | 14:23 -15:13 | 536 | 6:18 - 6:49 | 564 | 27:5 -27:26 |
| 509 | 15:14 -15:32 | 537 | 6:50 - 6:75 | 565 | 27:27 -28:9 |
| 510 | 15:33 -16:13 | 538 | 6:76 - 7:15 | 566 | 28:10 -29:2 |
| 511 | 16:14 -17:11 | 539 | 7:16 - 8:3 | 567 | 29:3 -29:20 |
| 512 | 17:12 -17:27 | 540 | 8:4 - 8:39 | 568 | 29:21 -29:30 |
| 513 | 17:28 -18:6 | 541 | 8:40 - 9:20 | 569 | 2 CHR. 1:1 - 1:12 |
| 514 | 18:7 -18:23 | 542 | 9:21 - 9:44 | 570 | 1:13 - 2:11 |
| 515 | 18:24 -19:3 | 543 | 10:1 -11:5 | 571 | 2:12 - 3:11 |
| 516 | 19:4 -19:22 | 544 | 11:6 -11:25 | 572 | 3:12 - 4:14 |
| 517 | 19:23 -19:32 | 545 | 11:26 -12:11 | 573 | 4:15 - 5:11 |
| 518 | 19:33 -20:13 | 546 | 12:12 -12:32 | 574 | 5:12 - 6:15 |
| 519 | 20:14 -21:10 | 547 | 12:33 -13:12 | 575 | 6:16 - 6:31 |
| 520 | 21:11 -22:4 | 548 | 13:13 -15:5 | 576 | 6:32 - 7:5 |
| 521 | 22:5 -22:20 | 549 | 15:6 -15:26 | 577 | 7:6 - 7:22 |
| 522 | 23:1 -23:13 | 550 | 15:27 -16:18 | 578 | 8:1 - 8:18 |
| 523 | 23:14 -23:29 | 551 | 16:19 -16:37 | 579 | 9:1 - 9:18 |
| 524 | 23:30 -24:11 | 552 | 16:38 -17:14 | 580 | 9:19 -10:8 |
| 525 | 24:12 -25:8 | 553 | 17:15 -18:7 | 581 | 10:9 -11:9 |
| 526 | 25:9 -25:25 | 554 | 18:8 -19:8 | 582 | 11:10 -12:6 |
| 527 | 25:26 -25:30 | 555 | 19:9 -20:5 | 583 | 12:7 -13:8 |
| 528 | 1 CHR. 1:1 - 1:30 | 556 | 20:6 -21:16 | 584 | 13:9 -14:5 |
| 529 | 1:31 - 2:5 | 557 | 21:17 -22:5 | 585 | 14:6 -15:8 |
| 530 | 2:6 - 2:37 | 558 | 22:6 -23:5 | 586 | 15:9 -16:8 |
| 531 | 2:38 - 3:10 | 559 | 23:6 -23:31 | 587 | 16:9 -17:13 |
| 532 | 3:11 - 4:13 | 560 | 23:32 -24:26 | 588 | 17:14 -18:13 |

FIG.13G OLD TESTAMENT WORKABLE MODEL

8

| 72 COL.A | 74 COL.B | 72 COL.A | 74 COL.B | 72 COL.A | 74 COL.B |
|---|---|---|---|---|---|
| 589 | 2 CHR. 18:14 -18:32 | 617 | EZRA 1:1 - 1:11 | 645 | 9:31 -10:28 |
| 590 | 18:33 -20:4 | 618 | 2:1 - 2:39 | 646 | 10:29 -11:4 |
| 591 | 20:5 -20:20 | 619 | 2:40 - 2:66 | 647 | 11:5 -11:27 |
| 592 | 20:21 -20:37 | 620 | 2:67 - 3:10 | 648 | 11:28 -12:25 |
| 593 | 21:1 -21:18 | 621 | 3:11 - 4:12 | 649 | 12:26 -12:44 |
| 594 | 21:19 -22:12 | 622 | 4:13 - 5:5 | 650 | 12:45 -13:14 |
| 595 | 23:1 -23:16 | 623 | 5:6 - 6:4 | 651 | 13:15 -13:31 |
| 596 | 23:17 -24:12 | 624 | 6:5 - 6:19 | 652 | ESTHER 1:1 - 1:14 |
| 597 | 24:13 -24:27 | 625 | 6:20 - 7:15 | 653 | 1:15 - 2:7 |
| 598 | 25:1 -25:15 | 626 | 7:16 - 8:5 | 654 | 2:8 - 2:22 |
| 599 | 25:16 -26:5 | 627 | 8:6 - 8:27 | 655 | 2:23 - 3:13 |
| 600 | 26:6 -26:22 | 628 | 8:28 - 9:6 | 656 | 3:14 - 4:16 |
| 601 | 26:23 -28:8 | 629 | 9:7 -10:5 | 657 | 4:17 - 6:3 |
| 602 | 28:9 -28:25 | 630 | 10:6 -10:24 | 658 | 6:4 - 7:6 |
| 603 | 28:26 -29:17 | 631 | 10:25 -10:44 | 659 | 7:7 - 8:10 |
| 604 | 29:18 -29:33 | 632 | NEH. 1:1 - 1:11 | 660 | 8:11 - 9:11 |
| 605 | 29:34 -30:14 | 633 | 2:1 - 2:16 | 661 | 9:12 - 9:27 |
| 606 | 30:15 -31:2 | 634 | 2:17 - 3:14 | 662 | 9:28 -10:3 |
| 607 | 31:3 -31:18 | 635 | 3:15 - 4:1 | 663 | JOB 1:1 - 1:14 |
| 608 | 31:19 -32:14 | 636 | 4:2 - 4:20 | 664 | 1:15 - 2:11 |
| 609 | 32:15 -32:31 | 637 | 4:21 - 5:15 | 665 | 2:12 - 3:18 |
| 610 | 32:32 -33:15 | 638 | 5:16 - 6:14 | 666 | 3:19 - 4:12 |
| 611 | 33:16 -34:8 | 639 | 6:15 - 7:20 | 667 | 4:13 - 5:11 |
| 612 | 34:9 -34:24 | 640 | 7:21 - 7:58 | 668 | 5:12 - 6:5 |
| 613 | 34:25 -35:6 | 641 | 7:59 - 8:2 | 669 | 6:6 - 6:26 |
| 614 | 35:7 -35:21 | 642 | 8:3 - 8:17 | 670 | 6:27 - 7:15 |
| 615 | 35:22 -36:12 | 643 | 8:18 - 9:16 | 671 | 7:16 - 8:13 |
| 616 | 36:13 -36:23 | 644 | 9:17 - 9:30 | 672 | 8:14 - 9:12 |

FIG.13H OLD TESTAMENT WORKABLE MODEL

| 72 COL.A | 74 COL.B | 72 COL.A | 9 74 COL.B | 72 COL.A | 74 COL.B |
|---|---|---|---|---|---|
| 673 | JOB 9:13 - 9:33 | 701 | 32:6 -33:2 | 729 | 18:40 -19:6 |
| 674 | 9:34 -10:18 | 702 | 33:3 -33:22 | 730 | 19:7 -20:8 |
| 675 | 10:19 -11:17 | 703 | 33:23 -34:9 | 731 | 20:9 -22:3 |
| 676 | 11:18 -12:17 | 704 | 34:10 -34:29 | 732 | 22:4 -22:22 |
| 677 | 12:18 -13:13 | 705 | 34:30 -35:12 | 733 | 22:23 -23:6 |
| 678 | 13:14 -14:7 | 706 | 35:13 -36:17 | 734 | 24:1 -25:7 |
| 679 | 14:8 -15:4 | 707 | 36:18 -37:5 | 735 | 25:8 -26:5 |
| 680 | 15:5 -15:24 | 708 | 37:6 -37:24 | 736 | 26:6 -27:7 |
| 681 | 15:25 -16:8 | 709 | 38:1 -38:21 | 737 | 27:8 -28:7 |
| 682 | 16:9 -17:5 | 710 | 38:22 -39:2 | 738 | 28:8 -30:4 |
| 683 | 17:6 -18:9 | 711 | 39:3 -39:23 | 739 | 30:5 -31:10 |
| 684 | 18:10 -19:10 | 712 | 39:24 -40:8 | 740 | 31:11 -31:24 |
| 685 | 19:11 -20:1 | 713 | 40:9 -41:11 | 741 | 32:1 -33:5 |
| 686 | 20:2 -20:23 | 714 | 41:12 -41:33 | 742 | 33:6 -34:3 |
| 687 | 20:24 -21:14 | 715 | 41:34 -42:17 | 743 | 34:4 -35:1 |
| 688 | 21:15 -21:33 | 716 | PSALMS 1:1 - 2:4 | 744 | 35:2 -35:18 |
| 689 | 21:34 -22:18 | 717 | 2:5 - 3:8 | 745 | 35:19 -36:6 |
| 690 | 22:19 -23:9 | 718 | 4:1 - 5:9 | 746 | 36:7 -37:13 |
| 691 | 23:10 -24:12 | 719 | 5:10 - 7:3 | 747 | 37:14 -37:32 |
| 692 | 24:13 -25:5 | 720 | 7:4 - 8:1 | 748 | 37:33 -38:11 |
| 693 | 25:6 -27:6 | 721 | 8:2 - 9:12 | 749 | 38:12 -39:6 |
| 694 | 27:7 -28:2 | 722 | 9:13 -10:12 | 750 | 39:7 -40:7 |
| 695 | 28:3 -28:24 | 723 | 10:13 -12:4 | 751 | 40:8 -41:3 |
| 696 | 28:25 -29:17 | 724 | 12:5 -14:5 | 752 | 41:4 -42:5 |
| 697 | 29:18 -30:13 | 725 | 14:6 -16:10 | 753 | 42:6 -44:3 |
| 698 | 30:14 -31:4 | 726 | 16:11 -17:15 | 754 | 44:4 -44:25 |
| 699 | 31:5 -31:25 | 727 | 18:1 -18:18 | 755 | 44:26 -45:15 |
| 700 | 31:26 -32:5 | 728 | 18:19 -18:39 | 756 | 45:16 -47:4 |

FIG.13I OLD TESTAMENT WORKABLE MODEL

10

| 72 COL.A | 74 COL.B | 72 COL.A | 74 COL.B | 72 COL.A | 74 COL.B |
|---|---|---|---|---|---|
| 757 | PSALMS 47:5 -48:12 | 785 | 77:17 -78:11 | 813 | 105:9 -105:30 |
| 758 | 48:13 -49:14 | 786 | 78:12 - 78:31 | 814 | 105:31 -106:4 |
| 759 | 49:15 -50:13 | 787 | 78:32 - 78:51 | 815 | 106:5 -106:23 |
| 760 | 50:14 -51:7 | 788 | 78:52 - 78:72 | 816 | 106:24 -106:42 |
| 761 | 51:8 -52:7 | 789 | 79:1 -80:3 | 817 | 106:43 -107:9 |
| 762 | 52:8 -54:4 | 790 | 80:4 -81:5 | 818 | 107:10 -107:30 |
| 763 | 54:5 -55:14 | 791 | 81:6 -82:7 | 819 | 107:31 -108:6 |
| 764 | 55:15 -56:5 | 792 | 82:8 -83:18 | 820 | 108:7 -109:14 |
| 765 | 56:6 -57:7 | 793 | 84:1 -85:2 | 821 | 109:15 -109:31 |
| 766 | 57:8 -59:1 | 794 | 85:3 -86:7 | 822 | 110:1 -111:10 |
| 767 | 59:2 -60:1 | 795 | 86:8 -87:7 | 823 | 112:1 -113:7 |
| 768 | 60:2 -61:8 | 796 | 88:1 -88:18 | 824 | 113:8 -115:6 |
| 769 | 62:1 -63:3 | 797 | 89:1 -89:19 | 825 | 115:7 -116:5 |
| 770 | 63:4 -64:10 | 798 | 89:20 -89:41 | 826 | 116:6 -118:1 |
| 771 | 65:1 -66:3 | 799 | 89:42 -90:7 | 827 | 118:2 -118:22 |
| 772 | 66:4 -67:1 | 800 | 90:8 -91:9 | 828 | 118:23 -119:13 |
| 773 | 67:2 -68:11 | 801 | 91:10 -92:12 | 829 | 119:14 -119:34 |
| 774 | 68:12 -68:29 | 802 | 92:13 -94:9 | 830 | 119:35 -119:55 |
| 775 | 68:30 -69:10 | 803 | 94:10 -95:6 | 831 | 119:56 -119:76 |
| 776 | 69:11 -69:29 | 804 | 95:7 -96:12 | 832 | 119:77 -119:97 |
| 777 | 69:30 -71:4 | 805 | 96:13 -98:2 | 833 | 119:98 -119:118 |
| 778 | 71:5 -71:23 | 806 | 98:3 -99:8 | 834 | 119:119-119:139 |
| 779 | 71:24 -72:16 | 807 | 99:9 -102:1 | 835 | 119:140-119:160 |
| 780 | 72:17 -73:13 | 808 | 102:2 -102:22 | 836 | 119:161-120:3 |
| 781 | 73:14 -74:4 | 809 | 102:23-103:13 | 837 | 120:4 -122:7 |
| 782 | 74:5 -75:1 | 810 | 103:14-104:8 | 838 | 122:8 -125:2 |
| 783 | 75:2 -76:10 | 811 | 104:9 -104:26 | 839 | 125:3 -127:4 |
| 784 | 76:11 -77:16 | 812 | 104:27-105:8 | 840 | 127:5 -129:8 |

FIG.13J OLD TESTAMENT WORKABLE MODEL

11

| 72 COL.A | 74 COL.B | 72 COL.A | 74 COL.B | 72 COL.A | 74 COL.B |
|---|---|---|---|---|---|
| 841 | PSALMS 130:1 -132:5 | 869 | 9:3 -10:3 | 897 | 29:5 -29:26 |
| 842 | 132:6 -133:3 | 870 | 10:4 -10:25 | 898 | 29:27 -30:14 |
| 843 | 134:1 -135:14 | 871 | 10:26-11:14 | 899 | 30:15 -30:31 |
| 844 | 135:15-136:13 | 872 | 11:15-12:3 | 900 | 30:32 -31:17 |
| 845 | 136:14-137:6 | 873 | 12:4 -12:25 | 901 | 31:18 -31:31 |
| 846 | 137:7 -139:5 | 874 | 12:26-13:19 | 902 | ECCLES. 1:1 - 1:18 |
| 847 | 139:6 -139:23 | 875 | 13:20-14:16 | 903 | 2:1 - 2:21 |
| 848 | 139:24-141:3 | 876 | 14:17-15:3 | 904 | 2:22 - 3:18 |
| 849 | 141:4 -142:6 | 877 | 15:4 -15:25 | 905 | 3:19 - 5:3 |
| 850 | 142:7 -144:1 | 878 | 15:26-16:14 | 906 | 5:4 - 6:4 |
| 851 | 144:2 -145:4 | 879 | 16:15-17:3 | 907 | 6:5 - 7:18 |
| 852 | 145:5 -146:2 | 880 | 17:4 -17:25 | 908 | 7:19 - 8:13 |
| 853 | 146:3 -147:7 | 881 | 17:26-18:18 | 909 | 8:14 - 9:13 |
| 854 | 147:8 -148:4 | 882 | 18:19-19:15 | 910 | 9:14 -11:2 |
| 855 | 148:5 -149:7 | 883 | 19:16-20:8 | 911 | 11:3 -12:11 |
| 856 | 149:8 -150:6 | 884 | 20:9 -20:30 | 912 | 12:12 -12:14 |
| 857 | PROV. 1:1 - 1:15 | 885 | 21:1 -21:22 | 913 | SONG 1:1 - 1:8 |
| 858 | 1:16- 2:2 | 886 | 21:23-22:13 | 914 | 1:9 - 2:3 |
| 859 | 2:3 - 3:1 | 887 | 22:14-23:3 | 915 | 2:4 - 2:15 |
| 860 | 3:2 - 3:21 | 888 | 23:4 -23:23 | 916 | 2:16 - 3:9 |
| 861 | 3:22- 4:7 | 889 | 23:24-24:6 | 917 | 3:10 - 4:10 |
| 862 | 4:8 - 5:1 | 890 | 24:7 -24:23 | 918 | 4:11 - 5:5 |
| 863 | 5:2 - 5:20 | 891 | 24:24-25:7 | 919 | 5:6 - 6:1 |
| 864 | 5:21- 6:17 | 892 | 25:8 -25:28 | 920 | 6:2 - 6:13 |
| 865 | 6:18- 7:4 | 893 | 26:1 -26:22 | 921 | 7:1 - 7:13 |
| 866 | 7:5 - 7:24 | 894 | 26:23-27:16 | 922 | 8:1 - 8:9 |
| 867 | 7:25- 8:17 | 895 | 27:17-28:10 | 923 | 8:10 - 8:14 |
| 868 | 8:18- 9:2 | 896 | 28:11-29:4 | 924 | ISAIAH 1:1 -1:7 |

FIG.13K OLD TESTAMENT WORKABLE MODEL

12

| 72 COL.A | 74 COL.B | 72 COL.A | 74 COL.B | 72 COL.A | 74 COL.B |
|---|---|---|---|---|---|
| 925 | ISAIAH 1:8 - 1:18 | 953 | 21:13 -22:11 | 981 | 40:12 -40:22 |
| 926 | 1:19 - 2:1 | 954 | 22:12 -22:25 | 982 | 40:23 -41:3 |
| 927 | 2:2 - 2:12 | 955 | 23:1 -23:17 | 983 | 41:4 -41:16 |
| 928 | 2:13 - 3:7 | 956 | 23:18 -24:13 | 984 | 41:17 -41:28 |
| 929 | 3:8 - 3:25 | 957 | 24:14 -25:2 | 985 | 41:29 -42:11 |
| 930 | 3:26 - 5:5 | 958 | 25:3 -26:3 | 986 | 42:12 -42:24 |
| 931 | 5:6 - 5:18 | 959 | 26:4 -26:19 | 987 | 42:25 -43:9 |
| 932 | 5:19 - 6:4 | 960 | 26:20 -27:11 | 988 | 43:10 -43:22 |
| 933 | 6:5 - 7:3 | 961 | 27:12 -28:9 | 989 | 43:23 -44:7 |
| 934 | 7:4 - 8:1 | 962 | 28:10 -28:21 | 990 | 44:8 -44:21 |
| 935 | 8:2 - 8:18 | 963 | 28:22 -29:6 | 991 | 44:22 -45:2 |
| 936 | 8:19 - 9:7 | 964 | 29:7 -29:17 | 992 | 45:3 -45:13 |
| 937 | 9:8 -10:1 | 965 | 29:18 -30:5 | 993 | 45:14 -45:22 |
| 938 | 10:2 -10:12 | 966 | 30:6 -30:16 | 994 | 45:23 -46:9 |
| 939 | 10:13 -10:25 | 967 | 30:17 -30:31 | 995 | 46:10 -47:8 |
| 940 | 10:26 -11:6 | 968 | 30:32 -31:8 | 996 | 47:9 -48:3 |
| 941 | 11:7 -12:1 | 969 | 31:9 -32:13 | 997 | 48:4 -48:16 |
| 942 | 12:2 -13:9 | 970 | 32:14 -33:9 | 998 | 48:17 -49:5 |
| 943 | 13:10 -14:1 | 971 | 33:10 -33:22 | 999 | 49:6 -49:15 |
| 944 | 14:2 -14:15 | 972 | 33:23 -34:9 | 1000 | 49:16 -49:25 |
| 945 | 14:16 -14:28 | 973 | 34:10 -35:4 | 1001 | 49:26 -50:8 |
| 946 | 14:29 -15:8 | 974 | 35:5 -36:7 | 1002 | 50:9 -51:6 |
| 947 | 15:9 -16:11 | 975 | 36:8 -37:3 | 1003 | 51:7 -51:18 |
| 948 | 16:12 -17:10 | 976 | 37:4 -37:23 | 1004 | 51:19 -52:8 |
| 949 | 17:11 -18:6 | 977 | 37:24 -37:34 | 1005 | 52:9 -53:4 |
| 950 | 18:7 -19:11 | 978 | 37:35 -38:13 | 1006 | 53:5 -54:2 |
| 951 | 19:12 -20:4 | 979 | 38:14 -39:8 | 1007 | 54:3 -54:15 |
| 952 | 20:5 -21:12 | 980 | 40:1 -40:11 | 1008 | 54:16 -55:10 |

FIG.13L OLD TESTAMENT WORKABLE MODEL

| 72 COL.A | | 74 COL.B | 72 COL.A | 13 74 COL.B | 72 COL.A | 74 COL.B |
|---|---|---|---|---|---|---|
| 1009 | ISAIAH | 55:11 -56:7 | 1037 | 4:25 - 5:2 | 1065 | 20:4 -20:14 |
| 1010 | | 56:8 -57:7 | 1038 | 5:3 - 5:11 | 1066 | 20:15 -21:11 |
| 1011 | | 57:8 -57:17 | 1039 | 5:12 - 5:23 | 1067 | 21:12 -22:10 |
| 1012 | | 57:18 -58:6 | 1040 | 5:24 - 6:3 | 1068 | 22:11 -22:23 |
| 1013 | | 58:7 -59:2 | 1041 | 6:4 - 6:13 | 1069 | 22:24 -23:8 |
| 1014 | | 59:3 -59:13 | 1042 | 6:14 - 6:26 | 1070 | 23:9 -23:18 |
| 1015 | | 59:14 -60:3 | 1043 | 6:27 - 7:17 | 1071 | 23:19 -23:38 |
| 1016 | | 60:4 -60:13 | 1044 | 7:18 - 7:34 | 1072 | 23:39 -25:5 |
| 1017 | | 60:14 -60:22 | 1045 | 8:1 - 8:11 | 1073 | 25:6 -25:26 |
| 1018 | | 61:1 -61:10 | 1046 | 8:12 - 8:22 | 1074 | 25:27 -26:1 |
| 1019 | | 61:11 -62:10 | 1047 | 9:1 - 9:11 | 1075 | 26:2 -26:19 |
| 1020 | | 62:11 -63:6 | 1048 | 9:12 - 9:25 | 1076 | 26:20 -27:12 |
| 1021 | | 63:7 -63:17 | 1049 | 9:26 -10:13 | 1077 | 27:13 -28:7 |
| 1022 | | 63:18 -65:1 | 1050 | 10:14 -10:25 | 1078 | 28:8 -29:8 |
| 1023 | | 65:2 -65:12 | 1051 | 11:1 -11:16 | 1079 | 29:9 -29:26 |
| 1024 | | 65:13 -65:24 | 1052 | 11:17 -12:26 | 1080 | 29:27 -30:9 |
| 1025 | | 65:25 -66:8 | 1053 | 12:27 -13:10 | 1081 | 30:10 -30:18 |
| 1026 | | 66:9 -66:18 | 1054 | 13:11 -13:21 | 1082 | 30:19 -31:7 |
| 1027 | | 66:19 -66:24 | 1055 | 13:22 -14:7 | 1083 | 31:8 -31:17 |
| 1028 | | JER. 1:1 - 1:14 | 1056 | 14:8 -14:19 | 1084 | 31:18 -31:29 |
| 1029 | | 1:15 - 2:5 | 1057 | 14:20 -15:8 | 1085 | 31:30 -32:6 |
| 1030 | | 2:6 - 2:17 | 1058 | 15:9 -15:19 | 1086 | 32:7 -32:24 |
| 1031 | | 2:18 - 2:27 | 1059 | 15:20 -16:15 | 1087 | 32:25 -32:43 |
| 1032 | | 2:28 - 3:1 | 1060 | 16:16 -17:7 | 1088 | 32:44 -33:15 |
| 1033 | | 3:2 - 3:15 | 1061 | 17:8 -17:20 | 1089 | 33:16 -34:7 |
| 1034 | | 3:16 - 4:1 | 1062 | 17:21 -18:13 | 1090 | 34:8 -34:21 |
| 1035 | | 4:2 - 4:11 | 1063 | 18:14 -19:3 | 1091 | 35:1 -35:17 |
| 1036 | | 4:12 - 4:24 | 1064 | 19:4 -20:3 | 1092 | 35:18 -36:14 |

FIG.13M OLD TESTAMENT WORKABLE MODEL

14

| 72 COL.A | 74 COL.B | 72 COL.A | 74 COL.B | 72 COL.A | 74 COL.B |
|---|---|---|---|---|---|
| 1093 | JER. 36:14 -36:31 | 1121 | 51:28 -51:39 | 1149 | 10:1 -10:18 |
| 1094 | 36:32 -37:17 | 1122 | 51:40 -51:52 | 1150 | 10:19 -11:6 |
| 1095 | 37:17 -38:12 | 1123 | 51:53 -52:1 | 1151 | 11:7 -12:12 |
| 1096 | 38:13 -39:1 | 1124 | 52:2 -52:19 | 1152 | 12:13 -13:7 |
| 1097 | 39:2 -39:18 | 1125 | 52:20 -52:34 | 1153 | 13:8 -13:23 |
| 1098 | 40:1 -40:13 | 1126 | LAM. 1:1 - 1:6 | 1154 | 14:1 -14:19 |
| 1099 | 40:14 -41:11 | 1127 | 1:7 - 1:13 | 1155 | 14:20 -16:3 |
| 1100 | 41:12 -42:11 | 1128 | 1:14 - 1:20 | 1156 | 16:4 -16:22 |
| 1101 | 42:12 -43:5 | 1129 | 1:21 - 2:5 | 1157 | 16:23 -16:41 |
| 1102 | 43:6 -44:8 | 1130 | 2:6 - 2:12 | 1158 | 16:42 -16:59 |
| 1103 | 44:9 -44:23 | 1131 | 2:13 - 2:19 | 1159 | 16:60 -17:8 |
| 1104 | 44:24 -46:3 | 1132 | 2:20 - 3:12 | 1160 | 17:9 -17:22 |
| 1105 | 46:4 -46:13 | 1133 | 3:13 - 3:33 | 1161 | 17:23 -18:16 |
| 1106 | 46:14 -46:26 | 1134 | 3:34 - 3:55 | 1162 | 18:17 -19:2 |
| 1107 | 46:27 -48:1 | 1135 | 3:56 - 4:5 | 1163 | 19:3 -19:13 |
| 1108 | 48:2 -48:13 | 1136 | 4:6 - 4:16 | 1164 | 19:14 -20:17 |
| 1109 | 48:14 -48:29 | 1137 | 4:17 - 5:8 | 1165 | 20:18 -20:36 |
| 1110 | 48:30 -48:44 | 1138 | 5:9 - 5:22 | 1166 | 20:37 -21:6 |
| 1111 | 48:45 -49:7 | 1139 | EZEK. 1:1 - 1:15 | 1167 | 21:7 -21:22 |
| 1112 | 49:8 -49:18 | 1140 | 1:16 - 2:5 | 1168 | 21:23 -22:6 |
| 1113 | 49:19 -49:29 | 1141 | 2:6 - 3:6 | 1169 | 22:7 -22:27 |
| 1114 | 49:30 -50:1 | 1142 | 3:7 - 3:26 | 1170 | 22:28 -23:16 |
| 1115 | 50:2 -50:13 | 1143 | 3:27 - 4:17 | 1171 | 23:17 - 23:33 |
| 1116 | 50:14 -50:24 | 1144 | 5:1 - 5:16 | 1172 | 23:34 - 24:3 |
| 1117 | 50:25 -50:36 | 1145 | 5:17 - 7:3 | 1173 | 24:4 - 24:16 |
| 1118 | 50:37 -51:3 | 1146 | 7:4 - 7:23 | 1174 | 24:17 - 25:8 |
| 1119 | 51:4 -51:15 | 1147 | 7:24 - 8:13 | 1175 | 25:9 - 26:6 |
| 1120 | 51:16 -51:27 | 1148 | 8:14 -9:11 | 1176 | 26:7 - 26:17 |

FIG.13N OLD TESTAMENT WORKABLE MODEL

15

| 72 COL.A | 74 COL.B | 72 COL.A | 74 COL.B | 72 COL.A | 74 COL.B |
|---|---|---|---|---|---|
| 1177 | EZEK. 26:18 -27:10 | 1205 | 43:19 -44:9 | 1233 | 11:10 -11:26 |
| 1178 | 27:11 -27:29 | 1206 | 44:10 -44:27 | 1234 | 11:27 -11:44 |
| 1179 | 27:30 -28:6 | 1207 | 44:28 -45:13 | 1235 | 11:45 -12:13 |
| 1180 | 28:7 -28:17 | 1208 | 45:14 -46:6 | 1236 | HOSEA 1:1 - 1:9 |
| 1181 | 28:18 -29:3 | 1209 | 46:7 -46:22 | 1237 | 1:10 - 2:10 |
| 1182 | 29:4 -29:18 | 1210 | 46:23 -47:15 | 1238 | 2:11 - 3:2 |
| 1183 | 29:19 -30:11 | 1211 | 47:16 -48:11 | 1239 | 3:3 - 4:8 |
| 1184 | 30:12 -31:1 | 1212 | 48:12 -48:29 | 1240 | 4:9 - 5:2 |
| 1185 | 31:2 -31:15 | 1213 | 48:30 -48:35 | 1241 | 5:3 - 6:1 |
| 1186 | 31:16 -32:15 | 1214 | DANIEL 1:1 - 1:14 | 1242 | 6:2 - 7:4 |
| 1187 | 32:16 -32:31 | 1215 | 1:15 - 2:12 | 1243 | 7:5 - 8:1 |
| 1188 | 32:32 -33:17 | 1216 | 2:13 - 2:29 | 1244 | 8:2 - 8:14 |
| 1189 | 33:18 -34:3 | 1217 | 2:30 - 2:47 | 1245 | 9:1 - 9:11 |
| 1190 | 34:4 -34:22 | 1218 | 2:48 - 3:14 | 1246 | 9:12 - 10:7 |
| 1191 | 34:23 -35:9 | 1219 | 3:15 - 3:29 | 1247 | 10:8 - 11:3 |
| 1192 | 35:10 -36:11 | 1220 | 3:30 - 4:14 | 1248 | 11:4 - 12:3 |
| 1193 | 36:12 -36:31 | 1221 | 4:15 - 4:29 | 1249 | 12:4 - 13:1 |
| 1194 | 36:32 -37:13 | 1222 | 4:30 - 5:5 | 1250 | 13:2 - 13:14 |
| 1195 | 37:14 -38:3 | 1223 | 5:6 - 5:20 | 1251 | 13:15 - 14:9 |
| 1196 | 38:4 -38:20 | 1224 | 5:21 - 6:7 | 1252 | JOEL 1:1 - 1:10 |
| 1197 | 38:21 -39:16 | 1225 | 6:8 - 6:23 | 1253 | 1:11 - 2:1 |
| 1198 | 39:17 -40:4 | 1226 | 6:24 - 7:9 | 1254 | 2:2 - 2:13 |
| 1199 | 40:5 -40:23 | 1227 | 7:10 - 7:27 | 1255 | 2:14 - 2:22 |
| 1200 | 40:24 -40:42 | 1228 | 7:28 - 8:16 | 1256 | 2:23 - 3:2 |
| 1201 | 40:43 -41:10 | 1229 | 8:17 - 9:6 | 1257 | 3:3 - 3:16 |
| 1202 | 41:11 -42:3 | 1230 | 9:7 - 9:23 | 1258 | 3:17 - 3:21 |
| 1303 | 42:4 -43:2 | 1231 | 9:24 -10:12 | 1259 | AMOS 1:1 - 1:7 |
| 1204 | 43:3 -43:18 | 1232 | 10:13-11:9 | 1260 | 1:8 - 2:2 |

FIG.13O OLD TESTAMENT WORKABLE MODEL

16

| 72 COL.A | 74 COL.B | 72 COL.A | 74 COL.B | 72 COL.A | 74 COL.B |
|---|---|---|---|---|---|
| 1261 | AMOS 2:3 - 2:13 | 1289 | 2:3 - 3:2 | 1317 | 14:12 -14:21 |
| 1262 | 2:14 - 3:10 | 1290 | 3:3 - 3:16 | 1318 | MALACHI 1:1 - 1:13 |
| 1263 | 3:11 - 4:5 | 1291 | 3:17 - 3:19 | 1319 | 1:14 - 2:17 |
| 1264 | 4:6 - 5:1 | 1292 | HAB. 1:1 - 1:8 | 1320 | 3:1 - 3:18 |
| 1265 | 5:2 - 5:14 | 1293 | 1:9 - 2:4 | 1321 | 4:1 - 4:6 |
| 1266 | 5:15 - 6:1 | 1294 | 2:5 - 2:16 | | |
| 1267 | 6:2 - 6:13 | 1295 | 2:17 - 3:8 | | |
| 1268 | 6:14 - 8:2 | 1296 | 3:9 - 3:19 | | |
| 1269 | 8:3 - 8:14 | 1297 | ZEPH. 1:1 - 1:9 | | |
| 1270 | 9:1 - 9:8 | 1298 | 1:10 - 2:2 | | |
| 1271 | 9:9 - 9:15 | 1299 | 2:3 - 2:13 | | |
| 1272 | OBADIAH 1:1 - 1:7 | 1300 | 2:14 - 3:10 | | |
| 1273 | 1:8 - 1:21 | 1301 | 3:11 - 3:20 | | |
| 1274 | JONAH 1:1 - 1:16 | 1302 | HAGGAI 1:1 - 1:15 | | |
| 1275 | 1:17 - 4:1 | 1303 | 2:1 - 2:21 | | |
| 1276 | 4:2 - 4:11 | 1304 | 2:22 - 2:23 | | |
| 1277 | MICAH 1:1 - 1:8 | 1305 | ZECH. 1:1 - 1:14 | | |
| 1278 | 1:9 - 2:3 | 1306 | 1:15 - 3:3 | | |
| 1279 | 2:4 - 3:3 | 1307 | 3:4 - 4:14 | | |
| 1280 | 3:4 - 4:1 | 1308 | 5:1 - 6:9 | | |
| 1281 | 4:2 - 4:10 | 1309 | 6:10 - 7:13 | | |
| 1282 | 4:11 - 5:7 | 1310 | 7:14 - 8:18 | | |
| 1283 | 5:8 - 6:5 | 1311 | 8:19 - 9:8 | | |
| 1284 | 6:6 - 7:1 | 1312 | 9:9 - 10:1 | | |
| 1285 | 7:2 - 7:15 | 1313 | 10:2 - 10:12 | | |
| 1286 | 7:16 - 7:20 | 1314 | 11:1 - 12:1 | | |
| 1287 | NAHUM 1:1 - 1:10 | 1315 | 12:2 - 13:4 | | |
| 1288 | 1:11 - 2:2 | 1316 | 13:5 - 14:11 | | |

FIG.13P OLD TESTAMENT WORKABLE MODEL

NEW TESTAMENT

| 72 COL.A | 74 COL.B | 72 COL.A | 74 COL.B | 72 COL.A | 74 COL.B |
|---|---|---|---|---|---|
| 2001 | MATTHEW 1:1 - 1:19 | 2029 | 19:29 -20:22 | 2057 | 7:17 -8:5 |
| 2002 | 1:20 - 2:15 | 2030 | 20:23 -21:14 | 2058 | 8:6 - 8:32 |
| 2003 | 2:16 - 3:15 | 2031 | 21:15 -21:35 | 2059 | 8:33 - 9:17 |
| 2004 | 3:16 - 4:22 | 2032 | 21:36 -22:15 | 2060 | 9:18 - 9:41 |
| 2005 | 4:23 - 5:16 | 2033 | 22:16 -22:46 | 2061 | 9:42 -10:18 |
| 2006 | 5:17 - 5:38 | 2034 | 23:1 -23:26 | 2062 | 10:19 -10:40 |
| 2007 | 5:39 - 6:13 | 2035 | 23:27 -24:11 | 2063 | 10:41 -11:12 |
| 2008 | 6:14 - 7:3 | 2036 | 24:12 -24:39 | 2064 | 11:13 -12:1 |
| 2009 | 7:4 - 7:16 | 2037 | 24:40 -25:18 | 2065 | 12:2 -12:26 |
| 2010 | 7:17 - 8:12 | 2038 | 25:19 -25:42 | 2066 | 12:27 -13:5 |
| 2011 | 8:13 - 9:3 | 2039 | 25:43 -26:24 | 2067 | 13:6 -13:30 |
| 2012 | 9:4 - 9:27 | 2040 | 26:25 -26:49 | 2068 | 13:31 -14:15 |
| 2013 | 9:28 -10:15 | 2041 | 26:50 -26:74 | 2069 | 14:16 -14:42 |
| 2014 | 10:16 -10:41 | 2042 | 26:75 -27:24 | 2070 | 14:43 -14:69 |
| 2015 | 10:42 -11:21 | 2043 | 27:25 -27:52 | 2071 | 14:70 -15:24 |
| 2016 | 11:22 -12:17 | 2044 | 27:53 -28:10 | 2072 | 15:25 -16:2 |
| 2017 | 12:18 -12:37 | 2045 | 28:11 - 28 20 | 2073 | 16:3 -16:20 |
| 2018 | 12:38 -13:11 | 2046 | MARK 1:1 - 1:14 | 2074 | LUKE 1:1 - 1:16 |
| 2019 | 13:12 -13:32 | 2047 | 1:15 - 1:40 | 2075 | 1:17 - 1:41 |
| 2020 | 13:33 -13:56 | 2048 | 1:41 - 2:17 | 2076 | 1:42 - 1:66 |
| 2021 | 13:57 -14:24 | 2049 | 2:18 - 3:12 | 2077 | 1:67 - 2:9 |
| 2022 | 14:25 -15:15 | 2050 | 3:13 - 4:7 | 2078 | 2:10 - 2:36 |
| 2023 | 15:16 -16:1 | 2051 | 4:8 - 4:33 | 2079 | 2:37 - 3:7 |
| 2024 | 16:2 -16:25 | 2052 | 4:34 - 5:18 | 2080 | 3:8 - 3:29 |
| 2025 | 16:26 -17:22 | 2053 | 5:19 - 5:43 | 2081 | 3:30 - 4:15 |
| 2026 | 17:23 -18:16 | 2054 | 6:1 - 6:23 | 2082 | 4:16 - 4:38 |
| 2027 | 18:17 -19:5 | 2055 | 6:24 - 6:48 | 2083 | 4:39 - 5:16 |
| 2028 | 19:6 -19:28 | 2056 | 6:49 - 7:16 | 2084 | 5:17 - 5:39 |

FIG.14A NEW TESTAMENT WORKABLE MODEL

| 72 COL.A | 74 COL.B | 72 COL.A | 2 74 COL.B | 72 COL.A | 74 COL.B |
|---|---|---|---|---|---|
| 2085 | LUKE 6:1 - 6:22 | 2113 | 20:37 -21:19 | 2141 | 11:31 -11:54 |
| 2086 | 6:23 - 6:46 | 2114 | 21:20 -22:5 | 2142 | 11:55 -12:22 |
| 2087 | 6:47 - 7:19 | 2115 | 22:6 -22:34 | 2143 | 12:23 -12:48 |
| 2088 | 7:20 - 7:41 | 2116 | 22:35 -22:60 | 2144 | 12:49 -13:24 |
| 2089 | 7:42 - 8:15 | 2117 | 22:61 -23:17 | 2145 | 13:25 -14:12 |
| 2090 | 8:16 - 8:36 | 2118 | 23:18 -23:45 | 2146 | 14:13 -15:7 |
| 2091 | 8:37 - 9:4 | 2119 | 23:46 -24:17 | 2147 | 15:8 -16:6 |
| 2092 | 9:5 - 9:27 | 2120 | 24:18 -24:43 | 2148 | 16:7 -16:30 |
| 2093 | 9:28 - 9:50 | 2121 | 24:44 -24:53 | 2149 | 16:31 -17:22 |
| 2094 | 9:51 -10:13 | 2122 | JOHN 1:1 - 1:22 | 2150 | 17:23 -18:24 |
| 2095 | 10:14 -10:37 | 2123 | 1:23 - 1:49 | 2151 | 18:25 -19:3 |
| 2096 | 10:38 -11:27 | 2124 | 1:50 - 2:23 | 2152 | 19:4 -19:25 |
| 2097 | 11:28 -11:41 | 2125 | 2:24 - 3:24 | 2153 | 19:26 -20:7 |
| 2098 | 11:42 -12:9 | 2126 | 3:25 - 4:14 | 2154 | 20:8 -20:30 |
| 2099 | 12:10 -12:35 | 2127 | 4:15 - 4:44 | 2155 | 20:31 -21:19 |
| 2100 | 12:36 -12:57 | 2128 | 4:45 - 5:15 | 2156 | 21:20 -21:25 |
| 2101 | 12:58 -13:21 | 2129 | 5:16 - 5:42 | 2157 | ACTS 1:1 - 1:17 |
| 2102 | 13:22 -14:9 | 2130 | 5:43 - 6:21 | 2158 | 1:18 - 2:16 |
| 2103 | 14:10 -14:34 | 2131 | 6:22 - 6:46 | 2159 | 2:17 - 2:38 |
| 2104 | 14:35 -15:25 | 2132 | 6:47 - 7:3 | 2160 | 2:39 - 3:15 |
| 2105 | 15:26 -16:9 | 2133 | 7:4 - 7:31 | 2161 | 3:16 - 4:12 |
| 2106 | 16:10 -17:7 | 2134 | 7:32 - 8:8 | 2162 | 4:13 - 4:34 |
| 2107 | 17:8 -17:34 | 2135 | 8:9 - 8:34 | 2163 | 4:35 - 5:20 |
| 2108 | 17:35 -18:23 | 2136 | 8:35 - 8:59 | 2164 | 5:21 - 5:42 |
| 2109 | 18:24 -19:7 | 2137 | 9:1 - 9:26 | 2165 | 6:1 - 7:6 |
| 2110 | 19:8 -19:31 | 2138 | 9:27 -10:12 | 2166 | 7:7 - 7:31 |
| 2111 | 19:32 -20:10 | 2139 | 10:13 -10:41 | 2167 | 7:32 - 7:53 |
| 2112 | 20:11 -20:36 | 2140 | 10:42 -11:30 | 2168 | 7:54 - 8:18 |

FIG.14B NEW TESTAMENT WORKABLE MODEL

| 72 COL.A | 74 COL.B | 72 COL.A | 3 74 COL.B | 72 COL.A | 74 COL.B |
|---|---|---|---|---|---|
| 2169 | ACTS 8:19 - 9:2 | 2197 | 25:17 -26:9 | 2225 | 2:11 - 3:19 |
| 2170 | 9:3 - 9:26 | 2198 | 26:10 -26:31 | 2226 | 3:20 - 4:19 |
| 2171 | 9:27 -10:6 | 2199 | 26:32 -27:22 | 2227 | 4:20 - 6:8 |
| 2172 | 10:7 -10:31 | 2200 | 27:23 -28:2 | 2228 | 6:9 - 7:19 |
| 2173 | 10:32 -11:7 | 2201 | 28:3 -28:22 | 2229 | 7:20 - 7:32 |
| 2174 | 11:8 -11:30 | 2202 | 28:23 -28:31 | 2230 | 7:33 - 8:12 |
| 2175 | 12:1 -12:20 | 2203 | ROMANS 1:1 - 1:15 | 2231 | 8:13 - 9:23 |
| 2176 | 12:21 -13:16 | 2204 | 1:16 - 2:3 | 2232 | 9:24 -10:23 |
| 2177 | 13:17 -13:40 | 2205 | 2:4 - 2:29 | 2233 | 10:24 -11:19 |
| 2178 | 13:41 -14:11 | 2206 | 3:1 - 3:24 | 2234 | 11:20 -12:9 |
| 2179 | 14:12 -15:3 | 2207 | 3:25 - 4:15 | 2235 | 12:10 - 13:4 |
| 2180 | 15:4 -15:26 | 2208 | 4:16 - 5:13 | 2236 | 13:5 -14:16 |
| 2181 | 15:27 -16:10 | 2209 | 5:14 - 6:13 | 2237 | 14:17 -14:40 |
| 2182 | 16:11 -16:32 | 2210 | 6:14 - 7:11 | 2238 | 15:1 -15:28 |
| 2183 | 16:33 -17:13 | 2211 | 7:12 - 8:10 | 2239 | 15:29 -15:56 |
| 2184 | 17:14 -17:34 | 2212 | 8:11 - 8:33 | 2240 | 15:57 -16:22 |
| 2185 | 18:1 -18:23 | 2213 | 8:34 - 9:18 | 2241 | 16:23 -16:24 |
| 2186 | 18:24 -19:17 | 2214 | 9:19 -10:9 | 2242 | 2 COR. 1:1 - 1:11 |
| 2187 | 19:18 -19:36 | 2215 | 10:10 -11:09 | 2243 | 1:12 - 2:9 |
| 2188 | 19:37 -20:17 | 2216 | 11:10 -11:31 | 2244 | 2:10 - 3:13 |
| 2189 | 20:18 -21:2 | 2217 | 11:32 -12:19 | 2245 | 3:14 - 4:16 |
| 2190 | 21:3 -21:24 | 2218 | 12:20 -14:5 | 2246 | 4:17 - 5:20 |
| 2191 | 21:25 -22:2 | 2219 | 14:6 -15:6 | 2247 | 5:21 - 7:1 |
| 2192 | 22:3 -22:24 | 2220 | 15:7 -15:29 | 2248 | 7:2 - 8:3 |
| 2193 | 22:25 -23:14 | 2221 | 15:30 -16:22 | 2249 | 8:4 - 9:2 |
| 2194 | 23:15 -23:35 | 2222 | 16:23 -16:27 | 2250 | 9:3 -10:6 |
| 2195 | 24:1 -24:23 | 2223 | 1 COR. 1:1 - 1:16 | 2251 | 10:7 -11:9 |
| 2196 | 24:24 -25:16 | 2224 | 1:17 - 2:10 | 2252 | 11:10 -12:3 |

FIG.14C NEW TESTAMENT WORKABLE MODEL

| 72 COL.A | 74 COL.B | 72 COL.A | 4 74 COL.B | 72 COL.A | 74 COL.B |
|---|---|---|---|---|---|
| 2253 | 2 COR. 12:4 -12:21 | 2281 | 3:6 - 4:16 | 2309 | 9:25 -10:21 |
| 2254 | 13:1 -13:14 | 2282 | 4:17 - 4:28 | 2310 | 10:22 -11:5 |
| 2255 | GAL. 1:1 - 1:13 | 2283 | 2 THESS. 1:1 - 1:12 | 2311 | 11:6 -11:27 |
| 2256 | 1:14 - 2:12 | 2284 | 2:1 - 3:6 | 2312 | 11:28 -12:9 |
| 2257 | 2:13 - 3:13 | 2285 | 3:7 - 3:18 | 2313 | 12:10 -13:3 |
| 2258 | 3:14 - 4:8 | 2286 | 1 TIM. 1:1 - 1:14 | 2314 | 13:4 -13:25 |
| 2259 | 4:9 - 5:2 | 2287 | 1:15 - 3:3 | 2315 | JAMES 1:1 - 1:18 |
| 2260 | 5:3 - 6:2 | 2288 | 3:4 - 4:9 | 2316 | 1:19 - 2:13 |
| 2261 | 6:3 - 6:18 | 2289 | 4:10 - 5:15 | 2317 | 2:14 - 3:11 |
| 2262 | EPH. 1:1 - 1:16 | 2290 | 5:16 - 6:10 | 2318 | 3:12 - 5:1 |
| 2263 | 1:17 - 2:15 | 2291 | 6:11 - 6:21 | 2319 | 5:2 - 5:20 |
| 2264 | 2:16 - 3:20 | 2292 | 2 TIM. 1:1 - 1:12 | 2320 | 1 PETER 1:1 - 1:12 |
| 2265 | 3:21 - 4:25 | 2293 | 1:13 - 2:18 | 2321 | 1:13 - 2:8 |
| 2266 | 4:26 - 5:22 | 2294 | 2:19 - 3:15 | 2322 | 2:9 - 3:5 |
| 2267 | 5:23 - 6:16 | 2295 | 3:16 - 4:22 | 2323 | 3:6 - 4:2 |
| 2268 | 6:17 - 6:24 | 2296 | TITUS 1:1 - 1:14 | 2324 | 4:3 - 5:4 |
| 2269 | PHILLIP 1:1 - 1:16 | 2297 | 1:15 - 3:7 | 2325 | 5:5 - 5:14 |
| 2270 | 1:17 - 2:11 | 2298 | 3:8 - 3:15 | 2326 | 2 PETER 1:1 - 1:15 |
| 2271 | 2:12 - 3:7 | 2299 | PHILEM. 1:1 - 1:19 | 2327 | 1:16 - 2:13 |
| 2272 | 3:8 - 4:7 | 2300 | 1:20 - 1:25 | 2328 | 2:14 - 3:10 |
| 2273 | 4:8 - 4:23 | 2301 | HEBREWS 1:1 - 1:11 | 2329 | 3:11 - 3:18 |
| 2274 | COL. 1:1 - 1:19 | 2302 | 1:12 - 2:17 | 2330 | 1 JOHN 1:1 - 2:6 |
| 2275 | 1:20 - 2:11 | 2303 | 2:18 - 4:2 | 2331 | 2:7 - 2:24 |
| 2276 | 2:12 - 3:12 | 2304 | 4:3 - 5:9 | 2332 | 2:25 - 3:20 |
| 2277 | 3:13 - 4:12 | 2305 | 5:10 - 6:20 | 2333 | 3:21 - 4:20 |
| 2278 | 4:13 - 4:18 | 2306 | 7:1 - 7:24 | 2334 | 4:21 - 5:21 |
| 2279 | 1 THESS. 1:1 - 2:3 | 2307 | 7:25 - 9:3 | 2335 | 2 JOHN 1:1 - 1:13 |
| 2280 | 2:4 - 3:5 | 2308 | 9:4 - 9:24 | 2336 | 3 JOHN 1:1 - 1:14 |

FIG.14D NEW TESTAMENT WORKABLE MODEL

5

| 72 COL.A | 74 COL.B |
|---|---|
| 2337 | JUDE 1:1 - 1:10 |
| 2338 | 1:11 - 1:25 |
| 2339 | REV. 1:1 - 1:10 |
| 2340 | 1:11 - 2:9 |
| 2341 | 2:10 - 2:29 |
| 2342 | 3:1 - 3:20 |
| 2343 | 3:21 - 5:5 |
| 2344 | 5:6 - 6:7 |
| 2345 | 6:8 - 7:8 |
| 2346 | 7:9 - 8:8 |
| 2347 | 8:9 - 9:14 |
| 2348 | 9:15 -10:11 |
| 2349 | 11:1 -11:18 |
| 2350 | 11:19 -13:1 |
| 2351 | 13:2 -14:3 |
| 2352 | 14:4 -15:1 |
| 2353 | 15:2 -16:12 |
| 2354 | 16:13 -17:10 |
| 2355 | 17:11 -18:12 |
| 2356 | 18:13 -19:5 |
| 2357 | 19:6 -20:3 |
| 2358 | 20:4 -21:7 |
| 2359 | 21:8 -21:27 |
| 2360 | 22:1 -22:21 |

FIG.14E NEW TESTAMENT WORKABLE MODEL

APOCRYPHA

| 72 COL.A | 74 COL.B | 72 COL.A | 74 COL.B | 72 COL.A | 74 COL.B |
|---|---|---|---|---|---|
| 3001 | 1 ESDRAS 1:1 - 1:15 | 3029 | 2:20 - 2:41 | 3057 | 10:23 -10:40 |
| 3002 | 1:16 - 1:32 | 3030 | 2:42 - 3:11 | 3058 | 10:41 -10:59 |
| 3003 | 1:33 - 1:50 | 3031 | 3:12 - 3:31 | 3059 | 11:1 -11:25 |
| 3004 | 1:51 - 2:9 | 3032 | 3:32 - 4:12 | 3060 | 11:26 -11:46 |
| 3005 | 2:10 - 2:26 | 3033 | 4:13 - 4:32 | 3061 | 12:1 -12:22 |
| 3006 | 2:27 - 3:16 | 3034 | 4:33 - 4:52 | 3062 | 12:23 -12:43 |
| 3007 | 3:17 - 4:15 | 3035 | 5:1 - 5:20 | 3063 | 12:44 -13:11 |
| 3008 | 4:16 - 4:38 | 3036 | 5:21 - 5:37 | 3064 | 13:12 -13:34 |
| 3009 | 4:39 - 4:52 | 3037 | 5:38 - 5:55 | 3065 | 13:35 -13:56 |
| 3010 | 4:53 - 5:8 | 3038 | 5:56 - 6:16 | 3066 | 13:57 -14:21 |
| 3011 | 5:9 - 5:21 | 3039 | 6:17 - 6:34 | 3067 | 14:22 -14:41 |
| 3012 | 5:22 - 5:37 | 3040 | 6:35 - 6:52 | 3068 | 14:42 -15:16 |
| 3013 | 5:38 - 5:53 | 3041 | 6:53 - 7:13 | 3069 | 15:17 -15:33 |
| 3014 | 5:54 - 5:68 | 3042 | 7:14 - 7:32 | 3070 | 15:34 -15:53 |
| 3015 | 5:69 - 6:12 | 3043 | 7:33 - 7:34 | 3071 | 15:54 -16:15 |
| 3016 | 6:13 - 6:26 | 3044 | 7:35 - 7:35 | 3072 | 16:16 -16:37 |
| 3017 | 6:27 - 7:9 | 3045 | 7:35 - 7:35 | 3073 | 16:38 -16:56 |
| 3018 | 7:10 - 8:12 | 3046 | 7:35 - 7:35 | 3074 | 16:57 -16:58 |
| 3019 | 8:13 - 8:28 | 3047 | 7:35 - 7:35 | 3075 | TOBIT 1:1 - 1:17 |
| 3020 | 8:29 - 8:53 | 3048 | 7:35 - 7:35 | 3076 | 1:18 - 2:10 |
| 3021 | 8:54 - 8:70 | 3049 | 7:36 - 7:61 | 3077 | 2:11 - 3:11 |
| 3022 | 8:71 - 8:90 | 3050 | 7:62 - 8:8 | 3078 | 3:12 - 4:11 |
| 3023 | 8:91 - 9:13 | 3051 | 8:9 - 8:30 | 3079 | 4:12 - 5:6 |
| 3024 | 9:14 - 9:36 | 3052 | 8:31 - 8:50 | 3080 | 5:7 - 5:21 |
| 3025 | 9:37 - 9:55 | 3053 | 8:51 - 9:9 | 3081 | 6:1 - 6:15 |
| 3026 | 2 ESDRAS 1:1 - 1:20 | 3054 | 9:10 - 9:30 | 3082 | 6:16 - 7:15 |
| 3027 | 1:21 - 1:40 | 3055 | 9:31 -10:4 | 3083 | 7:16 - 8:16 |
| 3028 | 2:1 - 2:19 | 3056 | 10:5 -10:22 | 3084 | 8:17 -10:9 |

FIG.15A APOCRYPHA WORKABLE MODEL

| 72 COL.A | 74 COL.B | 72 COL.A | 2 74 COL.B | 72 COL.A | 74 COL.B |
|---|---|---|---|---|---|
| 3085 | TOBIT 10:10 -11:15 | 3113 | ESTHER 11:2 -12:6 | 3141 | 14:7 -14:20 |
| 3086 | 11:16 -12:15 | 3114 | 13:1 -13:7 | 3142 | 14:21 -15:2 |
| 3087 | 12:16 -13:6 | 3115 | 13:8 -14:7 | 3143 | 15:3 -15:14 |
| 3088 | 13:7 -14:3 | 3116 | 14:8 -15:6 | 3144 | 15:15 -16:6 |
| 3089 | 14:4 -14:15 | 3117 | 15:7 -16:7 | 3145 | 16:7 -16:19 |
| 3090 | JUDITH 1:1 - 1:14 | 3118 | 16:8 - 9:23 | 3146 | 16:20 -17:2 |
| 3091 | 1:15 - 2:13 | 3119 | 9:24 -11:1 | 3147 | 17:3 -17:16 |
| 3092 | 2:14 - 3:4 | 3120 | SOLOMON 1:1 - 1:15 | 3148 | 17:17 -18:15 |
| 3093 | 3:5 - 4:10 | 3121 | 1:16 - 2:11 | 3149 | 18:16 -18:19 |
| 3094 | 4:11 - 5:10 | 3122 | 2:12 - 3:3 | 3150 | 18:20 -19:3 |
| 3095 | 5:11 - 6:2 | 3123 | 3:4 - 3:19 | 3151 | 19:4 -19:14 |
| 3096 | 6:3 - 6:18 | 3124 | 4:1 - 4:15 | 3152 | 19:15 -19:22 |
| 3097 | 6:19 - 7:13 | 3125 | 4:16 - 5:7 | 3153 | SIRACH 1:1 - 1:19 |
| 3098 | 7:14 - 7:28 | 3126 | 5:8 - 5:20 | 3154 | 1:20 - 2:8 |
| 3099 | 7:29 - 8:11 | 3127 | 5:21 - 6:14 | 3155 | 2:9 - 3:7 |
| 3100 | 8:12 - 8:27 | 3128 | 6:15 - 7:6 | 3156 | 3:8 - 3:26 |
| 3101 | 8:28 - 9:6 | 3129 | 7:7 - 7:22 | 3157 | 3:27 - 4:12 |
| 3102 | 9:7 -10:5 | 3130 | 7:23 - 8:5 | 3158 | 4:13 - 4:29 |
| 3103 | 10:6 -10:19 | 3131 | 8:6 - 8:18 | 3159 | 4:30 - 5:15 |
| 3104 | 10:20 -11:11 | 3132 | 8:19 - 9:12 | 3160 | 6:1 - 6:17 |
| 3105 | 11:12 -12:2 | 3133 | 9:13 -10:7 | 3161 | 6:18 - 6:37 |
| 3106 | 12:3 -12:19 | 3134 | 10:8 -10:21 | 3162 | 7:1 - 7:18 |
| 3107 | 12:20 -13:14 | 3135 | 11:1 -11:16 | 3163 | 7:19 - 7:36 |
| 3108 | 13:15 -14:7 | 3136 | 11:17 -12:2 | 3164 | 8:1 - 8:16 |
| 3109 | 14:8 -15:4 | 3137 | 12:3 -12:15 | 3165 | 8:17 - 9:11 |
| 3110 | 15:5 -16:2 | 3138 | 12:16 -12:27 | 3166 | 9:12 -10:9 |
| 3111 | 16:3 -16:13 | 3139 | 13:1 -13:12 | 3167 | 10:10 -10:26 |
| 3112 | 16:14 -16:25 | 3140 | 13:13 -14:6 | 3168 | 10:27 -11:9 |

FIG.15B APOCRYPHA WORKABLE MODEL

| 72 COL.A | 74 COL.B | 72 COL.A | 3 74 COL.B | 72 COL.A | 74 COL.B |
|---|---|---|---|---|---|
| 3169 | SIRACH 11:10 -11:26 | 3197 | 28:9 -28:25 | 3225 | 43:17 -43:33 |
| 3170 | 11:27 -12:8 | 3198 | 28:26 -29:12 | 3226 | 44:1 -44:18 |
| 3171 | 12:9 -13:3 | 3199 | 29:13 -30:2 | 3227 | 44:19 -45:5 |
| 3172 | 13:4 -13:20 | 3200 | 30:3 -30:18 | 3228 | 45:6 -45:15 |
| 3173 | 13:21 -14:11 | 3201 | 30:19 -31:10 | 3229 | 45:16 -45:26 |
| 3174 | 14:12 -15:3 | 3202 | 31:11 -31:26 | 3230 | 46:1 -46:11 |
| 3175 | 15:4 -16:2 | 3203 | 31:27 -32:9 | 3231 | 46:12 -47:4 |
| 3176 | 16:3 -16:19 | 3204 | 32:10 -33:4 | 3232 | 47:5 -47:19 |
| 3177 | 16:20 -17:7 | 3205 | 33:5 -33:18 | 3233 | 47:20 -48:9 |
| 3178 | 17:8 -17:32 | 3206 | 33:19 -34:3 | 3234 | 48:10 -48:21 |
| 3179 | 18:1 -18:19 | 3207 | 34:4 -34:19 | 3235 | 48:22 -49:9 |
| 3180 | 18:20 -19:5 | 3208 | 34:20 -35:11 | 3236 | 49:10 -50:7 |
| 3181 | 19:6 -19:27 | 3209 | 35:12 -36:5 | 3237 | 50:8 -50:19 |
| 3182 | 19:28 -20:15 | 3210 | 36:6 -36:22 | 3238 | 50:20 -51:4 |
| 3183 | 20:16 -21:2 | 3211 | 36:23 -37:11 | 3239 | 51:5 -51:18 |
| 3184 | 21:3 -21:19 | 3212 | 37:12 -37:28 | 3240 | 51:19 -51:30 |
| 3185 | 21:20 -22:7 | 3213 | 37:29 -38:15 | 3241 | BARUCH 1:1 - 1:14 |
| 3186 | 22:8 -22:21 | 3214 | 38:16 -38:27 | 3242 | 1:15 - 2:10 |
| 3187 | 22:22 -23:8 | 3215 | 38:28 -39:3 | 3243 | 2:11 - 2:26 |
| 3188 | 23:9 -23:17 | 3216 | 39:4 -39:16 | 3244 | 2:27 - 3:9 |
| 3189 | 23:18 -24:4 | 3217 | 39:17 -39:31 | 3245 | 3:10 - 3:23 |
| 3190 | 24:5 -24:20 | 3218 | 39:32 -40:11 | 3246 | 3:24 - 4:4 |
| 3191 | 24:21 -25:1 | 3219 | 40:12 -40:28 | 3247 | 4:5 - 4:21 |
| 3192 | 25:2 -25:17 | 3220 | 40:29 -41:10 | 3248 | 4:22 - 4:34 |
| 3193 | 25:18 -26:9 | 3221 | 41:11 -41:23 | 3249 | 4:35 - 5:9 |
| 3194 | 26:10 -27:5 | 3222 | 42:1 -42:13 | 3250 | JEREMIA 6:1 - 6:19 |
| 3195 | 27:6 -27:22 | 3223 | 42:14 -43:1 | 3251 | 6:20 - 6:41 |
| 3196 | 27:23 -28:8 | 3224 | 43:2 -43:16 | 3252 | 6:42 - 6:59 |

FIG.15C APOCRYPHA WORKABLE MODEL

| 72 COL.A | 74 COL.B | 72 COL.A | 4 74 COL.B | 72 COL.A | 74 COL.B |
|---|---|---|---|---|---|
| 3253 | JEREMIA 6:60 - 6:73 | 3281 | 5:21 - 5:39 | 3309 | 13:31 -13:48 |
| 3254 | SONG OF 1:1 - 1:15 | 3282 | 5:40 - 5:57 | 3310 | 13:49 -14:9 |
| 3255 | 1:16 - 1:31 | 3283 | 5:58 - 6:7 | 3311 | 14:10 -14:26 |
| 3256 | 1:32 - 1:51 | 3284 | 6:8 - 6:27 | 3312 | 14:27 -14:40 |
| 3257 | 1:52 - 1:68 | 3285 | 6:28 - 6:46 | 3313 | 14:41 -15:8 |
| 3258 | SUSANNA 1:1 - 1:18 | 3286 | 6:47 - 6:63 | 3314 | 15:9 -15:27 |
| 3259 | 1:19 - 1:41 | 3287 | 7:1 - 7:18 | 3315 | 15:28 -16:2 |
| 3260 | 1:42 - 1:55 | 3288 | 7:19 - 7:36 | 3316 | 16:3 -16:17 |
| 3261 | 1:56 - 1:64 | 3289 | 7:37 - 7:50 | 3317 | 16:18 -18:24 |
| 3262 | BELL & 1:1 - 1:15 | 3290 | 8:1 - 8:16 | 3318 | 2 MACA 1:1 - 1:18 |
| 3263 | 1:16 - 1:30 | 3291 | 8:17 - 8:32 | 3319 | 1:19 - 1:36 |
| 3264 | 1:31 - 1:42 | 3292 | 9:1 - 9:21 | 3320 | 2:1 - 2:18 |
| 3265 | PRAYER 1:1 - 1:8 | 3293 | 9:22 - 9:42 | 3321 | 2:19 - 3:2 |
| 3266 | 1:9 - 1:15 | 3294 | 9:43 - 9:62 | 3322 | 3:3 - 3:17 |
| 3267 | 1 MACA 1:1 - 1:19 | 3295 | 9:63 -10:9 | 3323 | 3:18 - 3:32 |
| 3268 | 1:20 - 1:38 | 3296 | 10:10 -10:28 | 3324 | 3:33 - 4:6 |
| 3269 | 1:39 - 1:61 | 3297 | 10:29 -10:43 | 3325 | 4:7 - 4:20 |
| 3270 | 1:62 - 2:18 | 3298 | 10:44 -10:62 | 3326 | 4:21 - 4:35 |
| 3271 | 2:19 - 2:38 | 3299 | 10:63 -10:78 | 3327 | 4:36 - 4:50 |
| 3272 | 2:39 - 2:60 | 3300 | 10:79 -11:7 | 3328 | 5:1 - 5:14 |
| 3273 | 2:61 - 3:9 | 3301 | 11:8 -11:28 | 3329 | 5:15 - 5:27 |
| 3274 | 3:10 - 3:27 | 3302 | 11:29 -11:41 | 3330 | 6:1 - 6:17 |
| 3275 | 3:28 - 3:44 | 3303 | 11:42 -11:60 | 3331 | 6:18 - 6:31 |
| 3276 | 3:45 - 3:60 | 3304 | 11:61 -12:4 | 3332 | 7:1 - 7:14 |
| 3277 | 4:1 - 4:25 | 3305 | 12: 5 -12:25 | 3333 | 7:15 - 7:29 |
| 3278 | 4:26 - 4:44 | 3306 | 12:26 -12:44 | 3334 | 7:30 - 8:5 |
| 3279 | 4:45 - 5:2 | 3307 | 12:45 -13:10 | 3335 | 8:6 - 8: 18 |
| 3280 | 5:3 - 5:20 | 3308 | 13:11 -13:30 | 3336 | 8:19 - 8:32 |

FIG.15D APOCRYPHA WORKABLE MODEL

5

| 72 COL.A | 74 COL.B | 72 COL.A | 74 COL.B | 72 COL.A | 74 COL.B |
|---|---|---|---|---|---|
| 3337 | 2 MACA 8:33 - 9:8 | 3365 | 5:31 - 5:46 | 3393 | 17:9 -18:4 |
| 3338 | 9:9 - 9:24 | 3366 | 5:47 - 6:7 | 3394 | 18:5 -18:24 |
| 3339 | 9:25 -10:9 | 3367 | 6:8 - 6:24 | 3395 | PSALMS 151:1 -151:7 |
| 3340 | 10:10 -10:24 | 3368 | 6:25 - 6:36 | | |
| 3341 | 10:25 -11:3 | 3369 | 6:37 - 7:9 | | |
| 3342 | 11:4 -11:21 | 3370 | 7:10 - 7:23 | | |
| 3343 | 11:22 -12:2 | 3371 | 4 MACA 1:1 - 1:17 | | |
| 3344 | 12:3 -12:17 | 3372 | 1:18 - 2:5 | | |
| 3345 | 12:18 -12:34 | 3373 | 2:6 - 2:24 | | |
| 3346 | 12:35 -12:45 | 3374 | 3:1 - 3:21 | | |
| 3347 | 13:1 -13:15 | 3375 | 4:1 - 4:16 | | |
| 3348 | 13:16 -14:5 | 3376 | 4:17 - 5:9 | | |
| 3349 | 14:6 -14:22 | 3377 | 5:10 - 5:31 | | |
| 3350 | 14:23 -14:37 | 3378 | 5:32 - 6:17 | | |
| 3351 | 14:38 -15:8 | 3379 | 6:18 - 7:4 | | |
| 3352 | 15:9 -15:19 | 3380 | 7:5 - 8:1 | | |
| 3353 | 15:20 -15:30 | 3381 | 8:2 - 8:15 | | |
| 3354 | 15:31 -15:39 | 3382 | 8:16 - 9:7 | | |
| 3355 | 3 MACA 1:1 - 1:12 | 3383 | 9:8 - 9:27 | | |
| 3356 | 1:13 - 2:1 | 3384 | 9:28 -10:18 | | |
| 3357 | 2:2 - 2:18 | 3385 | 10:19 -11:24 | | |
| 3358 | 2:19 - 2:32 | 3386 | 11:25 -12:18 | | |
| 3359 | 2:33 - 3:12 | 3387 | 12:19 -13:19 | | |
| 3360 | 3:13 - 3:24 | 3388 | 13:20 -14:10 | | |
| 3361 | 3:25 - 4:7 | 3389 | 14:11 -15:8 | | |
| 3362 | 4:8 - 4:18 | 3390 | 15:9 -15:24 | | |
| 3363 | 4:19 - 5:15 | 3391 | 15:25 -16:14 | | |
| 3364 | 5:16 - 5:30 | 3392 | 16:15 -17:8 | | |

FIG.15E APOCRYPHA WORKABLEL MODEL

CONCORDANCE

| 76 COL.C | 78 COL.D | | 80 COL.E | 76 COL.C | 78 COL.D | | 80 COL.E |
|---|---|---|---|---|---|---|---|
| 4001 | A | - | absent | 4029 | dog | - | draw |
| 4002 | absent | - | advise | 4030 | draw | - | dumb |
| 4003 | advise | - | almighty | 4031 | dumb | - | earth |
| 4004 | almighty | - | arise | 4032 | earth | - | eat |
| 4005 | arise | - | avenge | 4033 | eat | - | eleven |
| 4006 | avenge | - | barren | 4034 | eleven | - | enemy |
| 4007 | barren | - | believe | 4035 | enemy | - | err |
| 4008 | believe | - | bitter | 4036 | err | - | ever |
| 4009 | bitter | - | book | 4037 | ever | - | exalt |
| 4010 | book | - | brimstone | 4038 | exalt | - | extol |
| 4011 | brimstone | - | camp | 4039 | extol | - | faith |
| 4012 | camp | - | chariot | 4040 | faith | - | fall |
| 4013 | chariot | - | clap | 4041 | fall | - | fast |
| 4014 | clap | - | cold | 4042 | fast | - | favour |
| 4015 | cold | - | complaint | 4043 | favour | - | feet |
| 4016 | complaint | - | consist | 4044 | feet | - | field |
| 4017 | consist | - | correction | 4045 | field | - | fire |
| 4018 | correction | - | covet | 4046 | fire | - | fresh |
| 4019 | covet | - | cup | 4047 | fresh | - | folly |
| 4020 | cup | - | daughter | 4048 | folly | - | forgave |
| 4021 | daughter | - | death | 4049 | forgave | - | forsake |
| 4022 | death | - | decline | 4050 | forsake | - | free |
| 4023 | decline | - | deliverance | 4051 | free | - | full |
| 4024 | deliverance | - | despise | 4052 | full | - | gate |
| 4025 | despise | - | devise | 4053 | gate | - | give |
| 4026 | devise | - | dim | 4054 | give | - | glory |
| 4027 | dim | - | disobedient | 4055 | glory | - | godliness |
| 4028 | disobedient | - | dog | 4056 | godliness | - | goodly |

FIG.16A CONCORDANCE WORKABLE MODEL

2

| 76 COL.C | 78 COL.D | | 80 COL.E | 76 COL.C | 78 COL.D | | 80 COL.E |
|---|---|---|---|---|---|---|---|
| 4057 | goodly | - | greater | 4085 | pay | - | perish |
| 4058 | greater | - | hair | 4086 | perish | - | pity |
| 4059 | hair | - | hard | 4087 | pity | - | pleasure |
| 4060 | hard | - | heal | 4088 | pleasure | - | pot |
| 4061 | heal | - | herring | 4089 | pot | - | pray |
| 4062 | herring | - | heaven | 4090 | pray | - | present |
| 4063 | heaven | - | help | 4091 | present | - | profane |
| 4064 | help | - | hole | 4092 | profane | - | prosper |
| 4065 | hole | - | honest | 4093 | prosper | - | punch |
| 4066 | honest | - | house | 4094 | punch | - | quiet |
| 4067 | house | - | I | 4095 | quiet | - | read |
| 4068 | I | - | iniquity | 4096 | read | - | receive |
| 4069 | iniquity | - | joy | 4097 | receive | - | redeemer |
| 4070 | joy | - | keeper | 4098 | redeemer | - | remain |
| 4071 | keeper | - | knowledge | 4099 | remain | - | renew |
| 4072 | knowledge | - | liberty | 4100 | renew | - | request |
| 4073 | liberty | - | living | 4101 | request | - | resurrection |
| 4074 | living | - | lord | 4102 | resurrection | - | reward |
| 4075 | lord | - | magnify | 4103 | reward | - | right |
| 4076 | magnify | - | matter | 4104 | right | - | righteousness |
| 4077 | matter | - | merchant | 4105 | righteousness | - | river |
| 4078 | merchant | - | minister | 4106 | river | - | root |
| 4079 | minister | - | much | 4107 | root | - | sacrifice |
| 4080 | much | - | neck | 4108 | sacrifice | - | salvation |
| 4081 | neck | - | now | 4109 | salvation | - | satisfy |
| 4082 | now | - | old | 4110 | satisfy | - | saw |
| 4083 | old | - | own | 4111 | saw | - | secret |
| 4084 | own | - | pay | 4112 | secret | - | seem |

FIG.16B CONCORDANCE WORKABLE MODEL

3

| 76 COL.C | 78 COL.D | | 80 COL.E |
|---|---|---|---|
| 4113 | seem | - | set |
| 4114 | set | - | sight |
| 4115 | sight | - | slain |
| 4116 | slain | - | smitten |
| 4117 | smitten | - | some |
| 4118 | some | - | soul |
| 4119 | soul | - | speech |
| 4120 | speech | - | spiritual |
| 4121 | spiritual | - | stand |
| 4122 | stand | - | stick |
| 4123 | stick | - | straight |
| 4124 | straight | - | submit |
| 4125 | submit | - | T |
| 4126 | T | - | teacher |
| 4127 | teacher | - | terror |
| 4128 | terror | - | thirst |
| 4129 | thirst | - | tongue |
| 4130 | tongue | - | tree |
| 4131 | tree | - | truth |
| 4132 | truth | - | ungodly |
| 4133 | Ungodly | - | V |
| 4134 | V | - | vision |
| 4135 | vision | - | wait |
| 4136 | wait | - | want |
| 4137 | want | - | water |
| 4138 | water | - | way |
| 4139 | way | - | weapon |
| 4140 | weapon | - | wept |

| 76 COL.C | 78 COL.D | | 80 COL.E |
|---|---|---|---|
| 4141 | wept | - | wicked |
| 4142 | wicked | - | wine |
| 4143 | wine | - | woman |
| 4144 | woman | - | word |
| 4145 | word | - | work |
| 4146 | work | - | world |
| 4147 | world | - | wound |
| 4148 | wound | - | Y |
| 4149 | Y | - | you |
| 4150 | you | - | end of concordance |

FIG.16C CONCORDANCE WORKABLE MODEL

GLOSSARY

| 76 COL.C | 78 COL.D | | 80 COL.E |
|---|---|---|---|
| 5001 | A | - | Absalom |
| 5002 | Absalom | - | Ahab |
| 5003 | Ahab | - | altar |
| 5004 | altar | - | Amos |
| 5005 | Amos | - | angel |
| 5006 | angel | - | Ararat |
| 5007 | Ararat | - | Athens |
| 5008 | Athens | - | Balaam |
| 5009 | Balaam | - | Beelzebub |
| 5010 | Beelzebub | - | Boaz |
| 5011 | Boaz | - | Caiaphas |
| 5012 | Caiaphas | - | Carmel |
| 5013 | Carmel | - | chariot |
| 5014 | chariot | - | church |
| 5015 | church | - | covenant |
| 5016 | covenant | - | Cyprus |
| 5017 | Cyprus | - | deacon |
| 5018 | deacon | - | dog |
| 5019 | dog | - | Egypt |
| 5020 | Egypt | - | elders |
| 5021 | elders | - | Emmaus |
| 5022 | Emmaus | - | exile |
| 5023 | exile | - | fasting |
| 5024 | fasting | - | flood |
| 5025 | flood | - | frankincense |
| 5026 | frankincense | - | Gilead |
| 5027 | Gilead | - | Haran |

| 76 COL.C | 78 COL.D | | 80 COL.E |
|---|---|---|---|
| 5028 | Haran | - | Herodians |
| 5029 | Herodians | - | hyssop |
| 5030 | hyssop | - | Jehovah |
| 5031 | Jehovah | - | Jerusalem |
| 5032 | Jerusalem | - | Jew |
| 5033 | Jew | - | Joppa |
| 5034 | Joppa | - | Judges |
| 5035 | Judges | - | lion |
| 5036 | lion | - | lute |
| 5037 | lute | - | manna |
| 5038 | manna | - | Megiddo |
| 5039 | Megiddo | - | miracle |
| 5040 | miracle | - | money |
| 5041 | money | - | money changers |
| 5042 | money changers | - | mourning |
| 5043 | mourning | - | Nazareth |
| 5044 | Nazareth | - | Nineveh |
| 5045 | Nineveh | - | Palestine |
| 5046 | Palestine | - | parable |
| 5047 | parable | - | Pentecost |
| 5048 | Pentecost | - | Pharisees |
| 5049 | Pharisees | - | Philistines |
| 5050 | Philistines | - | prophet |
| 5051 | prophet | - | Publicans |
| 5052 | Publicans | - | Sabbath |
| 5053 | Sabath | - | Samaria |
| 5054 | Samaria | - | Scribes |
| 5055 | Scribes | - | seal |

FIG.17A GLOSSARY WORKABLE MODEL

2

| 76 | 78 | | 80 |
|---|---|---|---|
| COL.C | COL.D | | COL.E |
| 5056 | seal | - | shepherd |
| 5057 | shepherd | - | Sinai |
| 5058 | Sinai | - | swine |
| 5059 | swine | - | temple |
| 5060 | temple | - | time |
| 5061 | time | - | tribute |
| 5662 | tribute | - | vows |
| 5063 | vows | - | wine |
| 5064 | wine | - | Zealots |
| 5065 | Zealots | - | end of glossary |

FIG.17B GLOSSARY WORKABLE MODEL

METHOD OF MODIFYING AND ARRANGING BIBLE TEXT AND IDENTIFYING BIBLE TEXT PAGES FOR PUBLISHING QUICK-REFERENCE BIBLES

BACKGROUND—FIELD OF INVENTION

This invention relates to Bibles, specifically to a method of modifying and arranging Bible text for publication to allow quick and easy location of cited text by page identification.

BACKGROUND—DESCRIPTION OF PRIOR ART

The Bible is the world's best selling book. It is also credited with being the one book that is most read, most meditated upon, most taught, most studied, most quoted, most cited, and printed in more languages than any other book in existence. Yet, in spite of these many attributes, there is no quick and easy way to locate cited text or other specific text in the Bible.

The Bible is subdivided into a series of books, chapters, and verses. The reference system in common use for the Bible utilizes the names of the books, together with chapter and verse, for example, John 3:16; Ruth 2:1–11; and Matthew 1:1–19.

The problem of cited Bible text and other specific Bible text being difficult and time consuming to locate has existed for centuries. It is mostly because, heretofore, there has been no uniform method of publishing bibles.

There are hundreds of different versions and editions of Bibles being published and used today, and in many different languages. Different publishers use different layouts of Bible text for publishing Bibles. As a result any given text in any given Bible is usually located on different page numbers in other versions and editions of other Bibles. Thorough search of prior art does not reveal a successful solution to this problem. However, some limited attempts have been made in this direction.

Various index systems for multiple-page books such as telephone directories, dictionaries, airline guides, and others, which could include Bibles have been proposed. See, for example, U.S. Pat. No. 3,463,515 to Thompson (1969); U.S. Pat. No. 3,561,147 to Valencia (1971); U.S. Pat. No. 3,995,389 to Mathis (1976); and U.S. Pat. No. 4,019,759 to Stanton (1977). These various proposals only address the problem on a very limited scale and at a restricted level utilizing a combination of index tabs and other paraphernalia which must be purchased and attached to each book by the book owner.

A more recent attempt to address the problem was made in U.S. Pat. No. 4,978,143 to Ericson (1990) where a book indexing system is used to locate book chapters or other similar parts of the Bible. Ericson's invention also has several disadvantages:

(a) It requires an index table and page tabs to be purchased by the Bible owner and placed manually on each individual Bible.

(b) It is limited to locating only book chapters or similar parts of the Bible which have to be predetermined when installing the indexing kit.

(c) The Bible owner must bear the expense of purchasing the indexing kit and spend time installing it on his/her individual Bible.

(d) This indexing system does not meet the universal need that exists for a method to locate any cited book, chapter, verse, or item in the Bible quickly and easily, regardless of which version, edition, or language of Bible used.

Therefore, Ericson's indexing system is not likely to be accepted or widely used by the Bible-purchasing, Bible-using public.

SUMMARY

The present invention is a method of modifying and arranging Bible text and identifying Bible text pages for publishing quick-reference Bibles, comprising the steps of:

a. modifying and arranging predetermined segments of Bible text for predetermined Bible text pages so that said segments of Bible text and like segments of equivalent text of other Bible versions can be published on the space available on like predetermined Bible text pages so that Bible text references can be made by page identification; and b. identifying said predetermined Bible text pages so that said Bible text pages can be quickly and easily located by said page identification.

Accordingly, several objects and advantages of the present invention are to provide a method of modifying and arranging Bible text for publication and identifying Bible pages for publication so that:

(a) Bible text can be easily cited by page identification number and quickly and easily located by page identification number regardless of version, edition, or language of Bible used. This solves the age-old time-consuming problem of searching for cited text using the current reference system utilizing Bible books, chapters, and verses.

(b) The method of this invention can be quickly adopted and uniformly used by Bible publishers throughout the world, and will be readily accepted by Bible purchasers and Bible users throughout the world.

(c) There is no need for the Bible user to purchase and install page tabs, kits, or other paraphernalia on individual Bibles.

Further objects and advantages of the present invention provide that Bibles published will have predetermined equivalent text published on predetermined equivalent numbered pages to allow text to be cited and located by page identification number;

have clear and distinct page numbers located in the lower outside corner of each page for quick and easy location of cited page;

have space provided at the end of the text on each page for user notes;

permit the unique style and printing format of the text of the different Bible versions to be retained;

permit the location of favorite Bible text and special Bible verses to be easily memorized and cited by page identification number;

include but not be limited to the Protestant Bible, the Catholic Bible, the Old Testament, the New Testament, the Apocrypha, the Bible concordance, and the Bible glossary. These Bible text groups can be published separately, together, or in any combination thereof, and in different languages;

have special identification on outside front cover of Bibles to readily identify Bibles and to help promote the sale and use of said Bibles;

have a text group numbering system which permits easier recognition and location of text cited by page identification number.

Further objects and advantages will become apparent from a consideration of the ensuing description and drawings.

BRIEF DESCRIPTION OF THE DRAWINGS

In the drawings, closely related figures have the same number but different alphabetical suffixes.

Old Testament FIGS. 1A to 1D, 2A to 2D, 3A to 3D, and New Testament FIGS. 4A to 4D, 5A to 5D, 6A to 6D show sample pages of Old Testament and New Testament Bible text showing various aspects of the present invention in four different versions and editions of the Bible.

FIG. 7 shows a sample page of New Testament Bible text showing various aspects of the present invention in a foreign language (Spanish) version.

FIGS. 8A and 8B show sample pages from the Apocrypha showing various aspects of the present invention in two different editions and versions of the Apocrypha.

FIGS. 9A and 9B show sample pages from a Bible concordance showing various aspects of the present invention as applied to a Bible concordance.

FIGS. 10A and 10B show sample pages from a Bible glossary showing various aspects of the present invention as applied to a Bible glossary.

FIGS. 13A to 13P show an Old Testament workable model of the method of the present invention.

FIGS. 14A to 14E show a New Testament workable model of the method of the present invention.

FIGS. 15A to 15E show an Apocrypha workable model of the method of the present invention.

FIGS. 16A to 16C show a Bible concordance workable model of the method of the present invention.

FIGS. 17A and 17B show a Bible glossary workable model of the method of the present invention.

Reference Numerals In Drawings

Figures 11, 12:
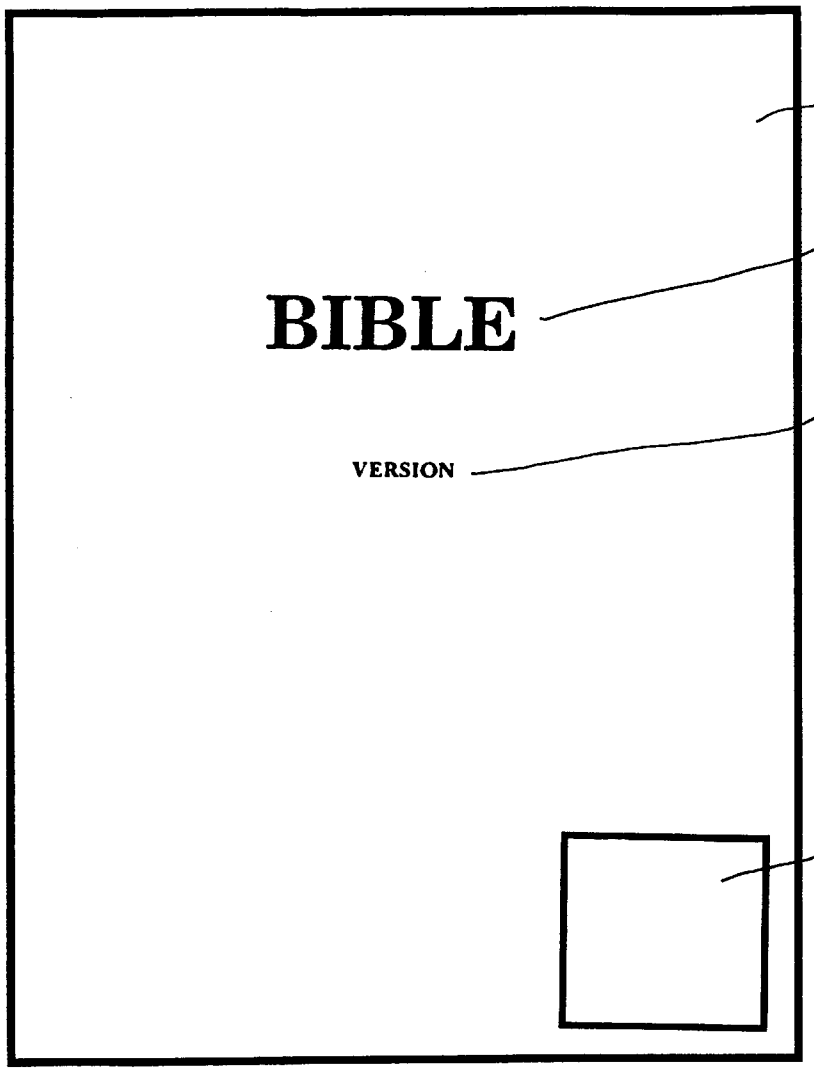
FIG. 11 shows a front outside view of a Bible showing method for special Bible identification of Bibles published using the method of the present invention.
FIG. 12 shows a Bible text group page numbering aspect of the present invention.

| | |
|---|---|
| 30 Bible page | 56 outside front cover |
| 32 Bible text | 58 Bible name |
| 34 blank space | 60 Bible version |
| 36 page identification number | 62 special Bible identification |
| 38 punctuation marks | 64 text group numbering table |
| 40 arrangement of verses | 66 column X |
| 42 layout of verse numbers | 68 column Y |
| 44 John 3:16 | 70 column Z |
| 46 Matthew 1:1 | 72 column A |
| 48 beginning topic | 74 column B |
| 50 specific topic | 76 column C |
| 52 concordance entry topic | 78 column D |
| 54 glossary page | 80 column E |

FIGS. 1A TO 7

Typical applications of the present invention are illustrated in the following figures. These figures show portions of several different versions and editions of the Old Testament and the New Testament: Old Testament FIGS. 1A, 2A, 3A, and New Testament 4A, 5A, 6A show the King James Version; Old Testament FIGS. 1B, 2B, 3B, and New Testament 4B, 5B, 6B show the Living Bible Paraphrased Version; Old Testament FIGS. 1C, 2C, 3C, and New Testament 4C, 5C, 6C show the New English Bible Version; and Old Testament FIGS. 1D, 2D, 3D, and New Testament 4D, 5D, 6D show the Revised Standard Version. FIG. 7 shows a portion of the New Testament in a foreign language (Spanish). These several figures are shown for comparison purposes and to show that the method of the present invention is workable with all Bible versions, editions, and languages.

As shown in FIGS. 1A to 7, the method of the present invention allocates a predetermined amount of Bible text to each predetermined Bible page being sure that the predetermined amount of allocated Bible text can be actually printed on the predetermined Bible page. That is to say that the space on the page is sufficient enough to allow the allotted text to be printed on the page by the publisher. And further, being sure that the equivalent text of other versions, editions, and languages can be actually printed on the corresponding page of each respective publication.

For example, in Old Testament FIGS. 1A to 1D predetermined amount of Bible text 32 allocated to Bible page number 1 is Genesis, Chapter 1, Verses 1–24. Predetermined amount of Bible text 32 can actually be printed by the publisher on page 1 of the King James Version (FIG. 1A), the Living Bible Paraphrased Version (FIG 1B), the New English Bible Version (FIG. 1C), the Revised Standard Version (FIG. 1D), and other versions and editions of the Bible. Therefore, using the method of the present invention, and using this example, any or all verses from Genesis 1:1–24 can be cited as being on page 1 and quickly and easily located by page number on page 1, regardless of version or edition of Bible used.

A similar example is shown in Old Testament FIGS. 2A to 2D wherein predetermined amount of Bible text 32 allocated to page number 354 is Ruth 1:16–2:11. Bible text 32 and its equivalent text in other versions and languages can be actually printed by the publisher on page 354 of every Bible printed using the method of the present invention. Therefore, any and all verses in Ruth 1:16–2:11 can be cited as being on page 354 and quickly and easily located on page 354 by page number, regardless of version or edition of Bible used.

Other similar examples are shown in Old Testament FIGS. 3A to 3D wherein predetermined amount of Bible text 32 allocated to page number 1321 is Malachi 4:1–6; New Testament FIGS. 4A to 4D wherein predetermined amount of Bible text 32 allocated to page number 2001 is Matthew 1:1–19; New Testament FIGS. 5A to 5D wherein predetermined amount of Bible text 32 allocated to page number 2125 is John 2:24–25, 3:1–24; and New Testament FIGS. 6A to 6D wherein predetermined amount of Bible text 32 allocated to page number 2360 is Revelation 22:1–21. Using the method of the present invention, and using this example, one can readily see that said Bible text can be cited by page number and quickly and easily located by page number, regardless of version or edition of Bible used.

A further similar example is seen in FIG. 7 which is a New Testament Spanish version wherein Bible text 32 in Spanish illustrates that the method of the present invention is very workable in other languages.

Further typical applications of the method of the present invention can be seen in FIGS. 1A to 7 as follows:

(a) A clear and distinct page identification number 36 is located on the lower outside corner of the Bible pages for quick and easy location of pages. Page identification numbers are located on the lower right corner of odd-numbered pages and in the lower left corner of even-numbered pages.

(b) A blank space 34 follows the Bible text on each Bible page. Blank space 34 can be used for notes or other purposes by Bible users. Blank space 34 is large on some pages and small on other pages due to the fact that some equivalent Bible text does not require as much space on the page as other equivalent Bible text requires, and some equivalent Bible text requires more space. Therefore, blank space 34 on each page will vary in size from page to page.

(c) Another application of the method of the present invention is that it allows the various versions of the Bible to retain their own unique style and printing format that are presently being used. One example is the New English Bible Version in Old Testament FIGS. 1C, 2C, 3C, and New Testament 4C, 5C, 6C, where Bible text 32 is printed across the entire Bible page 30, while the other versions in Old Testament FIGS. 1A and 3D and New Testament FIGS. 4A to 7 have Bible text 32 printed in columns. Other examples are seen in frequent use of punctuation marks 38 in Bible text 32 in Old Testament FIGS 1B, 2B, 3B, and New Testament FIGS. 5B, 6B; in special arrangement of verses 40 in Old Testament FIG. 2D and New Testament FIGS. 4D 6D; and in layout of verse numbers 42 in Old Testament FIGS. 1C, 2C, 3C, and New Testament FIGS. 4C, 5C, 6C. Yet another feature of various versions of Bible text is that the text is more wordy than the equivalent text in some versions, and less wordy than the equivalent text in other versions. This can be seen by comparing Bible text 32 in FIG. 1A which is the Old Testament King James Version with Bible text 32 in FIG. 1B which is the Old Testament Living Bible Paraphrased Version. One can readily see that equivalent Bible text 32 in FIG. 1B is less wordy than Bible text 32 in FIG. 1A.

Another application of the method of this invention is that it permits and encourages quick and easy memorization of location of favorite Bible text and special Bible verses by using page numbers. For example, it is easy to learn and remember that John 3:16 44 (New Testament FIGS. 5A to 5D) is on page 2125 of every Bible; that the 23rd Psalm is on page 733 of every Bible; that the New Testament begins with Matthew 1:1 46 (FIGS. 4A to 4C and FIG. 7) on page 2001 of every Bible; that 2 Timothy 2:15 is on page 2293 of every Bible; and the potential is great.

FIGS. 8A AND 8B

Another application of the method of the present invention is that it includes the Apocrypha. FIGS. 8A and 8B show portions of the Apocrypha showing Bible page 30, Bible text 32, blank space 34, and Bible page identification number 36. The same positive aspects of the method of this invention described in FIGS. 1A to 7 apply equally as well to the Apocrypha.

FIGS. 9A AND 9B

Another application of the method of the present invention is that it includes a Bible concordance for quick and easy citing and locating concordance topics and concordance references by page number. FIGS. 9A and 9B show sample portions of a Bible concordance layout.

Predetermined segments of concordance topics are allocated to be printed on predetermined concordance pages, being sure that the predetermined segments of allocated concordance topics and accompanying text can be actually printed on said pages. That is to say that the space on said pages is sufficient enough to allow the allotted concordance segments with accompanying text to be printed on said pages by the publisher. And further, being sure that predetermined equivalent concordance segments, including accompanying text, of other versions, editions, and languages, can be actually printed on said concordance pages of each respective publication.

For example, each predetermined concordance segment allocated to each predetermined concordance page is defined as beginning with a predetermined beginning topic and proceeding in alphabetical order to include all topics up to but not including a predetermined specific topic, wherein the predetermined specific topic is the beginning topic for the succeeding page of the concordance. There is one exceptance to this procedure and that is that the last topic of the last segment in the concordance will be the last topic on the last page of the concordance.

For example, in FIG. 9A predetermined beginning topic 48 is the first topic in the segment. The topics of the segment proceed in alphabetical order to include all topics up to but not including predetermined specific topic 50 which in this case is ABSENT which is the first topic for the succeeding page of the concordance. Therefore, all concordance topics in all concordances published by the method of the present invention can be cited by page number and quickly and easily located by page numbers, regardless of version or edition of Bible used.

And further, all concordance topic references can be cited with a reference page number in addition to the present custom of citing references by book, chapter, and verse. For example, in FIG. 9A concordance entry topic 52 ABATED has three references cited by book, chapter, and verse. The concordance user is still faced with the age-old problem of searching the Bible to locate this cited text. The method of the present invention includes a page number for each cited text: Gen. 8:3, p. 9; Lev. 27:18, p. 166; and Deut. 34:7, p. 282 (page numbers from FIGS. 13A, 13B, and 13D—workable model of Old Testament). Therefore, references cited in concordance can be quickly and easily located by page identification number, regardless of version, edition, or language of Bible used.

Each page of the concordance also has page identification number 36 and blank space 34 as described in FIGS. 1A to 7.

FIGS. 10A AND 10B

Another application of the method of the present invention is that it includes a Bible glossary for quick and easy citing and locating glossary topics and cited references by page number. The Bible glossary is designed and operates in the same manner as the Bible concordance to locate topics and cited references. The detailed description of locating Bible concordance topics and cited references can be applied to the Bible glossary topics and cited references as well, therefore, will not be repeated here. FIGS. 10A and 10B show portions of a Bible glossary showing glossary page 54 with predetermined beginning topic 50 and predetermined specific topic 52. Predetermined specific topic 52 denotes the ending of one page and the beginning of the next page as described in the preceding description of the concordance. As with the concordance, every topic in every Bible glossary published by the method of the present invention can be cited by page number and quickly and easily located by page number, regardless of version, edition, or language of Bible used.

Also, each page of the glossary has page identification number 36 and blank space 34 as described in FIGS. 1A to 7.

FIG. 11

FIG. 11 shows a typical view of a Bible outside front cover 56 which shows Bible name 58 and Bible version 60. Another application of the method of the present invention places a special Bible identification 62 in a prominent location on the outside front cover of all Bibles published using said method for publication so said Bibles can be readily recognized by the Bible-purchasing and Bible-using public as Bibles wherein text can be cited and quickly and easily located by page identification number, regardless of version, edition, or language of Bible used.

Said special Bible identification can be a name, symbol, trademark, or other identification which also can be used to advertise and promote the sale and use of Bibles using this method for publication. An example is a possible future trademark name FEN (acronym for Furniss Edition Numbered). Said Bibles using said method for publication could be called FEN BIBLES and advertised, sold, and promoted using said proposed trademark. Therefore, using this example, special Bible identification could be THE FEN BIBLE. The name FEN, as used herein, is not a trademark.

FIG. 12

Another application of the method of the present invention is a text group numbering system which provides for easier recognition and location of Bible text groupings. FIG. 12 shows a text group numbering table 64 which outlines the divisions of the system. Column X 66 divides Bible text into five distinct groups. Column Y 68 shows each group's beginning page number and column Z 70 shows each group's ending page number. The Old Testament text begins with page number 1 and ends with a number greater than 1 but less than 2000. The New Testament text begins with page number 2001 and ends with a number greater than 2001 but less than 3000. The Apocrypha text begins with page number 3001 and ends with a number greater than 3001 but less than 4000. The concordance text begins with page number 4001 and ends with a number greater than 4001 but less than 5000. The glossary text begins with page number 5001 and ends with a number greater than 5001 but less than 6000.

This text group numbering system permits easier recognition and location of text cited by page number.

FIG. 13A to 17B

Applications of the method of the present invention are further shown in FIGS. 13A to 17B which show workable models of the method of the present invention.

FIGS. 13A to 13P show a workable model for the Old Testament, FIGS. 14A to 14E show a workable model for the New Testament, and FIGS. 15A to 15E show a workable model for the Apocrypha. In each figure the Bible text described in each entry in each column B 74 is allocated for printing on the page identified by number immediately to the left in each column A 72. In each case the text defined in column B 74 can actually be printed on the page designated for it, regardless of the version or language used. That is to say that the space on the page is sufficient enough to allow the text to be printed on the page by the publisher.

FIGS. 16A to 16C show a workable model of a Bible concordance, and FIGS. 17A and 17B show a workable model of a Bible glossary. Both models work the same way. Column C 76 lists the page which the topic segment on its immediate right will be printed. Column D 78 lists the first word in the topic segment and column E 80 lists the topic word which the topic segment will extend to but not include. The one exception is that the last topic word in the last segment will be the last topic word in the concordance. The space on each designated page is sufficient enough to allow each word segment topic and its accompanying text to be printed on the page by the publisher, regardless of the version or language of the Bible published.

From the description above, a number of advantages of my method of modifying and arranging Bible text and identifying Bible text pages for publishing quick-reference Bibles for quick and easy location of cited Bible text by page number become evident:

(a) Any and all Bible text can be cited by page number and quickly and easily located by page number, regardless of version or edition of Bible used, regardless of which language it is printed in.

(b) Clear and distinct page numbers are located on the lower outside corner of each page for quick and easy location of cited page.

(c) Space is provided at the end of the text on each page for user notes.

(d) The unique style and printing format of each different version of Bible text can be retained.

(e) The location by page number of favorite Bible text and special Bible verses is easy to memorize and cite by page number.

(f) The method of the present invention includes but is not limited to the following groups which can be published separately, together, or in any combination thereof and in different languages: the Protestant Bible, the Catholic Bible, the Old Testament, the New Testament, the Apocrypha, the Bible concordance, and the Bible glossary.

(h) Special Bible identification on outside front cover of Bibles readily identiy Bibles and promote the sale and use of said Bibles.

(i) Text cited by page number is easier to recognize and locate using the text group numbering system of the present invention.

(j) Workable models provided show that the method of the present invention is very workable and very practical, and that it meets the very great need of being able to quickly and easily locate cited Bible text—a need that has existed for centuries and, heretofore, has been unresolved.

DESCRIPTION OF THE PREFERRED EMBODIMENTS

Accordingly, the reader will see that this invention will provide Bible publishers a uniform method of publishing Bibles with predetermined equivalent text printed on predetermined equivalent numbered pages whereby Bible users can cite text by page number and can quickly and easily locate cited text by page number, regardless of version, edition, or language of Bible used. Furthermore, this invention has the additional advantages in that Bibles published using this method will have clear and distinct page numbers located in the lower outside corner of each Bible page for quick and easy location of cited page;

have space provided at the end of the text on each page for user notes;

permit the unique style and printing format of each different version of Bible text to be retained;

permit the location of favorite Bible text and special Bible verses to be easily memorized and cited by page number;

include but not be limited to the Protestant Bible, the Catholic Bible, the Old Testament, the New Testament, the Apocrypha, the Bible concordance, and the Bible glossary. These Bible text groups can be published separately, together, or in any combination thereof, and in different languages.

have special identification on outside front cover to readily identify Bibles and to help promote the sale and use of Bibles;

have a text group numbering system which permits easier recognition and location of text cited by page number;

are very workable and very practical, and meet the very great need of being able to quickly and easily locate cited text—a need that has existed for centuries.

Although the description above contains many specificities, these should not be construed as limiting the scope of the invention but as merely providing illustrations of some of the presently preferred applications of this invention. For example, different segments of Bible text including concordance and glossary topics can be used; a different page numbering system and a different text group numbering system can be used, the unique style and printing format of current versions of other Bibles can be modified; the identification of Bibles published using this method of publication can be changed; and the method of this invention can be used for Bibles of other religions, etc.

Thus the scope of the invention should be determined by the appended claims and their legal equivalents, rather than by the examples given.

I claim:

1. Method for publishing quick-reference Bibles, comprising the steps of:

a. transforming Bible text into specific Bible text segments whereby each individual specific transformed Bible text segment, regardless of Bible text version or language transformed, can be physically published, with one version only and one language only per page, on the space available on each said Bible segment's designated Bible text page;

b. marking each said designated Bible text page with clear and distinct page identification; and c. combining said transformed Bible text segments, in sequential Bible order, with said marked designated Bible text pages, in numerical order, to form quick-reference Bibles whereby Bible text can be cited by page identification and quickly and easily located by page identification, regardless of Bible version or language.

2. The method of claim 1 wherein said Bible text pages are marked with clear, distinct, and highly-accessible page numbers in the lower outside corner of each page.

3. The method of claim 1 wherein said Bible text pages contain user note space at end of said Bible text on each said Bible text page.

4. The method of claim 1 wherein said Bible pages are numbered using a Text Group Numbering System wherein the Old Testament, New Testament, Apocrypha, Bible concordance, and Bible glossary are each assigned a separate series of page identification numbers for recognition and location of cited Bible text.

5. The method of claim 1 wherein said quick-reference Bibles contain the unique style and printing format of different Bible versions.

6. The method of claim 1 wherein outside front covers of said quick-reference Bibles have special identification for quick and easy recognition and identification of said quick-reference Bibles.

7. The method of claim 1 wherein said quick-reference Bibles contain only the Old Testament and the New Testament.

8. The method of claim 1 wherein said quick-reference Bibles contain only the Old Testament.

9. The method of claim 1 wherein said quick-reference Bibles contain only the New Testament.

10. The method of claim 1 wherein said quick-reference Bibles have quick-reference Bible glossaries wherein said quick-reference Bible glossaries are formed in like manner as said quick-reference Bibles.

11. The method of claim 1 wherein said quick-reference Bibles have quick-reference Bible concordances wherein said quick-reference Bible concordances are formed in like manner as said quick-reference Bibles.

12. The method of claim 11 wherein entry topics of said quick-reference Bible concordances cite Bible text references by page number.

* * * * *